US008872743B2

(12) United States Patent
Ueno

(10) Patent No.: US 8,872,743 B2
(45) Date of Patent: Oct. 28, 2014

(54) LIQUID CRYSTAL DISPLAY DEVICE AND CONTROL METHOD THEREFOR

(75) Inventor: Tetsuya Ueno, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 275 days.

(21) Appl. No.: 13/504,186

(22) PCT Filed: Jul. 23, 2010

(86) PCT No.: PCT/JP2010/062452

§ 371 (c)(1),
(2), (4) Date: Apr. 26, 2012

(87) PCT Pub. No.: WO2011/061966

PCT Pub. Date: May 26, 2011

(65) Prior Publication Data

US 2012/0206513 A1 Aug. 16, 2012

(30) Foreign Application Priority Data

Nov. 20, 2009 (JP) ..... 2009-265386

(51) Int. Cl.
*G09G 3/36* (2006.01)
*G09G 3/34* (2006.01)

(52) U.S. Cl.
CPC ..... *G09G 3/3413* (2013.01); *G09G 3/3607* (2013.01); *G09G 2340/06* (2013.01); *G09G 2360/16* (2013.01); *G09G 2300/0452* (2013.01); *G09G 2320/0242* (2013.01); *G09G 2320/0646* (2013.01); *G09G 2330/021* (2013.01)
USPC ..... 345/88; 345/102; 345/603; 362/97.2

(58) Field of Classification Search
CPC ..... G09G 3/34; G09G 3/20; G09G 3/36; G06F 1/133
USPC ..... 345/88, 102, 690, 603; 362/97.1–97.3
See application file for complete search history.

(56) References Cited

U.S. PATENT DOCUMENTS 6,961,038 B2 * 11/2005 Yoshinaga et al. ..... 345/88
7,893,903 B2 * 2/2011 Utsumi et al. ..... 345/88

(Continued)

FOREIGN PATENT DOCUMENTS

JP 2002-191055 A 7/2002
JP 2005-242300 A 9/2005

(Continued)

OTHER PUBLICATIONS

Official Communication issued in International Patent Application No. PCT/JP2010/062452, mailed on Aug. 17, 2010.

*Primary Examiner* — Lun-Yi Lao
*Assistant Examiner* — Kelly B Hegarty
(74) *Attorney, Agent, or Firm* — Keating & Bennett, LLP

(57) ABSTRACT

The present invention provides a liquid crystal display device including a multiple primary color panel capable of improving the display quality in the vicinity of a monochromatic color, and a control method therefor. The present invention provides a liquid crystal display device that performs display by input thereto of image signals for three colors from outside. The liquid crystal display device includes a liquid crystal display panel and a backlight. A plurality of pixels each including picture elements of four colors or more are formed in a display region of the liquid crystal display panel. Each pixel includes picture elements of three colors, provided with color filters having colors corresponding to the respective colors of the image signals, and at least one picture element of other color(s), provided with a color filter having a color corresponding to a color other than the colors of the image signals. The light emission intensity of the backlight can be controlled in accordance with image signals input. The light emission intensity of the backlight when a monochromatic color or a color close to a monochromatic color is displayed in the display region is greater than the light emission intensity when white is displayed in the display region.

8 Claims, 35 Drawing Sheets

(56) References Cited

U.S. PATENT DOCUMENTS

| | | | | |
|---|---|---|---|---|
| 8,605,017 | B2 * | 12/2013 | Brown Elliott et al. | 345/88 |
| 2002/0122019 | A1 | 9/2002 | Baba et al. | |
| 2004/0066363 | A1 * | 4/2004 | Yamano et al. | 345/98 |
| 2005/0146492 | A1 | 7/2005 | Baba et al. | |
| 2005/0175926 | A1 * | 8/2005 | Sugeta et al. | 430/270.1 |
| 2005/0184952 | A1 | 8/2005 | Konno et al. | |
| 2005/0184998 | A1 | 8/2005 | Yang et al. | |
| 2005/0237288 | A1 * | 10/2005 | Yoshinaga et al. | 345/88 |
| 2008/0238861 | A1 * | 10/2008 | Honda | 345/102 |
| 2009/0059078 | A1 | 3/2009 | Kim et al. | |
| 2009/0085847 | A1 | 4/2009 | Morisue et al. | |
| 2009/0207182 | A1 | 8/2009 | Takada et al. | |
| 2011/0128306 | A1 * | 6/2011 | Utsumi et al. | 345/690 |

FOREIGN PATENT DOCUMENTS

| | | | |
|---|---|---|---|
| JP | 2005-258403 | A | 9/2005 |
| JP | 2007-134752 | A | 5/2007 |
| JP | 2007-206585 | A | 8/2007 |
| JP | 2007-274600 | A | 10/2007 |
| JP | 2009-86054 | A | 4/2009 |
| JP | 2009-86278 | A | 4/2009 |
| JP | 2010-113099 | A | 5/2010 |

* cited by examiner

| | | | |
|---|---|---|---|
| 13R | 13Y | 13R | 13Y |
| 13G | 13B | 13G | 13B |
| 13R | 13Y | 13R | 13Y |
| 13G | 13B | 13G | 13B |

| | | | | | | | |
|---|---|---|---|---|---|---|---|
| 13R | 13G | 13B | 13Y | 13R | 13G | 13B | 13Y |
| 13R | 13G | 13B | 13Y | 13R | 13G | 13B | 13Y |

Fig. 38

| | | | | | | | | | |
|---|---|---|---|---|---|---|---|---|---|
| 13R | 13G | 13B | 13Y | 13C | 13R | 13G | 13B | 13Y | 13C |
| 13R | 13G | 13B | 13Y | 13C | 13R | 13G | 13B | 13Y | 13C |

LIQUID CRYSTAL DISPLAY DEVICE AND CONTROL METHOD THEREFOR

TECHNICAL FIELD

The present invention relates to a liquid crystal display device and a control method therefor. More particularly, the present invention relates to a multiple-primary-color liquid crystal display device and a control method therefor.

BACKGROUND ART

Liquid crystal display devices are already known as display devices that can be made thinner and with less weight than other display devices. A liquid crystal display device includes a liquid crystal display panel that has a plurality of pixels arrayed in a matrix shape.

It is widely known that to realize a color display with this kind of liquid crystal display device, a picture element including a red color filter, a picture element including a green color filter, and a picture element including a blue color filter are formed in each pixel in correspondence with video signals.

In recent years, for purposes such as widening the color reproduction range, liquid crystal display panels (multiple primary color panel) in which picture elements of colors other than RGB (for example, white) are formed have been proposed. For example, the technology described hereunder has been disclosed as specific technology relating to multiple primary color panels.

As technology for appropriately reproducing white when performing color conversion to multiple primary colors, a color conversion apparatus has been disclosed (for example, see Patent Document 1) that performs color conversion of a number of a plurality of colors of inputted image data to a number of a plurality of colors used by a display device that displays an image. The color conversion apparatus includes: white color conversion value calculation means that calculates a color conversion value of image data corresponding to white among a plurality of colors of the inputted image data or a color conversion value for a predetermined point corresponding to white; adjustment value calculation means that, based on the color conversion value corresponding to white, calculates an adjustment value so that a color conversion value corresponding to white after adjustment is positioned inside a color reproduction region that can be displayed by the display device in a color space; and adjustment means that adjusts a color conversion value of the inputted image data using the adjustment value.

Further, as technology for suppressing color tracking while also reducing power consumption and color conversion times, a color conversion matrix creation method has been disclosed (for example, see Patent Document 2) that, based on characteristics of each primary color, creates a color conversion matrix for converting tristimulus values XYZ in an XYZ colorimetric system into signal values for three primary colors with respect to a combination of three primary colors selected from among n primary colors ($n \geq 4$) that are previously specified that can be displayed by a multiple primary color display device. The color conversion matrix creation method includes executing, for all of three primary colors and for all combinations of three primary colors, processing that, for all gradations, repeatedly executes processing including: a step of determining three primary color signal values corresponding to tristimulus values XYZ of a predetermined gradation using a predetermined color conversion matrix; a step of determining three primary color gradation values corresponding to the determined three primary color signal values based on halftone reproduction characteristics of the multiple primary color display device; a step of determining tristimulus values XYZ corresponding to the determined three primary color gradation values based on a device profile of the multiple primary color display device; a step of, after bringing the brightnesses of the tristimulus values XYZ of the predetermined gradations that have been determined into conformity with brightnesses of tristimulus values XYZ of a reference gradation, determining color differences between the tristimulus values XYZ of the predetermined gradation and the tristimulus values XYZ of the reference gradation; a step of, when the determined color difference exceeds a previously specified threshold value, creating and storing a color conversion matrix based on the tristimulus values XYZ of the predetermined gradation, and changing the reference gradation to the predetermined gradation; and a step of changing the predetermined gradation by one gradation or a plurality of gradations; and the method also includes, with respect to a primary color having the shortest wavelength among the three primary colors, setting the threshold value to a value that is less than a threshold value of the other primary colors.

Furthermore, as technology for improving the display brightness of red and also suppressing shifting of the white point to the green side, an electro-optical device that includes a display panel and a light source has been disclosed (for example, see Patent Document 3). The display panel is provided with a plurality of subpixels. Each of the subpixels includes a first colored layer of red, a second colored layer of blue, and third and fourth colored layers of two kinds of colors arbitrarily selected from among hues ranging from blue to yellow. The light source includes a first light source that emits blue light, blue optical wavelength conversion means that converts a part of the blue light to yellow light, and a second light source that emits red light, and emits a combined light of the blue light, the yellow light, and the red light onto the display panel.

Further, as technology for improving color reproducibility in a panel having red, green, blue and white picture elements, a method for driving liquid crystal display elements has been disclosed in which a plurality of pixels of four colors consisting of three primary colors and white are formed that are alternately arranged in a matrix shape, and which displays a color image by means of a plurality of display elements that take four pixels including pixels of each of the three primary colors and white that are adjacent to each other as a single unit (for example, see Patent Document 4). According to this driving method, when ratios of brightness corresponding to drive gradation data for driving the pixels of four colors of the three primary colors and white with respect to the maximum gradation brightness of each pixel are defined as brightness rates, and maximum values among absolute values of differences in the mutual brightness rates of pixels of the three primary colors for each of the plurality of display elements are defined as maximum brightness rate differences based on input gradation data for the three primary colors, gradations values for the four colors consisting of three primary colors and white are set for each of the plurality of display elements so that brightness rates of the pixels of four colors including the three primary colors and white for each of the plurality of display elements respectively become values resulting from adding a brightness rate of a ratio corresponding to a gradation number other than a gradation number that corresponds to the maximum brightness rate difference of set brightness rates having arbitrary values predetermined in accordance with characteristics of the white pixel to the respective brightness rates of the pixels of the three primary colors and multiplying the addition results by a coefficient specified in accordance with maximum brightness rate differences of all display elements in one frame for displaying a color image of one screen and subtracting the brightness rate of the white pixel. Further, data signals of the four colors that respectively correspond to the drive gradation data of these gradation values are respectively supplied to the pixels of four colors including the three primary colors and white of the plurality of display elements.

CITATION LIST

Patent Document

[Patent Document 1] JP 2007-134752A
[Patent Document 2] JP 2007-274600A
[Patent Document 3] JP 2007-206585A
[Patent Document 4] JP 2009-86278A

SUMMARY OF THE INVENTION

However, in the conventional liquid crystal display device including a multiple primary color panel, room for improvement exists in the respect described hereafter. As an example, referring to FIGS. 40 to 43, a case is described in which a picture element (color filter) of yellow (Y) is added to a picture element (color filter) of red (R), a picture element (color filter) of green (G), and a picture element (color filter) of blue (B).

Since normal video signals are signals for the three colors of R, G and B, it is necessary to convert from signals for three colors to signals for four colors. At such time, when a white signal (signals of all of R, G and B have the maximum gradation value) is input, all the picture elements are controlled so as to have the maximum transmissivity (see the left side in FIG. 40). This is to maximize the light utilization efficiency at the time of a white display when it is necessary to output light with the greatest intensity. When this control is performed, points that can not be reproduced arise in a range of a combination of brightnesses and chromaticities that could be reproduced when using picture elements of three colors. In this case, yellow is added as a fourth picture element. Red and green light is radiated from the yellow picture element. When displaying a white signal, all the picture elements are set so as to have the maximum transmissivity, and hence red light is radiated from the R picture element and the Y picture element and green light is radiated from the G picture element and the Y picture element (see the right side in FIG. 40).

In contrast, a case will now be considered in which a red signal (R signal has the maximum gradation, and G and B signals have the minimum gradation) is input. More specifically, in this case, the R picture element is set to have the maximum gradation and the G picture element and B picture element are set to have the minimum gradation. In this case, a display defect arises that is caused by a reduction in the brightness of red, and this defect results in a decrease in the maximum brightness at all chromaticity points.

Although red light is radiated from both the R picture element and the Y picture element when displaying a white signal, red light is only radiated from the R picture element when displaying a red signal. Accordingly, when displaying a red signal, the radiated quantity of red light decreases by a quantity corresponding to the quantity of light radiated from the Y picture element at the time of a white display. In contrast, in a liquid crystal display panel using color filters of the three colors R, G and B, when displaying a red signal and when displaying a white signal, the R picture elements are the only picture elements that relate to the radiated quantity of red light, and furthermore, in both cases, the R picture elements are set so as to have the maximum transmissivity. Consequently, there is no change in the radiated quantity of red light between these two cases.

A similar phenomenon occurs with respect to green light. Accordingly, when a Y picture element is added, the maximum value of the brightness decreases when displaying monochromatic red or monochromatic green, and the range of brightnesses that can be reproduced narrows.

Further, the maximum brightness of the other colors also decreases, and not just the maximum brightness at the time of a monochromatic display.

As shown in FIG. 41, when the horizontal axis is taken as the chromaticity from a white chromaticity point to a red chromaticity point, and the longitudinal axis is taken as the brightness of red (maximum brightness for white is normalized as 1), although the red brightness when using color filters having the three colors R, G and B is 1, the red brightness when using color filters of the four colors R, G, B and Y decreases by an amount corresponding to an amount of light that is not transmitted through the Y picture element. In the range between the white point and the red point, more green light is required as the white point is approached, and therefore it is possible to increase the transmissivity of the Y picture element. Hence, it is possible to radiate red light from the Y picture element. As the white color point is approached to a certain degree, a point A exists at which the radiated quantity of green light matches the required quantity when the transmissivity of the Y picture element is maximized. In a region between the point A and the red point, the red brightness that can be radiated decreases compared to the white point, and a region that is filled in with diagonal lines in FIG. 42 can not be reproduced using color filters of four colors.

A case in which the above described phenomenon is illustrated with normalized brightness values obtained by mixing all of the colors is shown in FIG. 43.

The combinations of chromaticity and brightness that are filled in with diagonal lines in FIG. 43 are a region that can be reproduced with color filters of the three colors R, G and B, but can not be reproduced using color filters of the four colors R, G, B and Y.

A similar phenomenon arises with respect to the brightness of green. Therefore, when using four color filters obtained by adding a yellow color filter to color filters for red, green and blue, the maximum brightness of a certain fixed range decreases at a monochromatic red point and the periphery thereof and at a monochromatic green point and the periphery thereof on a chromaticity diagram. As a result, cases arise in which light of a chromaticity and brightness that can be reproduced using color filters of the three colors R, G and B can not be reproduced when using color filters of four colors.

By changing red and green to green and blue in the foregoing description when cyan is adopted as the color of the fourth color filter, and changing red and green to red and blue when magenta is adopted as the color of the fourth color filter, the entire description is valid.

When white is adopted as the color of the fourth color filter, for the same reason, the range that can be reproduced with combinations of chromaticity and brightness narrows with respect to the peripheries of all the primary color points for red, green and blue.

Thus, in the conventional liquid crystal display devices that include a multiple primary color panel, there are cases in which the maximum brightness decreases in a chromaticity range in the vicinity of a monochromatic color.

Further, according to the technology described in the aforementioned Patent Document 3, although the brightness of red can be improved, the brightness of other colors can not be improved. In addition, the power consumption increases.

The present invention has been made in view of the above circumstances, and an object of the present invention is to provide a liquid crystal display device including a multiple primary color panel capable of improving the display quality of monochromatic colors or colors close to monochromatic colors, as well as a control method for the liquid crystal display device.

DISCLOSURE OF THE INVENTION

The inventors have conducted various studies on liquid crystal display devices that include a multiple primary color panel capable of improving the display quality of monochromatic colors or colors close to monochromatic colors, and have focused attention on methods of driving a backlight. The inventors found that by controlling the light emission intensity of the backlight according to input image signals and making the light emission intensity of the backlight when a monochromatic color or a color close to a monochromatic color is displayed in a display region is greater than the light emission intensity of the backlight when white is displayed in the display region, the brightness in a chromaticity range of a monochromatic color or a color close to a monochromatic color can be improved. Having realized that this idea can beautifully solve the above problem, the inventors have arrived at the present invention.

More specifically, the present invention provides a liquid crystal display device that performs display by input thereto of image signals for three colors from outside, the liquid crystal display device including a liquid crystal display panel and a backlight, wherein: a plurality of pixels each including picture elements of four colors or more are formed in a display region of the liquid crystal display panel; each pixel includes picture elements of three colors, provided with color filters having colors corresponding to the respective colors of the image signals, and at least one picture element of other color(s), provided with a color filter having a color corresponding to a color other than the colors of the image signals; a light emission intensity of the backlight can be controlled in accordance with image signals input; and the light emission intensity of the backlight when a monochromatic color or a color close to a monochromatic color is displayed in the display region is greater than the light emission intensity (light emission intensity of the backlight) when white is displayed in the display region.

In the present specification, the term "color close to a monochromatic color" refers to a color when a picture element that transmits light of which components include the monochromatic color and that is included in the at least one picture element of other color(s) is set to a gradation other than a highest gradation, and a picture element that transmits the monochromatic color is set to a highest gradation.

Thus, since the brightness can be improved in a chromaticity range of a monochromatic color or a color close to a monochromatic color, the display quality of a monochromatic color or a color close to a monochromatic color can be improved.

Further, since the light emission intensity of the backlight is controlled in accordance with image signals input, an increase in power consumption can be suppressed.

The configuration of the liquid crystal display device of the present invention is not especially limited as long as it essentially includes such components.

Preferably, the backlight has a plurality of lighting portions whose light emission intensities can be controlled independently of each other, and the light emission intensity of any one of the lighting portions for a certain section of the display region when the monochromatic color or the color close to the monochromatic color is displayed in the section is greater than the light emission intensity when white is displayed in the section (certain section of the display region). It is thereby possible to further reduce the power consumption.

The present invention further provides a liquid crystal display device that performs display by input thereto of image signals for three colors from outside, the liquid crystal display device including a liquid crystal display panel, a backlight, and a backlight intensity determination circuit that determines a light emission intensity of the backlight for each frame, wherein: a plurality of pixels each including picture elements of four colors or more are formed in a display region of the liquid crystal display panel; each pixel includes picture elements of three colors, provided with color filters having colors corresponding to the respective colors of the image signals, and at least one picture element of other color(s), provided with a color filter having a color corresponding to a color other than the colors of the image signals; a light emission intensity of the backlight can be controlled in accordance with image signals input; the backlight intensity determination circuit includes a backlight light amount calculation circuit that converts image signals for three colors that are input from outside into signals for four colors or more that correspond to the colors of the picture elements and determines required minimum light emission intensities of the backlight for the respective pixels based on the signals for four colors or more, and a maximum value distinguishing circuit that determines a largest light emission intensity among the required minimum light emission intensities; and the backlight emits light with the light emission intensity determined by the maximum value distinguishing circuit (the largest light emission intensity).

Thus, since the brightness can be improved in a chromaticity range of a monochromatic color or a color close to a monochromatic color, the display quality of a monochromatic color or a color close to a monochromatic color can be improved.

Further, since the light emission intensity of the backlight is controlled in accordance with image signals input, an increase in power consumption can be suppressed.

Furthermore, when image signals for three colors are converted as they are into signals for four colors or more, in some cases a defect occurs whereby the gradation of image signals that is output to a source driver is greater than the maximum gradation due to an insufficiency in the light emission intensity of the backlight. However, according to the present invention, image signals for three colors are first converted to signals for four colors or more, and thereafter required minimum light emission intensities of the backlight are determined for the respective pixels based on these signals, and subsequently the largest light emission intensity among the required minimum light emission intensities can be determined. It is thus possible to prevent the occurrence of the above described defect. Further, when the entire display screen is dark, since it is possible to further lower the light emission intensity of the backlight, a further reduction in power consumption is enabled.

The configuration of the second liquid crystal display device of the present invention is not especially limited as long as it essentially includes such components.

Preferable embodiments of the second liquid crystal display device of the present invention are mentioned in more detail below.

The backlight light amount calculation circuit may convert image signals for three colors to signals for four colors or more based on a size of light transmitted through color filters (reference color filters) having colors corresponding to the respective colors of the image signals, and a size of a component of light transmitted through the reference color filters that is included in light transmitted through a color filter (additional color filter) having a color corresponding to a color other than the colors of the image signals.

Preferably, each of the image signals for three colors is constituted by gradation data, and the backlight intensity determination circuit further includes: a reverse gamma conversion circuit that subjects the image signals constituted by gradation data (the image signals for three colors constituted by gradation data) to reverse gamma conversion to generate image signals for three colors constituted by brightness data, and a dividing circuit that divides the image signals for three colors constituted by brightness data by the largest light emission intensity. It is thereby possible to prevent a light emission intensity of the backlight becoming a negative value.

Preferably, the backlight has a plurality of lighting portions whose light emission intensities can be controlled independently of each other, the maximum value distinguishing circuit determines a largest light emission intensity among the required minimum light emission intensities for the respective sections of the display region that correspond to the respective lighting portions, and the backlight intensity determination circuit further includes a lighting pattern calculation circuit that adds brightness distributions on an irradiated surface of the panel when the lighting portions emit light with the required minimum light emission intensities. Thus, a further reduction in power consumption is enabled.

A configuration may also be adopted in which: the backlight light amount calculation circuit is a first backlight light amount calculation circuit; the maximum value distinguishing circuit is a first maximum value distinguishing circuit; the backlight intensity determination circuit further includes: a second backlight light amount calculation circuit that converts the image signals for three colors into signals for four colors or more corresponding to the colors of the picture elements using the light emission intensity (the largest light emission intensity) determined by the first maximum value distinguishing circuit and determines required minimum light emission intensities of the backlight for the respective pixels based on the signals for four colors or more, and a second maximum value distinguishing circuit that determines a largest light emission intensity among the required minimum light emission intensities calculated by the second backlight light amount calculation circuit; and the backlight emits light with the light emission intensity (the largest light emission intensity) determined by the second maximum value distinguishing circuit. That is, the backlight may emit light with the light emission intensity determined by the second maximum value distinguishing circuit, and not the light emission intensity determined by the first maximum value distinguishing circuit. Thus, a further reduction in power consumption is enabled.

The present invention also provides a control method for a liquid crystal display device that performs display by input thereto of image signals for three colors from outside, the liquid crystal display device including a liquid crystal display panel and a backlight, wherein: a plurality of pixels each including picture elements of four colors or more are formed in a display region of the liquid crystal display panel; each pixel includes picture elements of three colors, provided with color filters having colors corresponding to the respective colors of the image signals, and at least one picture element of other color(s), provided with a color filter having a color corresponding to a color other than the colors of the image signals; and a light emission intensity of the backlight can be controlled in accordance with image signals input; the control method including a backlight intensity determination step of determining a light emission intensity of the backlight for each frame, wherein: the backlight intensity determination step includes (1) a step of converting image signals for three colors that are input from outside into signals for four colors or more that correspond to the colors of the picture elements, and determining required minimum light emission intensities of the backlight for the respective pixels based on the signals for four colors or more, and (2) a step of determining a largest light emission intensity among the required minimum light emission intensities; and the backlight emits light with the light emission intensity determined in the step (2) (the largest light emission intensity).

Thus, since the brightness can be improved in a chromaticity range of a monochromatic color or a color close to a monochromatic color, the display quality of a monochromatic color or a color close to a monochromatic color can be improved.

Further, since the light emission intensity of the backlight is controlled in accordance with image signals input, an increase in power consumption can be suppressed.

According to the present invention, image signals for three colors are first converted to signals for four colors or more, and thereafter required minimum light emission intensities of the backlight are determined for the respective pixels based on these signals, and subsequently the largest light emission intensity among the required minimum light emission intensities is determined. It is thus possible to prevent the occurrence of the above described defect in which a gradation is greater than the maximum gradation. Further, when the entire display screen is dark, since it is possible to further lower the backlight intensity, a further reduction in power consumption is enabled.

The configuration of the control method for the liquid crystal display device of the present invention is not especially limited as long as it essentially includes such components and steps. The configuration may or may not include other components and steps.

Preferable embodiments of the control method for the liquid crystal display device of the present invention are mentioned in more detail below.

The step (1) may be a step in which image signals for three colors are converted into signals for four colors or more based on a size of light transmitted through color filters (reference color filters) having colors corresponding to the respective colors of the image signals, and a size of a component of light transmitted through the reference color filters that is included in light transmitted through a color filter (additional color filter) having a color corresponding to a color other than the colors of the image signals.

Preferably, each of the image signals for three colors is constituted by gradation data, and the backlight intensity determination step further includes: (3) a step of subjecting the image signals constituted by gradation data (the image signals for three colors constituted by gradation data) to reverse gamma conversion to generate image signals for three colors constituted by brightness data; and (4) a step of dividing the image signals for three colors constituted by brightness data by the largest light emission intensity. It is thereby possible to prevent a light emission intensity of the backlight becoming a negative value.

It is preferable that: the backlight has a plurality of lighting portions whose light emission intensities can be controlled independently of each other; in the step (2), a largest light emission intensity among the required minimum light emission intensities is determined for the respective sections of the display region that correspond to the respective lighting portions; and the backlight intensity determination step further includes (5) a step of adding brightness distributions on an irradiated surface of the panel when the lighting portions emit light with the required minimum light emission intensities. Thus, a further reduction in power consumption is enabled.

A configuration may also be adopted in which the backlight intensity determination circuit further includes: (6) a step of converting the image signals for three colors into signals for four colors or more corresponding to the colors of the picture elements using the light emission intensity (largest light emission intensity) determined in the step (2), and determining required minimum light emission intensities of the backlight for the respective pixels based on the signals for four colors or more, and (7) a step of determining a largest light emission intensity among the required minimum light emission intensities calculated in the step (6); wherein the backlight emits light with the light emission intensity (the largest light emission intensity) determined in the step (7). That is, the backlight may also emit light with the light emission intensity determined in the step (7), and not the light emission intensity determined in the step (2). Thus, a further reduction in power consumption is enabled.

Advantageous Effects of Invention

According to a first and a second liquid crystal display device of the present invention and a control method for a liquid crystal display device of the present invention, the display quality of a monochromatic color or a color close to a monochromatic color can be improved.

BRIEF DESCRIPTION OF THE DRAWINGS

FIG. 38 is a planar schematic view illustrating a pixel array of a liquid crystal display device according to Embodiment 9.

MODES FOR CARRYING OUT THE INVENTION

Figure 1:
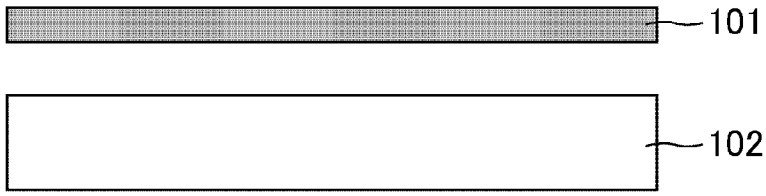
FIG. 1 is a cross-sectional schematic diagram that shows a configuration of a liquid crystal display device according to Embodiment 1.

The present invention will be mentioned in more detail referring to the drawings in the following embodiments, but is not limited to these embodiments.

In the present specification, red may be abbreviated to R or r, green may be abbreviated to G or g, blue may be abbreviated to B or b, white may be abbreviated to W or w, yellow may be abbreviated to Y, cyan may be abbreviated to C, and magenta may be abbreviated to M.

EMBODIMENT 1

FIG. 1 is a cross-sectional schematic diagram illustrating a configuration of a liquid crystal display device according to Embodiment 1.

The liquid crystal display device of the present embodiment is a transmission-type liquid crystal display device in which a backlight unit (backlight 102) that can independently change the light emission intensities of red, green, and blue, and a liquid crystal display panel 101 having a color filter of a color other than R, G, and B are combined.

When utilizing the liquid crystal display panel 101, there is a problem that the brightness decreases when white is lit with a backlight and a monochromatic color is displayed. However, this problem can be compensated for by combining the backlight 102 and the liquid crystal display panel 101 and changing the light emission intensity (lighting intensity) of the backlight 102.

A basic driving method is a method that:

in accordance with the gradation of an input signal, adjusts a light emission intensity of the backlight (hereunder, also referred to as "backlight intensity"), and sends an output signal that is calculated based on the light emission intensity and the gradation of the input signal to the liquid crystal display panel.

If this driving method is merely executed as it is, a decrease in a monochromatic brightness will occur. A specific driving method for preventing such a decrease in brightness is described below.

Figure 2:
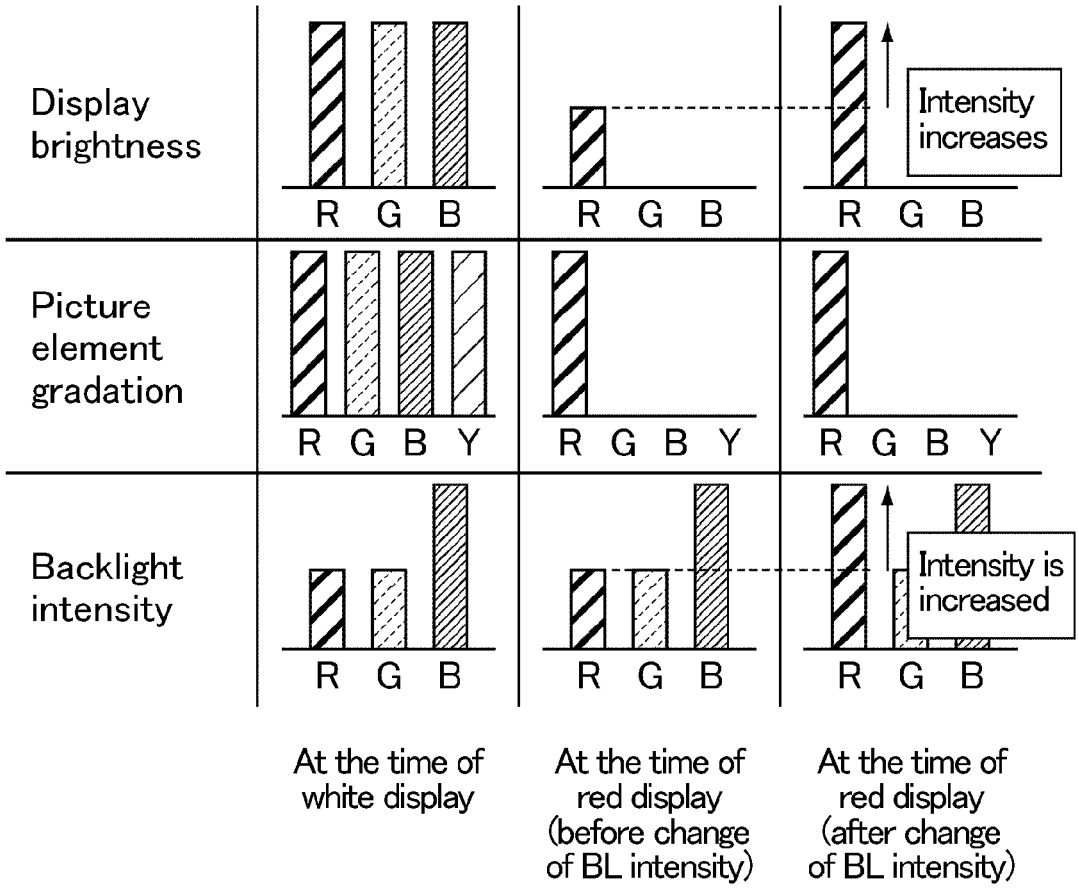
FIG. 2 is a view for explaining a method of driving the liquid crystal display device according to Embodiment 1.

FIG. 2 is a view for describing a method of driving the liquid crystal display device according to Embodiment 1.

For example, it is assumed that normal color filters of R, G, and B as well as a newly added yellow color filter are utilized. More specifically, it is assumed that a Y picture element is added to picture elements of the three colors R, G, and B. Further, it is assumed that the yellow color filter lets red light and green light pass therethrough. When performing a white display (when RGB signals that are each at a gradation level of 255 are input), in consideration of efficiency, it is favorable to control all picture elements of each color to have a gradation level of 255. Although it is necessary to achieve white balance at such time, since r light and g light are also transmitted from the yellow filter, the backlight intensities of r and g are decreased by an amount corresponding thereto (see left column in FIG. 2). In contrast, when performing a red display (R signal is at a gradation level of 255 and G and B signals are at a gradation level of 0), the R picture element has a gradation level of 255, and the G and B picture elements and the Y picture element have a gradation level of 0. Therefore, only R is lit with the backlight. In this case, because r light is not transmitted from the yellow filter and is radiated only from the R filter, the transmittance amount of r light is less than at the time of a white display (see center column in FIG. 2). This is due to the fact that the radiated quantity of r light can not be supplemented with the yellow filter. Even if the transmissivity of the Y picture elements were raised, a defect would appear in the display because unwanted g light would be radiated from the yellow filter. Therefore, the r light intensity of the backlight is strengthened by an amount corresponding to the insufficient amount of R light. It is thereby possible to compensate for the insufficient r light intensity on the display (see right column in FIG. 2). Thus, a decrease in a monochromatic brightness can be prevented. A feature of the present embodiment is that control is performed so that each of the colors of an RGB backlight do not have the highest light emission intensity at a time of a 255-gradation level, but rather have the highest light emission intensity at the time of a monochromatic display.

According to the present embodiment, it is possible prevent a decrease in brightness that occurs when white is lit with a backlight and a monochromatic color is displayed from becoming greater than when using a liquid crystal display panel having color filters of only R, G and B, which constitutes a problem when utilizing the liquid crystal display panel 101 that has a color filter of a color other than R, G and B.

In this case, sizes of required light emission intensities are described using mathematical expressions. First, the following symbols are defined:

R: intensity of light radiated from an R picture element

G: intensity of light radiated from a G picture element

B: intensity of light radiated from a B picture element $r_{BL}$: backlight intensity of r $g_{BL}$: backlight intensity of g $b_{BL}$: backlight intensity of b $r_R$: transmissivity of r light with respect to R picture element $g_G$: transmissivity of g light with respect to G picture element $b_B$: transmissivity of b light with respect to B picture element $r_Y$: transmissivity of r light with respect to Y picture element, which transmits r light at a multiple of "a" compared to R picture element $g_Y$: transmissivity of g light with respect to Y picture element, which transmits g light at a multiple of "b" compared to G picture element.

A normal case of converting from RGB signals to RGBY signals will now be considered (attention is focused on R light only).

When all of the RGB signals are at a gradation level of 255 (referred to as "complete white"), conventionally, control is normally performed in which all the colors of the backlight are lit to 100% of capacity to achieve the brightest lighting, and in which all of the picture elements are set to a gradation level of 255 to place the display panel in a state that transmits the most light. If the same principle is used for the case of converting to RGBY, since all colors in the backlight are lit to 100% of capacity and the picture elements of all colors are at a gradation level of 255, a state is entered in which $r_{BL}=1$, $r_R=1$, and $r_Y=a$.

$$R_{complete\ white}=r_{BL}\times(r_R+r_Y)=1+a$$

When only the R signal is at a gradation level of 255 (referred to as "complete red"), in the backlight, r is lit to a level of 100% and the other colors are 0 (not lit), and only the R picture element is at a gradation level of 255 and the other colors are at a gradation level of 0, and hence $r_{BL}=1$, $r_R=1$, $r_Y=0$.

$$R_{complete\ red}=r_{BL}\times(r_R+r_Y)=1$$

Accordingly, compared to complete white, in the case of complete red the light intensity of a red component transmitted through the panel is $1/(1+\alpha)$. Two methods can be considered to make $R_{complete\ white}=R_{complete\ red}$. One is a method that changes the transmissivity of the liquid crystal, and the other is a method that changes a light emission intensity of the backlight. In order not to reduce the utilization efficiency of light of the backlight in both a case of complete white and a case of complete red, according to the present embodiment a method is selected so as to fix the transmissivity of liquid crystal and adjust the light emission intensity of the backlight. In this case:

$$r_{BL\ complete\ red}=r_{BL\ complete\ white}\times(1+a).$$

Similarly, $$G_{complete\ white}=g_{BL}\times(g_G+g_Y)=1+b$$

$$G_{complete\ green}=g_{BL}\times(g_G+g_Y)=1$$

$$g_{BL\ complete\ green}=g_{BL\ complete\ white}\times(1+b).$$

Thus, the present embodiment proposes a method that increases the backlight intensity more than at a time of complete white. This is described in more detail in the following embodiments. Note that in the following embodiments, a backlight intensity of 100% takes the backlight intensity when displaying complete white as a reference value.

EMBODIMENT 2

Figure 3:
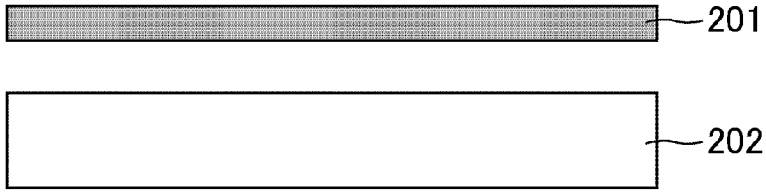
FIG. 3 is a cross-sectional schematic diagram that shows a configuration of a liquid crystal display device according to Embodiment 2.

FIG. 3 is a cross-sectional schematic diagram showing a configuration of a liquid crystal display device according to Embodiment 2.

A liquid crystal display device of the present embodiment is a transmission-type liquid crystal display device in which a white backlight unit (backlight 202) that can change a light emission intensity and a liquid crystal display panel 201 having color filters of three primary colors R, G and B and a color filter of a primary color other than R, G and B are combined. The light emission intensity of the backlight 202 is uniformly controlled (changed) over the entire surface of the light emitting surface.

Here, the term "white backlight" refers to a backlight based on the ideal that when combined with a liquid crystal display panel having color filters (picture elements) of R, G and B and another color, a display color when the gradations of all the color filters (picture elements) are made the maximum gradation is white. By finely adjusting the white balance, a white display may also be performed in a state in which all the color filters (picture elements) are not at the maximum gradation. The light source of the white backlight is not particularly limited, and may be a cold cathode fluorescent lamp (CCFL), a white LED, or three kinds of light emitting diodes (LED) of the colors R, G and B.

Although a case is described here in which a yellow color filter (Y picture element) is added, the description will similarly apply if R is replaced with B when a cyan color filter (C picture element) is added, and if G is replaced with B when a magenta color filter (M picture element) is added.

Figures 4, 5:
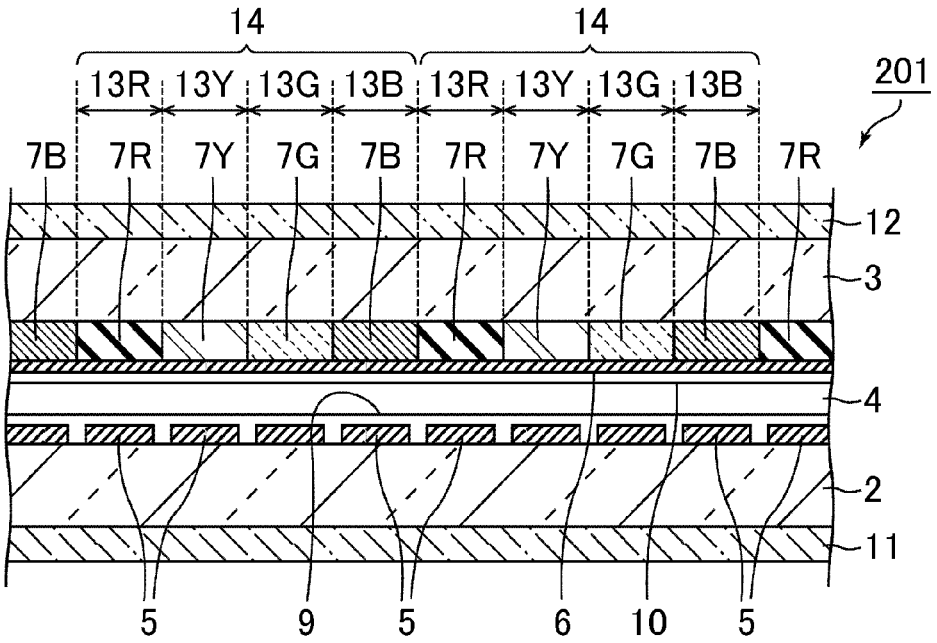
FIG. 4 is a cross-sectional schematic diagram that shows a configuration of a liquid crystal display panel according to Embodiment 2.
FIG. 5 is a planar schematic view that shows a pixel array of the liquid crystal display device according to Embodiment 2.
Figures 6, 7:
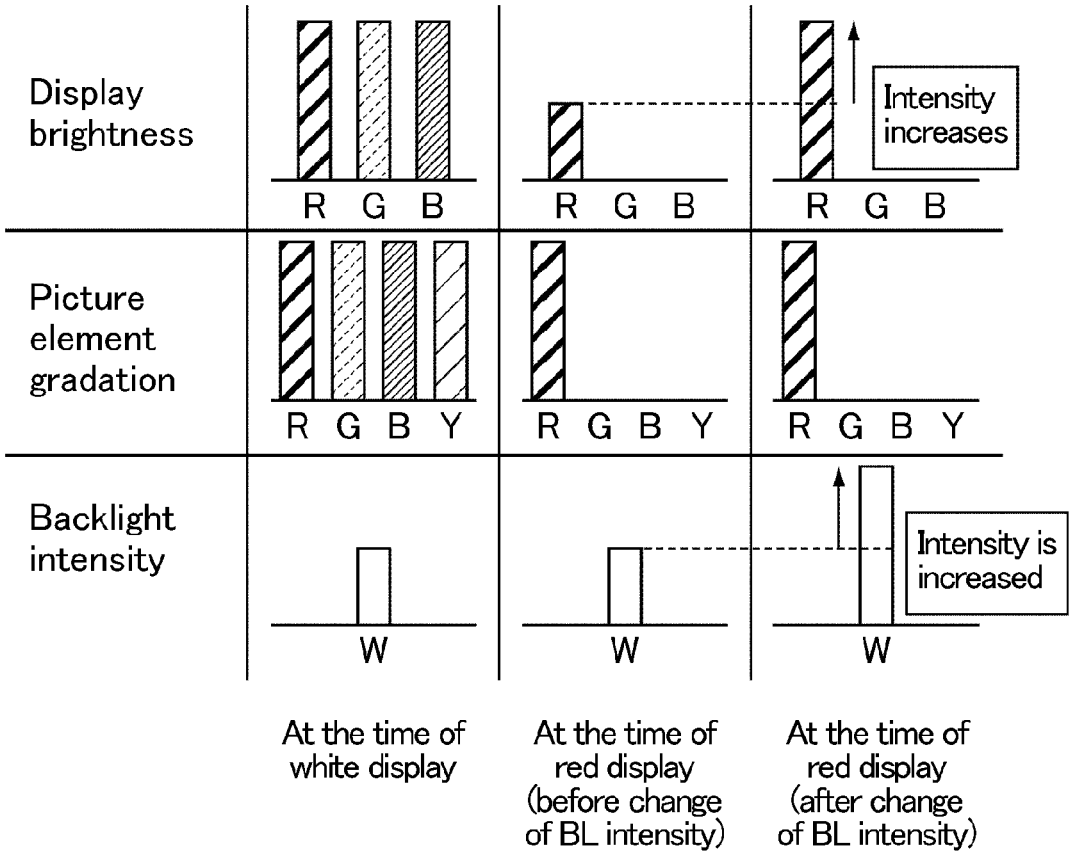
FIG. 6 is a planar schematic view that shows another pixel array of the liquid crystal display device according to Embodiment 2.
FIG. 7 is a view for explaining a method of driving the liquid crystal display device according to Embodiment 2.

FIG. 4 shows a configuration of the liquid crystal display panel according to Embodiment 2. FIG. 5 shows a pixel array of the liquid crystal display device according to Embodiment 2. FIG. 6 shows another pixel array of the liquid crystal display device according to Embodiment 2.

The liquid crystal display panel 201 includes: a pair of transparent substrates 2 and 3; a liquid crystal layer 4 that is enclosed in a gap between the substrates 2 and 3; a plurality of transparent pixel electrodes 5 arrayed in a matrix shape in a row direction (leftward and rightward direction of the screen) and a column direction (upward and downward direction of the screen) that are formed in one of the substrates 2 and 3, for example, in an inner face of the substrate 2 on an opposite side to an observation side (upper side in the drawing); a transparent opposed electrode 6 in the shape of a single film that is formed so as to correspond with the array region of the plurality of pixel electrodes 5 on an inner face of the other substrate, that is, on the inner face of the substrate 3 on the observation side; and a pair of polarizers 11 and 12 that are arranged on the outer faces of the substrates 2 and 3, respectively.

The liquid crystal display panel 201 is an active matrix type liquid crystal display element that has TFTs (thin film transistors) as active elements. Although omitted from FIG. 4, the inner face of the substrate 2 on which the pixel electrodes 5 are formed is provided with: a plurality of TFTs that are arranged in correspondence with the pixel electrodes 5, respectively, and are connected to the pixel electrodes 5, respectively; a plurality of scanning lines for supplying gate signals to TFTs of each row; and a plurality of data lines for supplying data signals to TFTs of each column.

The liquid crystal display panel 201 displays an image by controlling the transmission of light that is irradiated from the backlight 202 disposed on the opposite side to the observation side thereof. The liquid crystal display panel 201 also has a plurality of pixels 14. In each pixel 14, an alignment state of liquid crystal molecules of the liquid crystal layer 4 changes upon a data signal being supplied to a region where the pixel electrode 5 and the opposed electrode 6 face each other, that is, upon a voltage corresponding to a data signal being applied between the electrodes 5 and 6, and as a result the transmission of light is controlled.

The pixels 14 are arrayed in a matrix shape in a region corresponding to the pixel electrodes 5. As shown in FIG. 5, each pixel 14 includes an R picture element 13R having a red color filter 7R, a G picture element 13G having a green color filter 7G, a B picture element 13B having a blue color filter 7B, and a Y picture element 13Y having a yellow color filter 7Y. As the array of picture elements of four colors, an array of two picture elements x two picture elements may be adopted as shown in FIG. 5, or a stripe array may be adopted as shown in FIG. 6, and although not illustrated in the drawings, a mosaic array or delta array can also be used.

The color filters 7R, 7G, 7B and 7Y are formed on an inner face of either one of the substrates 2 and 3, for example, on the inner face of the observation side substrate 3.

The opposed electrode 6 is formed over the color filters 7R, 7G, 7B and 7Y. Alignment layers 9 and 10 are provided on the inner faces of the substrates 2 and 3 in a manner that covers the pixel electrodes 5 and the opposed electrode 6.

The substrates 2 and 3 are disposed facing each other with a predetermined gap therebetween, and are joined by a frame-shaped sealing material (not shown) that surrounds the display region in which the pixels 14 are arrayed in a matrix shape. The liquid crystal layer 4 is enclosed in a region surrounded by the sealing material between the substrates 2 and 3.

The liquid crystal display panel 201 may be of any of the following types: a TN or STN type in which the liquid crystal molecules of the liquid crystal layer 4 are arranged to have a twisted alignment; a vertical alignment type in which the liquid crystal molecules are aligned substantially vertically with respect to the surfaces of the substrates 2 and 3; a horizontal alignment type in which the liquid crystal molecules are aligned substantially horizontally with respect to the surfaces of the substrates 2 and 3 without being twisted; and a bend alignment type in which the liquid crystal molecules are aligned in a bent state; or may be a ferroelectric or antiferroelectric liquid crystal display device. The polarizers 11 and 12 are arranged so as to set the directions of the respective transmission axes thereof so that the display is black when a voltage is not applied between the electrodes 5 and 6 of each pixel 14.

In this connection, although the liquid crystal display panel 201 shown in FIG. 4 is a panel that changes an alignment state of liquid crystal molecules by generating an electric field between the electrodes 5 and 6 provided on the inner faces of the pair of substrates 2 and 3, respectively, the present invention is not limited thereto, and the liquid crystal display panel may be of a transverse electric field control type in which, for example, comb-shaped first and second electrodes for forming a plurality of pixels are provided on the inner face of either one of the pair of substrates, and which changes an alignment state of the liquid crystal molecules by generating a transverse electric field between the electrodes (electric field in a direction along the substrate surface).

Hereunder, a control method of the liquid crystal display device of the present embodiment is described. FIG. 7 is a view for explaining a method of driving the liquid crystal display device of Embodiment 2.

The relationship between the backlight intensity and the gradations of picture elements when displaying white with the maximum gradation is shown in the left column in FIG. 7. The gradation value of the picture element of each color is the maximum gradation value. Next, a case is considered in which red is displayed at the maximum gradation value without altering the light emission intensity of the backlight (see the center column in FIG. 7). In this case, only the R picture element is controlled to have the maximum gradation, and the other picture elements are all controlled to have a gradation of 0. At this time, although the display is a red display, the red brightness is darker than at a time of a white display. The reason is that although the red brightness at the time of a white display is a combination of red light transmitted through the R filter and red light transmitted through the yellow filter, the red brightness at the time of a red display is only red light transmitted through the R filter. To eliminate the cause of this decrease in the red brightness, control is performed to increase the light emission intensity of the backlight (see the right column in FIG. 7). If it is assumed that, at the time of a white display, the amount of red light transmitted from the yellow filter is a multiple of $\alpha$ relative to the amount of red light transmitted from the R filter, then the red brightness in the center column will be a multiple of $1/(1+\alpha)$ relative to the red brightness in the left column. Accordingly, it is sufficient to increase the light emission intensity of the backlight by a multiple of $(1+\alpha)$ to make the red brightness when displaying white with the maximum gradation and the red brightness when displaying red with the maximum gradation equal. Although the foregoing description refers to a case of displaying the same gradation over the entire screen, when actually performing display, the light emission intensity of the backlight will be equal for all pixels. Therefore, the control procedures are:

(1) Extracting minimum required backlight intensities for all pixels, and calculating the largest backlight intensity from among the extracted values; and (2) Calculating a gradation to be input to picture elements of each color with respect to the calculated backlight intensity.

Figure 8:
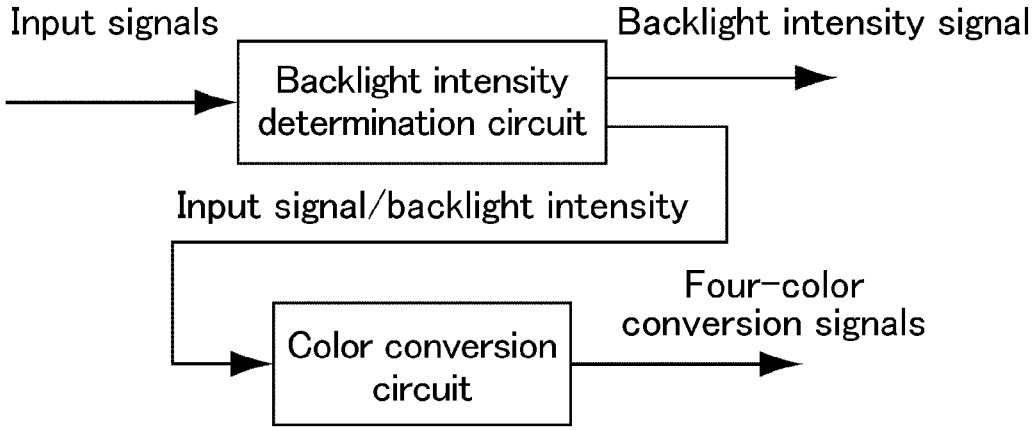
FIG. 8 is a block diagram that shows a circuit of the liquid crystal display device according to Embodiment 2.

A system block diagram for realizing the above described system is shown in FIG. 8.

Input signals are input to a backlight intensity determination circuit. This circuit determines a minimum backlight intensity that is required to perform display in accordance with the input signals. The determined backlight intensity is sent to the backlight as a backlight intensity signal. The input signals are converted to signals in accordance with the changed backlight intensity, are input to a color conversion circuit (three-color/four-color conversion circuit), and converted to signals for four colors. The backlight intensity signal is input to a circuit (backlight driving circuit) that controls the backlight, and the signals for four colors are input to a circuit (source driver) that controls the panel, and thus a video image can be output. When this system is used, a defect whereby an output gradation is greater than the maximum gradation which arises because the backlight intensity is insufficient that may occur when input signals are input as they are to a color conversion circuit is eliminated. At the same time, there is also the advantage that it is possible to lower the backlight intensity when the entire display screen is dark. The required backlight intensity differs according to the method used to convert signals for three colors into signals for four colors. Therefore, hereunder, first an algorithm for converting from signals for three colors to signals for four colors is described, and thereafter an algorithm for determining a backlight intensity is described.

An algorithm for converting RGB input signals into R'G'B'Y' signals is described hereunder.

Here, as a premise for the present explanation, it is assumed that an input signal is represented by a transmittance amount of light for which 1 is taken as a maximum gradation. It is assumed that a transmittance amount of red light from a yellow filter is a multiple of $\alpha$ relative to a transmittance amount thereof from an R filter. It is also assumed that a transmittance amount of green light from a yellow filter is a multiple of $\beta$ relative to a transmittance amount thereof from a G filter.

First, since an input signal B is radiated only from a B' filter, the value thereof before conversion is unchanged after conversion. Accordingly:

$$B'=B.$$

Next, input signals R and G are converted to R', G' and Y'. Based on the above described premise conditions, the following equations hold:

$$R=1/(1+\alpha)\times R'+\alpha/(1+\alpha)\times Y' \quad \text{(a)}$$

$$G=1/(1+\beta)\times G'+\beta/(1+\beta)\times Y' \quad \text{(b)}$$

If it is assumed that Y'=MAX(R, G), (it is assumed that MAX(R, G) is a function that takes the larger value among R and G), then:

$$R'=(1+\alpha)\times R-\alpha\times \mathrm{MAX}(R,G) \quad \text{(c)}$$

$$G'=(1+\beta)\times G-\beta\times \mathrm{MAX}(R,G) \quad \text{(d)}$$

It is necessary for R' and G' to satisfy the expressions $0\leq R'\leq 1$ and $0\leq G'\leq 1$, respectively. Although it is possible to make the relevant value that does not exceed 1 by strengthening the backlight intensity, since it is not possible to ensure that a negative value is not obtained by adjusting the backlight intensity, it is necessary to classify the conversion formulas according to the conditions. There are three ways of carrying out such a classification: (1) both (c) and (d) take a positive value, (2) (c) takes a negative value, and (3) (d) takes a negative value.

(1) When both (c) and (d) take a positive value:
the conversion formulas are as described above.

(2) When (c) takes a negative value:
although it is a case in which the second item increases in (c), since MAX(R, G)=R when R>G, because R' is always >0, it is necessary that R<G=MAX(R, G). Hence a condition when (c) takes a negative value is:

$$G>(1+\alpha)/\alpha\times R.$$

At this time, the value of R is extremely small compared to G. Consequently, if it is assumed that Y'=G, the state is one in which more red light than required is radiated to outside from the yellow filter. Therefore, a condition R'<0 is necessary. In this case, it is sufficient to perform control so that all the red light is radiated from the yellow filter, and thus it is sufficient to make R'=0. At this time, the equations:

$$Y'=(1+\alpha)/\alpha\times R$$

$$G'=(1+\beta)\times G-\{\beta\times(1+\alpha)/\alpha\}\times R$$

hold.

(3) When (d) takes a negative value:
It is sufficient to replace R with G, R' with G', and α with β in (2). When R>(1+β)/β×G, $$G'=0$$

$$Y'=(1+\beta)/\beta\times G$$

$$R'=(1+\alpha)\times R-\{\alpha\times(1+\beta)/\beta\}\times G$$

Next, an algorithm for determining backlight intensities is described.

Figure 9:
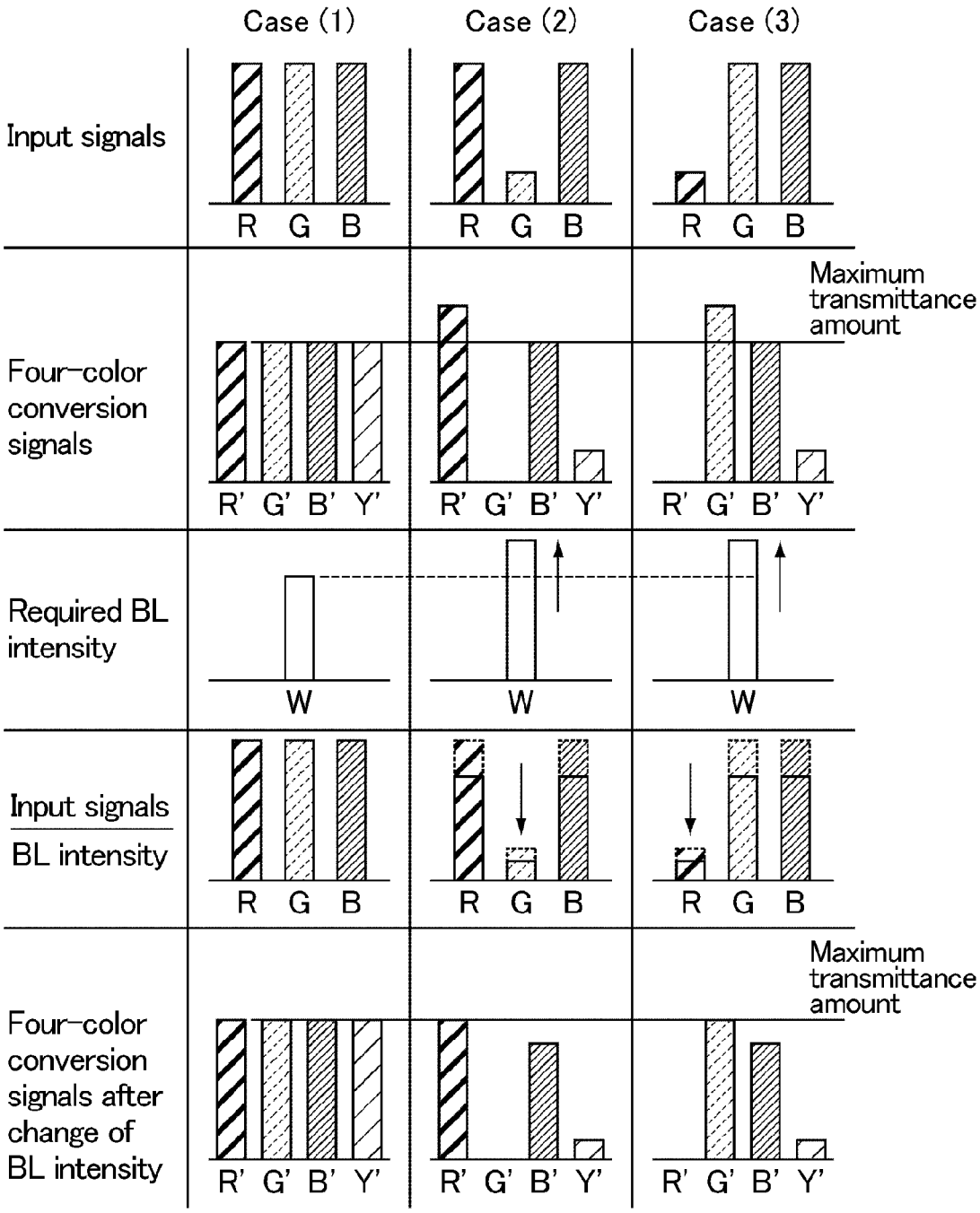
FIG. 9 is a view for explaining an algorithm for determining backlight intensities according to Embodiment 2.

FIG. 9 is a view for describing an algorithm for determining backlight intensities according to Embodiment 2.

In this case, the procedures include, first, determining required backlight intensities for each pixel, and thereafter setting the maximum value thereof as a backlight intensity that is required to display. A method of determining a required backlight intensity w for each pixel will now be described. The required backlight intensity w takes an intensity value of 1 when the values of input signals R, G and B are all 1 and R', G', B' and Y' are converted to 1.

As described above, the values converted to R'G'B'Y' signals are as follows.

B'=B (common for all cases)
R'=(1+α)×R−α×MAX(R, G) (at the time of (1))
=0 (at the time of (2))
=(1+α)×R−{α×(1+β)/β}×G (at the time of (3))
G'=(1+β)×G−β×MAX(R, G) (at the time of (1))
=(1+β)×G−{β×(1+α)/α}×R (at the time of (2))
=0 (at the time of (3))
Y'=MAX(R, G) (at the time of (1))
=(1+α)/α×R (at the time of (2))
=(1+β)/β×G (at the time of (3))

The conditions (1) to (3) specified here are as follows.

$$R<(1+\beta)/\beta\times G \text{ and } G<(1+\alpha)/\alpha\times R \quad (1)$$

$$G>(1+\alpha)/\alpha\times R \quad (2)$$

$$R>(1+\beta)/\beta\times G \quad (3)$$

Therefore, a backlight intensity required for a pixel with a certain combination of input signals RGB is a maximum value of the above values.

Among the above conditions, a maximum value in the case of (1) is MAX(R, G, B), a maximum value in the case of (2) is B or (1+β)×G−β×(1+α)/α×R, and a maximum value in the case of (3) is B or (1+α)×R−α×(1+β)/β×G. Hence, the backlight intensity w required for a pixel with a certain combination of input signals RGB is the maximum value of the following five values:

R, G, B
(1+β)×G−β×(1+α)/α×R
(1+α)×R−α×(1+β)/β×G

Even if the intensity of the backlight is greater than required, since the transmittance amount of light can be reduced by the liquid crystal, the required backlight intensity for the backlight unit as a whole is the maximum value among maximum values of the above described five values that are determined for all combinations of the input signals RGB.

Thus, according to the present embodiment, a required minimum backlight intensity is determined for each pixel (see third row from the top in FIG. 9). Subsequently, the input signals RGB are divided by the thus determined required backlight intensity w (see fourth row from the top in FIG. 9). Next, the divided input signals RGB are converted to signals for four colors (see fifth row from the top in FIG. 9). Accordingly, even in a case where the output gradation is greater than the maximum gradation when input signals are converted as they are into signals for four colors (see second row from the top in FIG. 9), the values of R'G'B'Y' all become numbers that are greater or equal to 0 and less than or equal to 1.

Next, configurations of driving and control portions of the liquid crystal display panel 201 and the backlight 202 are described in detail.

Figure 10:
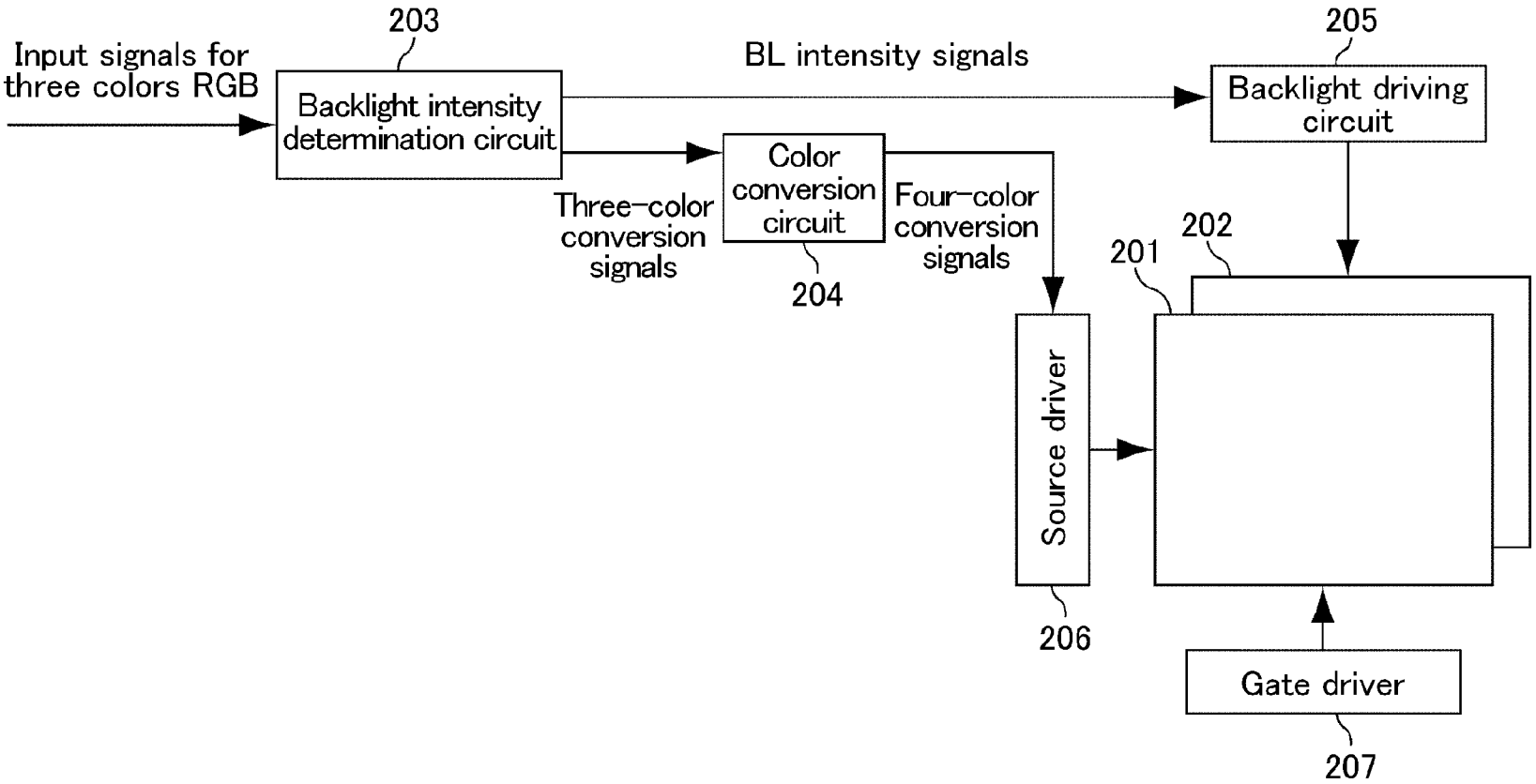
FIG. 10 shows a block configuration of the liquid crystal display device according to Embodiment 2.

FIG. 10 is a view that illustrates a block configuration of the liquid crystal display device according to Embodiment 2.

As shown in FIG. 10, a drive circuit for driving the liquid crystal display panel 201 to display a video image includes: a source driver 206 that supplies a data voltage that is based on an video signal to each pixel electrode inside the liquid crystal display panel 201; a gate driver 207 that drives each pixel electrode inside the liquid crystal display panel 201 in line-sequential order along scanning lines; the backlight intensity determination circuit 203; the color conversion circuit 204; and a backlight driving circuit 205 that controls a lighting operation of the backlight 202 at a maximum brightness $L_{MAX}$ that is determined by the backlight intensity determination circuit 203.

Figure 11:
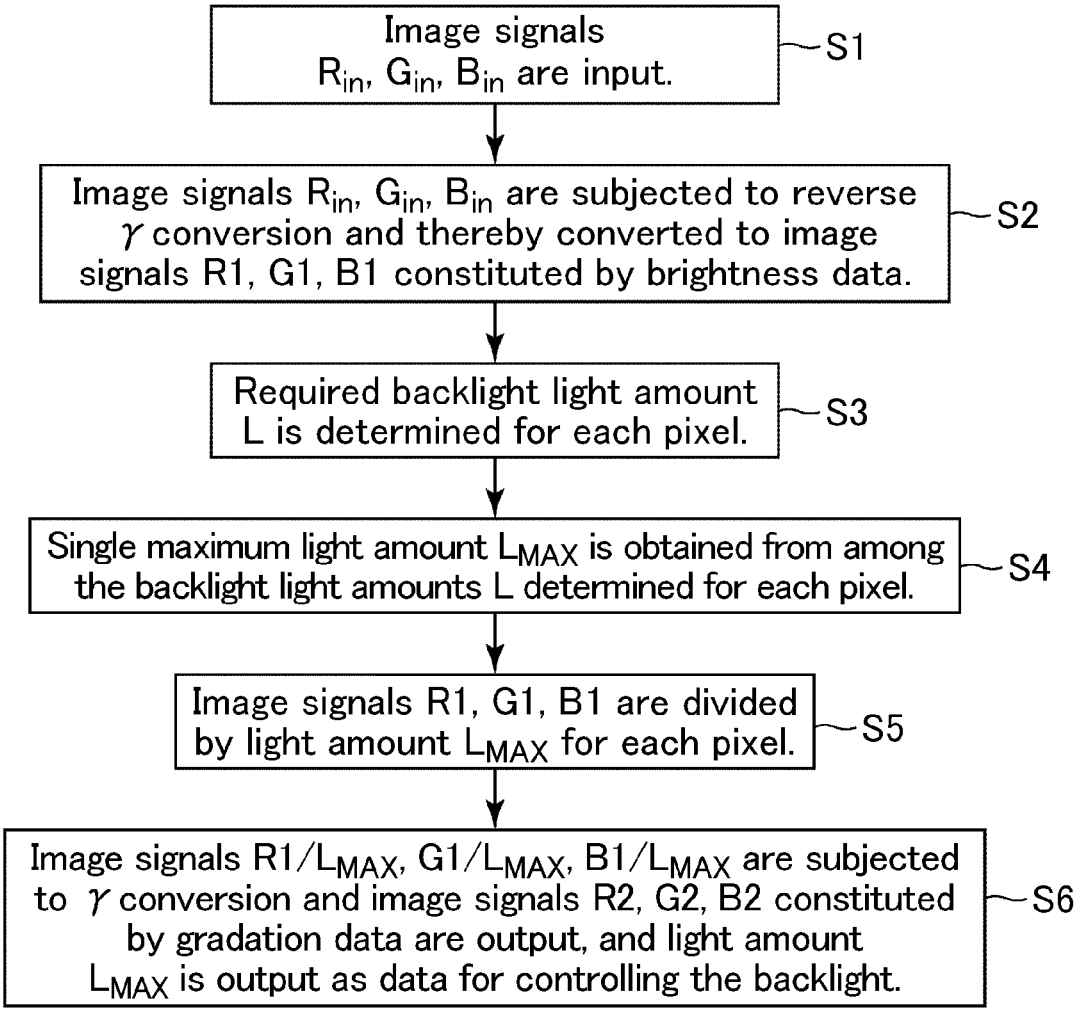
FIG. 11 is a view that illustrates a flow of processing in a backlight intensity determination circuit according to Embodiment 2.

FIG. 11 illustrates a flow of processing in the backlight intensity determination circuit of Embodiment 2. In the backlight intensity determination circuit 203, the following processing is performed for each frame.

First, RGB image (video) signals $R_{in}$, $G_{in}$, $B_{in}$ constituted by gradation data are input (S1).

Next, the image signals $R_{in}$, $G_{in}$, $B_{in}$ are subjected to reverse gamma conversion and thereby converted to image signals R1, G1, B1 constituted by brightness data (S2).

Next, a required backlight light amount L is determined for each pixel (S3).

Next, a single maximum brightness $L_{MAX}$ is obtained from among the backlight light amounts L determined for each pixel (S4).

Subsequently, the image signals R1, G1, B1 are divided by the maximum brightness $L_{MAX}$ for each pixel to calculate image signals R1/$L_{MAX}$, G1/$L_{MAX}$, B1/$L_{MAX}$ (S5).

Next, the image signals R1/$L_{MAX}$, G1/$L_{MAX}$, B1/$L_{MAX}$ are subjected to gamma conversion and image signals R2, G2, B2 constituted by gradation data are output, and in addition, a light amount $L_{MAX}$ is output as data for controlling the backlight (S6).

Figure 12:
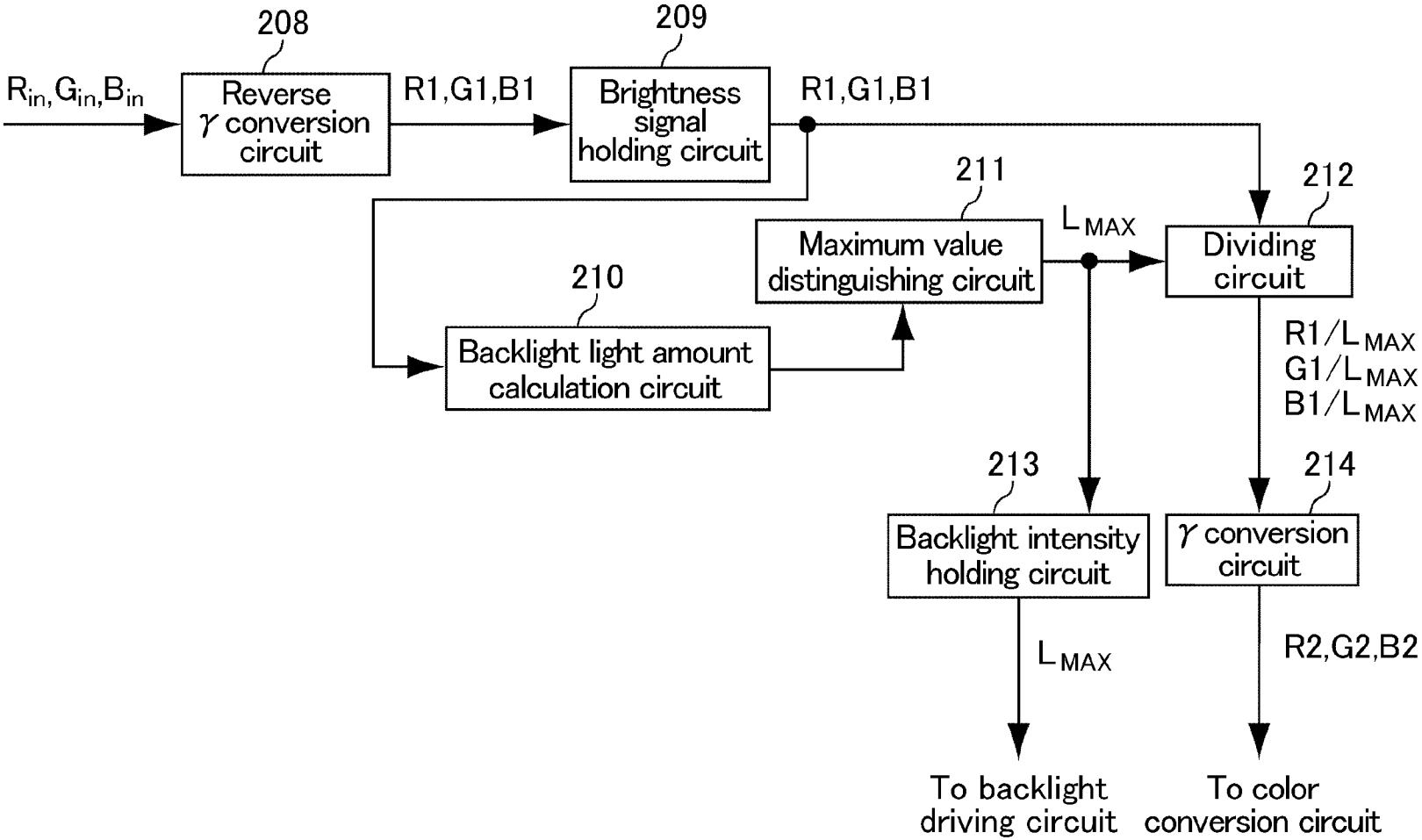
FIG. 12 shows a block diagram of the backlight intensity determination circuit according to Embodiment 2.

FIG. 12 illustrates a block diagram of the backlight intensity determination circuit according to Embodiment 2.

As shown in FIG. 12, the backlight intensity determination circuit 203 includes a reverse gamma conversion circuit 208, a brightness signal holding circuit 209, a backlight light amount calculation circuit 210, a maximum value distinguishing circuit 211, a dividing circuit 212, a backlight intensity holding circuit 213, and a gamma conversion circuit 214.

The reverse gamma conversion circuit 208 performs reverse gamma conversion with respect to the image signals $R_{in}$, $G_{in}$, $B_{in}$ to generate image signals R1, G1, B1 constituted by brightness data. The image signals R1, G1, B1 are output to the brightness signal holding circuit 209, and stored for a fixed period (for example, a period of one frame).

The backlight light amount calculation circuit 210 calculates a required backlight light amount L for each pixel based on the image signals R1, G1, B1 output from the brightness signal holding circuit 209 as described above. The backlight light amount L is one of the five brightnesses described in the above calculation, namely, R, G, B, $(1+\beta)\times G-\beta\times(1+\alpha)/\alpha\times R$ and $(1+\alpha)\times R-\alpha\times(1+\beta)/\beta\times G$.

The maximum value distinguishing circuit 211 determines one maximum brightness $L_{MAX}$ among the backlight light amounts L for each pixel that are output from the backlight light amount calculation circuit 210.

The backlight intensity holding circuit 213 stores the maximum brightness $L_{MAX}$ output from the maximum value distinguishing circuit 211 for a fixed period (for example, a period of one frame), and also outputs the maximum brightness $L_{MAX}$ to the backlight driving circuit 205.

The dividing circuit 212 divides the image signals R1, G1, B1 output from the brightness signal holding circuit 209 by the maximum brightness $L_{MAX}$ for each pixel to calculate image signals $R1/L_{MAX}$, $G1/L_{MAX}$, $B1/L_{MAX}$.

The gamma conversion circuit 214 subjects the image signals $R1/L_{MAX}$, $G1/L_{MAX}$, $B1/L_{MAX}$ output from the dividing circuit 212 to gamma conversion to generate image signals R2, G2, B2 constituted by gradation data, and outputs the generated image signals R2, G2, B2 to the color conversion circuit 204.

Figure 13:
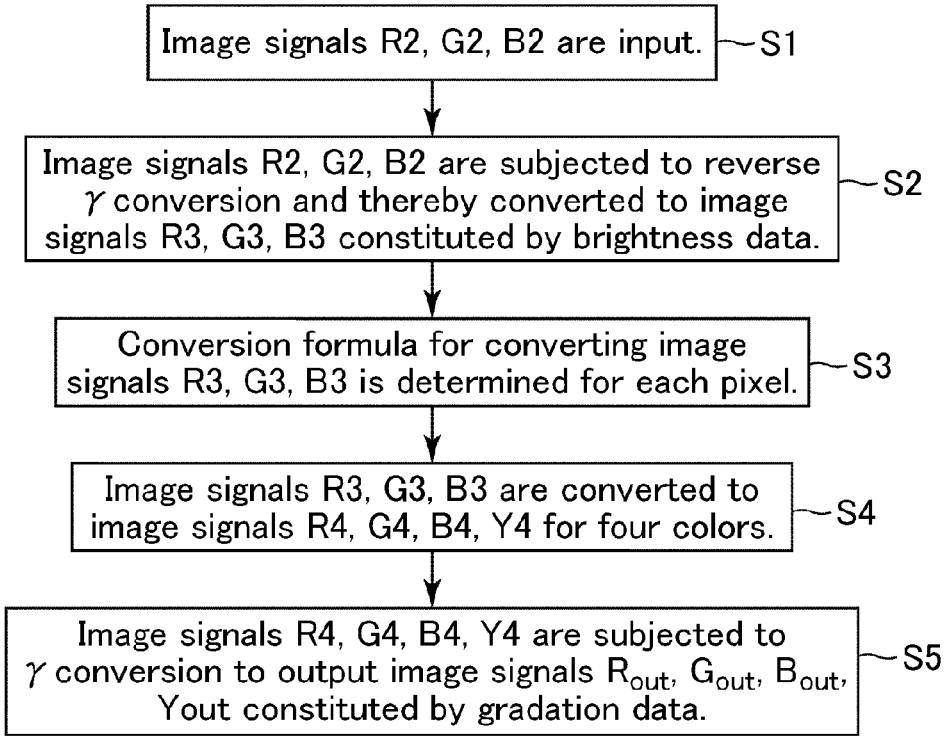
FIG. 13 is a view that illustrates a flow of processing in a color conversion circuit according to Embodiment 2.

FIG. 13 illustrates a flow of processing in the color conversion circuit of Embodiment 2. The following processing is performed for each frame at the color conversion circuit 204.

First, RGB image signals R2, G2, B2 constituted by gradation data are input from the backlight intensity determination circuit 203 (S1).

Next, the image signals R2, G2, B2 are subjected to reverse gamma conversion and thereby converted to image signals R3, G3, B3 constituted by brightness data (S2).

Subsequently, a conversion formula for converting the image signals R3, G3, B3 for three colors to image signals for four colors is determined for each pixel (S3).

Next, for each pixel, the image signals R3, G3, B3 for three colors are converted to image signals R4, G4, B4, Y4 for four colors by means of the determined conversion formula (S4).

Subsequently, the image signals R4, G4, B4, Y4 are subjected to gamma conversion to output image signals $R_{out}$, $G_{out}$, $B_{out}$, $Y_{out}$ constituted by gradation data (S5).

Figure 14:
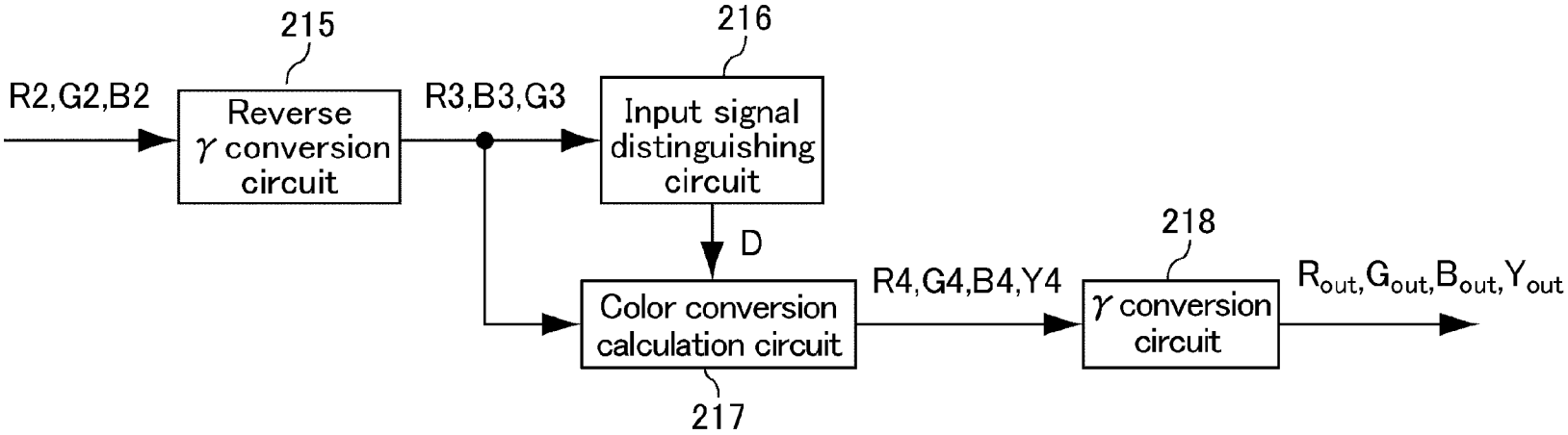
FIG. 14 shows a block diagram of the color conversion circuit according to Embodiment 2.

FIG. 14 shows a block diagram of the color conversion circuit of Embodiment 2.

As shown in FIG. 14, the color conversion circuit 204 includes a reverse gamma conversion circuit 215, an input signal distinguishing circuit 216, a color conversion calculation circuit 217, and a gamma conversion circuit 218.

The reverse gamma conversion circuit 215 subjects the image signals R2, G2, B2 to reverse gamma conversion to generate image signals R3, G3, B3 constituted by brightness data.

The input signal distinguishing circuit 216 determines an algorithm for converting to image signals R4, G4, B4, Y4 for four colors as described in the above calculations based on the image signals R3, G3, B3 for three colors that are output from the reverse gamma conversion circuit 215. More specifically, similarly to the above described equations (c) and (d), R4 and G4 are calculated based on the following equations:

$$R4=(1+\alpha)\times R3-\alpha\times \mathrm{MAX}(R3,G3) \quad \text{(c)'}$$

$$G4=(1+\beta)\times G3-\beta\times \mathrm{MAX}(R3,G3) \quad \text{(d)'}$$

Subsequently, the input signal distinguishing circuit 216 determines whether the case in question is a case where (1) (c)' and (d)' both take a positive value, (2) (c)' takes a negative value, or (3) (d)' takes a negative value, and outputs a control signal D indicating which of the following conversion formulas to use to the color conversion calculation circuit 217.

B4=B3 (common for all cases)

R4=(1+α)×R3−α×MAX(R3, G3) (at the time of (1))

=0 (at the time of (2))

=(1+α)×R3−{α×(1+β)/β}×G3 (at the time of (3))

G4=(1+β)×G3−β×MAX(R3, G3) (at the time of (1))

=(1+β)×G3−{β×(1+α)/α}×R3 (at the time of (2))

=0 (at the time of (3))

Y4=MAX(R3, G3) (at the time of (1))

=(1+α)/α×R3 (at the time of (2))

=(1+β)/β×G3 (at the time of (3))

The conditions (1) to (3) specified here are as follows.

$$R3<(1+\beta)/\beta\times G3 \text{ and } G3<(1+\alpha)/\alpha\times R3 \quad (1)$$

$$G3>(1+\alpha)/\alpha\times R3 \quad (2)$$

$$R3>(1+\beta)/\beta\times G3 \quad (3)$$

The color conversion calculation circuit 217 converts the image signals R3, G3, B3 for three colors to image signals R4, G4, B4, Y4 for four colors using one of the above conversion formulas that is determined by the control signal D output from the input signal distinguishing circuit 216.

The gamma conversion circuit 218 subjects the image signals R4, G4, B4, Y4 output from the color conversion calculation circuit 217 to gamma conversion to generate image signals $R_{out}$, $G_{out}$, $B_{out}$, $Y_{out}$ constituted by gradation data, and outputs the image signals $R_{out}$, $G_{out}$, $B_{out}$, $Y_{out}$ to the source driver.

Thus, according to the present embodiment, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

EMBODIMENT 3

A liquid crystal display device of the present embodiment has the same configuration as Embodiment 2, except that a white picture element that does not include a color filter is provided instead of a yellow color filter (Y picture element).

In this connection, a colorless transparent film is formed in correspondence with each of the white pixels on the inner face of the substrate on the observation side to adjust the liquid crystal layer thickness of the white pixels to a thickness of the same level as the liquid crystal layer thickness of the pixels 13R, 13G, 13B for the three colors red, green and blue.

Hereunder, a control method for the liquid crystal display device of the present embodiment is described.

Figure 15:
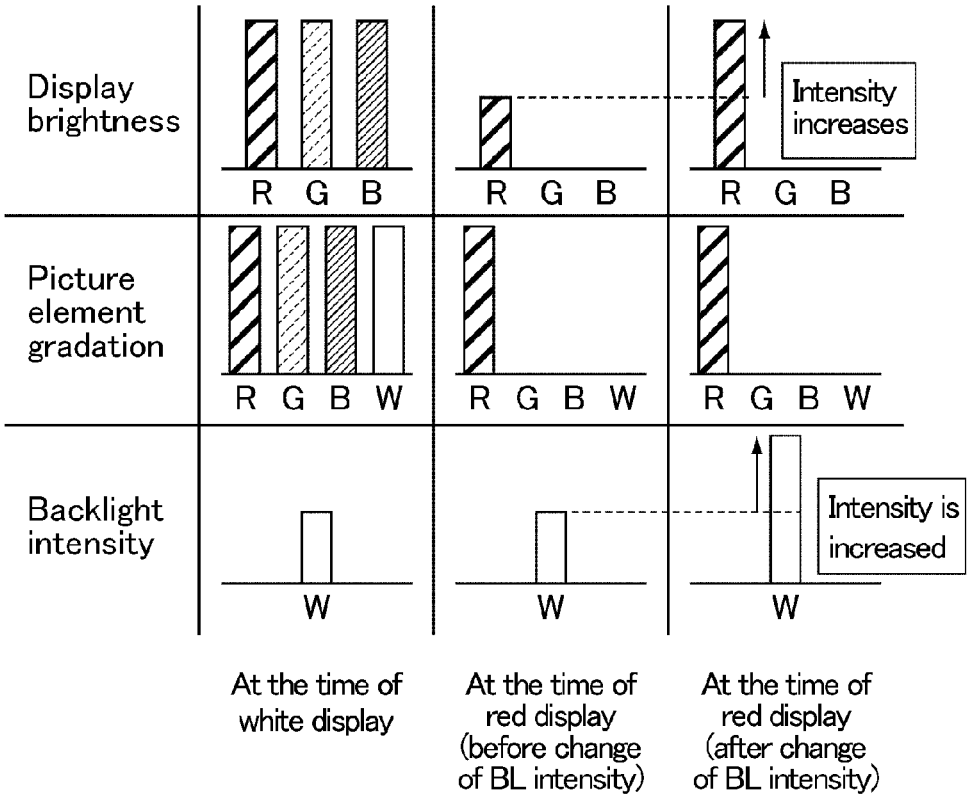
FIG. 15 is a view for explaining a method of driving a liquid crystal display device according to Embodiment 3.

FIG. 15 is a view for describing a driving method for the liquid crystal display device of Embodiment 3.

The relationship between the backlight intensity and the gradations of picture elements when displaying white with the maximum gradation is shown in the left column in FIG. 15. The gradation value of the picture element of each color is the maximum gradation value. Next, a case is considered in which red is displayed at the maximum gradation value without altering the light emission intensity of the backlight (see center column in FIG. 15). In this case, only the R picture element is controlled to have the maximum gradation, and the other picture elements are all controlled to have a gradation of 0. At this time, although the display is a red display, the red brightness is darker than at a time of a white display. The reason is that although the red brightness at the time of a white display is a combination of red light transmitted through the R filter and red light transmitted through the white filter, the red brightness at the time of a red display is only red light transmitted through the R filter. To eliminate the cause of this decrease in the red brightness, control is performed to increase the light emission intensity of the backlight (see the right column in FIG. 15). If it is assumed that, at the time of a white display, the amount of red light transmitted from the white filter is a multiple of $\alpha$ relative to the amount of red light transmitted from the R filter, the red brightness in the center column will be a multiple of $1/(1+\alpha)$ relative to the red brightness in the left column. Accordingly, it is sufficient to increase the light emission intensity of the backlight by a multiple of $(1+\alpha)$ to make the red brightness when displaying white with the maximum gradation and the red brightness when displaying red with the maximum gradation equal. Although the foregoing description refers to a case of displaying the same gradation over the entire screen, when actually performing display, the light emission intensity of the backlight will be equal for all pixels. Therefore, the control procedures are:

(1) Extracting minimum required backlight intensities for all pixels, and calculating the largest backlight intensity from among the extracted values; and (2) Calculating a gradation to be input to picture elements of each color with respect to the calculated backlight intensity.

A system block for implementing the above described system is the same as the system block illustrated in FIG. 8 according to Embodiment 2, and a flow of processing to generate signals for four colors from input signals is also the same as in Embodiment 2. An algorithm for determining the backlight intensity is different from Embodiment 2, and is thus described hereunder.

Figure 16:
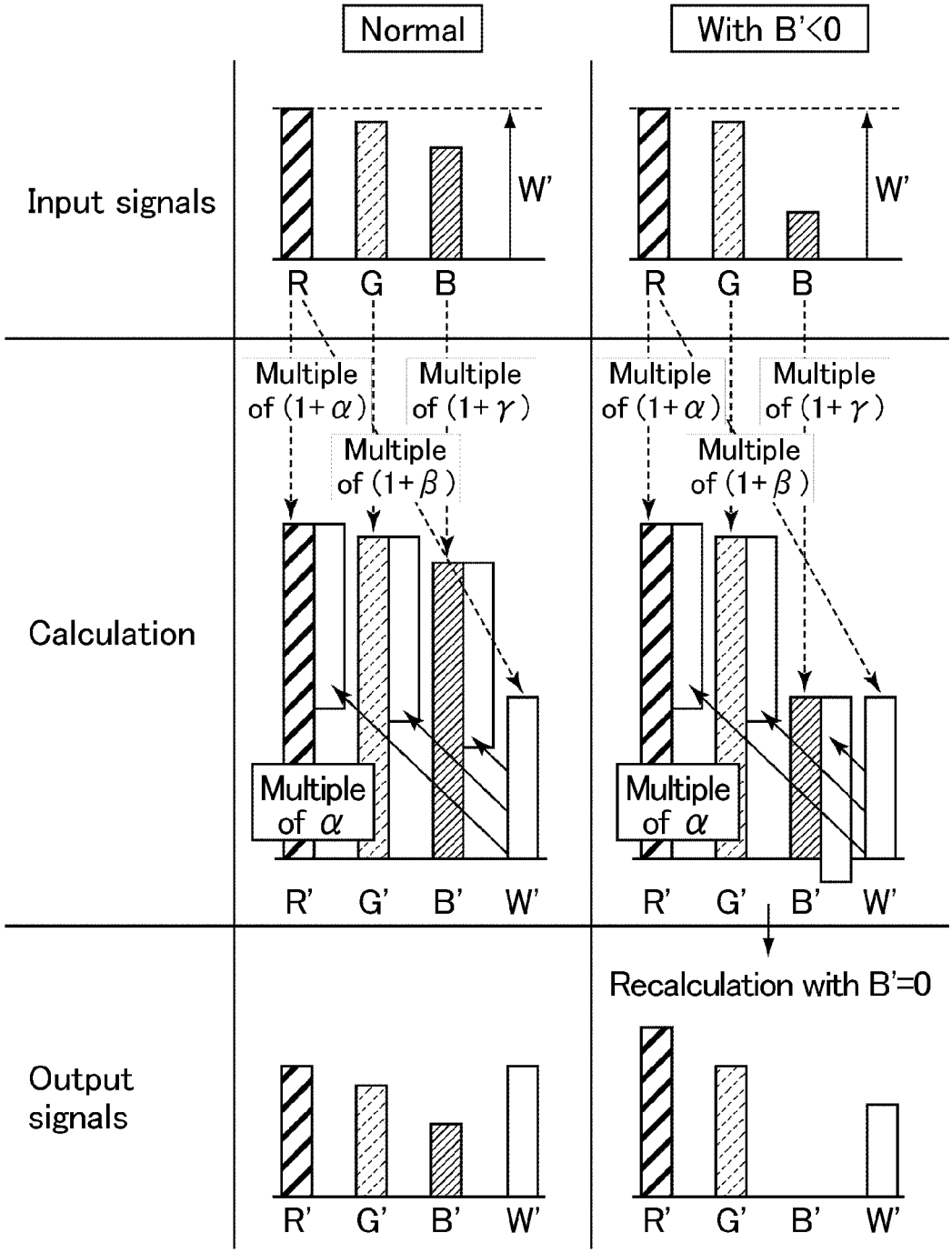
FIG. 16 is a view for explaining an algorithm for converting signals for three colors into signals for four colors according to Embodiment 3.
Figure 17:
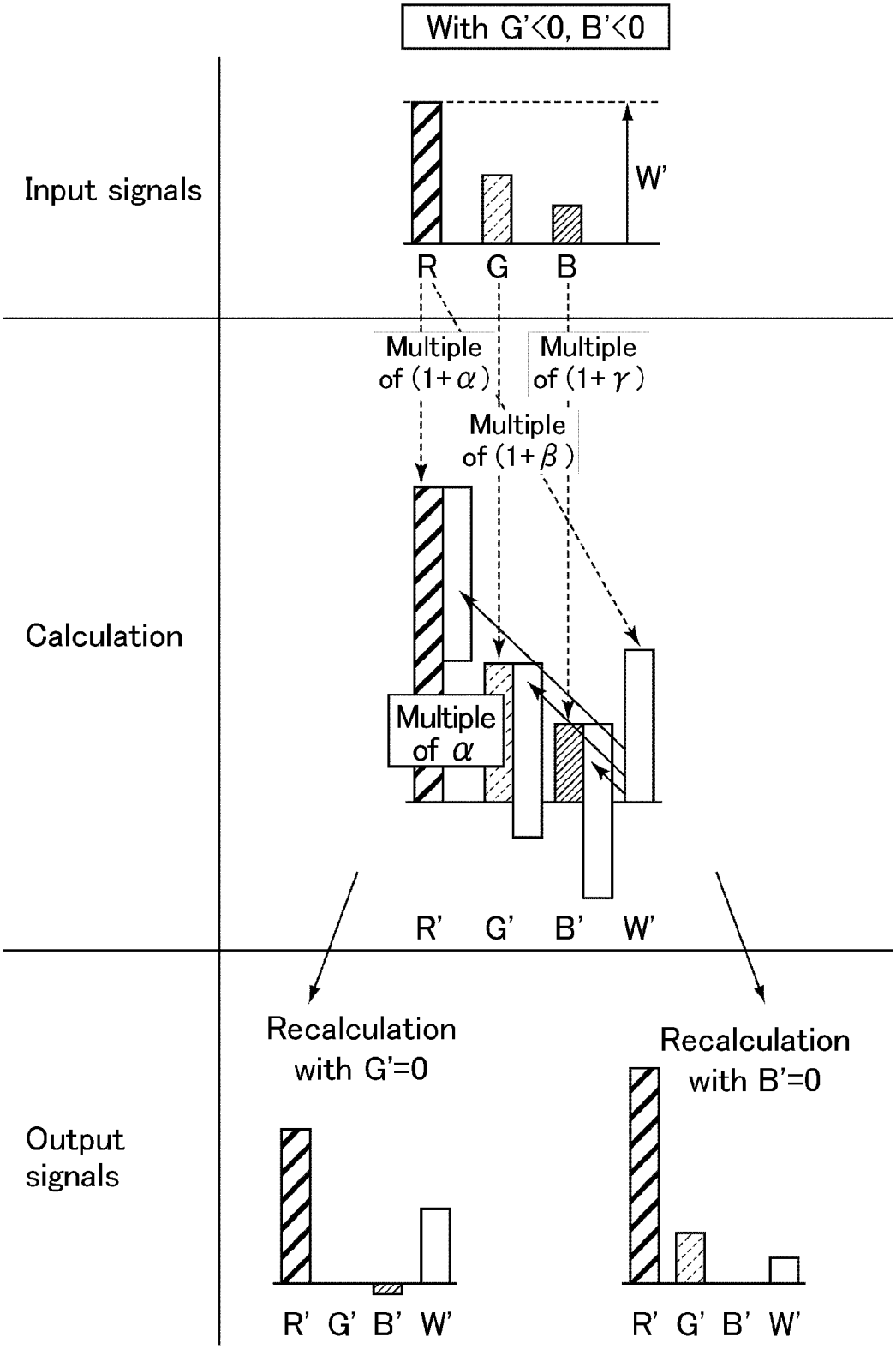
FIG. 17 is a view for explaining an algorithm for converting signals for three colors into signals for four colors according to Embodiment 3.

FIGS. 16 and 17 are view for explaining a conversion algorithm that converts signals for three colors to signals for four colors according to Embodiment 3.

The figures illustrate an algorithm for converting RGB input signals to R'G'B'W' signals. In this case, it is assumed that the transmittance amount of red light from a white filter is a multiple of $\alpha$ relative to the transmittance amount thereof from a red filter. Further, it is assumed that the transmittance amount of green light from a white filter is a multiple of $\beta$ relative to the transmittance amount thereof from a green filter, and that the transmittance amount of blue light from a white filter is a multiple of $\gamma$ relative to the transmittance amount thereof from a blue filter.

For the same reasons as those described above with respect to Embodiment 2, if it is assumed that W'=MAX(R, G, B) (assumed that MAX(R, G, B) is a function that takes the largest value among R, G and B), since $$R=R'\times 1/(1+\alpha)+W'\times\alpha/(1+\alpha)$$

$$G=G'\times 1/(1+\beta)+W'\times\beta/(1+\beta)$$

$$B=B'\times 1/(1+\gamma)+W'\times\gamma/(1+\gamma),$$

then $$R'=(1+\alpha)\times R-\alpha\times \mathrm{MAX}(R,G,B)$$

$$G'=(1+\beta)\times G-\beta\times \mathrm{MAX}(R,G,B)$$

$$B'=(1+\gamma)\times B-\gamma\times \mathrm{MAX}(R,G,B).$$

In this case, although the values for all of R', G', and B' must be greater than or equal to 0, there are cases in which the values for R', G', and B' may take a negative value depending on the values of the input signals. In such a case it is necessary to change the values, including W'. A case in which the values for all of R', G', and B' are greater than or equal to 0 is shown in the left column in FIG. 16.

I) When the above expression becomes R'<0, G'>0, B'>0 G', B', and W' are recalculated taking R' as equal to 0.

$$W'=(1+\alpha)/\alpha\times R$$

$$G'=(1+\beta)\times G-\beta\times(1+\alpha)/\alpha\times R$$

$$B'=(1+\gamma)\times B-\gamma\times(1+\alpha)/\alpha\times R$$

II) When the above expression becomes R'>0, G'<0, B'>0

$$G'=0$$

$$W'=(1+\beta)/\beta\times G$$

$$R'=(1+\alpha)\times R-\alpha\times(1+\beta)/\beta\times G$$

$$B'=(1+\gamma)\times B-\gamma\times(1+\beta)/\beta\times G$$

III) When the above expression becomes R'>0, G'>0, B'<0 (see right column in FIG. 16)

$$B'=0$$

$$W'=(1+\gamma)/\gamma\times B$$

$$R'=(1+\alpha)\times R-\alpha\times(1+\gamma)/\gamma\times B$$

$$G'=(1+\beta)\times G-\beta\times(1+\gamma)/\gamma\times B$$

IV) When the above expression becomes R'<0, G'<0, B'>0

Although a calculation is performed taking R' as equal to 0 or G' as equal to 0, the calculation differs according to the size relationship between R and G.

If G'>0 in I), the expression of I) can be used, and if R'>0 in II), the expression of II) can be used, and a boundary thereof is:

$$(1+\beta)/\beta\times G=(1+\alpha)/\alpha\times R.$$

When $(1+\beta)/\beta\times G<(1+\alpha)/\alpha\times R$, II) is used since G'<0 in I).

When $(1+\beta)/\beta\times G>(1+\alpha)/\alpha\times$, I) is used since R'<0 in II).

V) When the above expression becomes R'>0, G'<0, B'<0 (see FIG. 17)

When $(1+\gamma)/\gamma\times B<(1+\beta)/\beta\times G$, III) is used since B'<0 in II).

When $(1+\gamma)/\gamma\times B>(1+\beta)/\beta\times G$, II) is used since G'<0 in III).

VI) When the above expression becomes R'<0, G'>0, B'<0

When $(1+\alpha)/\alpha\times R<(1+\gamma)/\gamma\times B$, I) is used since R'<0 in III).

When $(1+\alpha)/\alpha\times R>(1+\gamma)/\gamma\times B$, III) is used since B'<0 in I).

Thus, the conversion from RGB to R'G'B'W' is one of the following:

(1) When $R>\alpha/(1+\alpha)\times MAX(R, G, B)$, $G>\beta/(1+\beta)\times MAX(R,G,B)$, and $B>\gamma/(1+\gamma)\times MAX(R,G,B)$:

$W'=MAX(R,G,B)$ $R'=(1+\alpha)\times R-\alpha\times MAX(R,G,B)$ $G'=(1+\beta)\times G-\beta\times MAX(R,G,B)$ $B'=(1+\gamma)\times B-\gamma\times MAX(R,G,B)$ (2) When $R<\alpha/(1+\alpha)\times MAX(R, G, B)$, $(1+\beta)/\beta\times G>(1+\alpha)/\alpha\times R$, and $(1+\alpha)/\alpha\times R<(1+\gamma)/\gamma\times B$:

$W'=(1+\alpha)/\alpha\times R$ $R'=0$ $G'=(1+\beta)\times G-\beta\times(1+\alpha)/\alpha\times R$ $B'=(1+\gamma)\times B-\gamma\times(1+\alpha)/\alpha\times R$ (3) When $G<\beta/(1+\beta)\times MAX(R, G, B)$, $(1+\beta)/\beta\times G<(1+\alpha)/\alpha\times R$, and $(1+\gamma)/\gamma\times B>(1+\beta)/\beta\times G$:

$W'=(1+\beta)/\beta\times G$ $R'=(1+\alpha)\times R-\alpha\times(1+\beta)/\beta\times G$ $G'=0$ $B'=(1+\gamma)\times B-\gamma\times(1+\beta)/\beta\times G$ (4) When $B<\gamma/(1+\gamma)\times MAX(R, G, B$ $(1+\alpha)/\alpha\times R>(1+\gamma)/\gamma\times B$, and $(1+\gamma)/\gamma\times B<(1+\beta)/\beta\times G$:

$B'=0$ $W'=(1+\gamma)/\gamma\times B$ $R'=(1+\alpha)\times R-\alpha\times(1+\gamma)/\gamma\times B$ $G'=(1+\beta)\times G-\beta\times(1+\gamma)/\gamma\times B$.

Next, an algorithm for determining backlight intensities is described.

Figure 18:
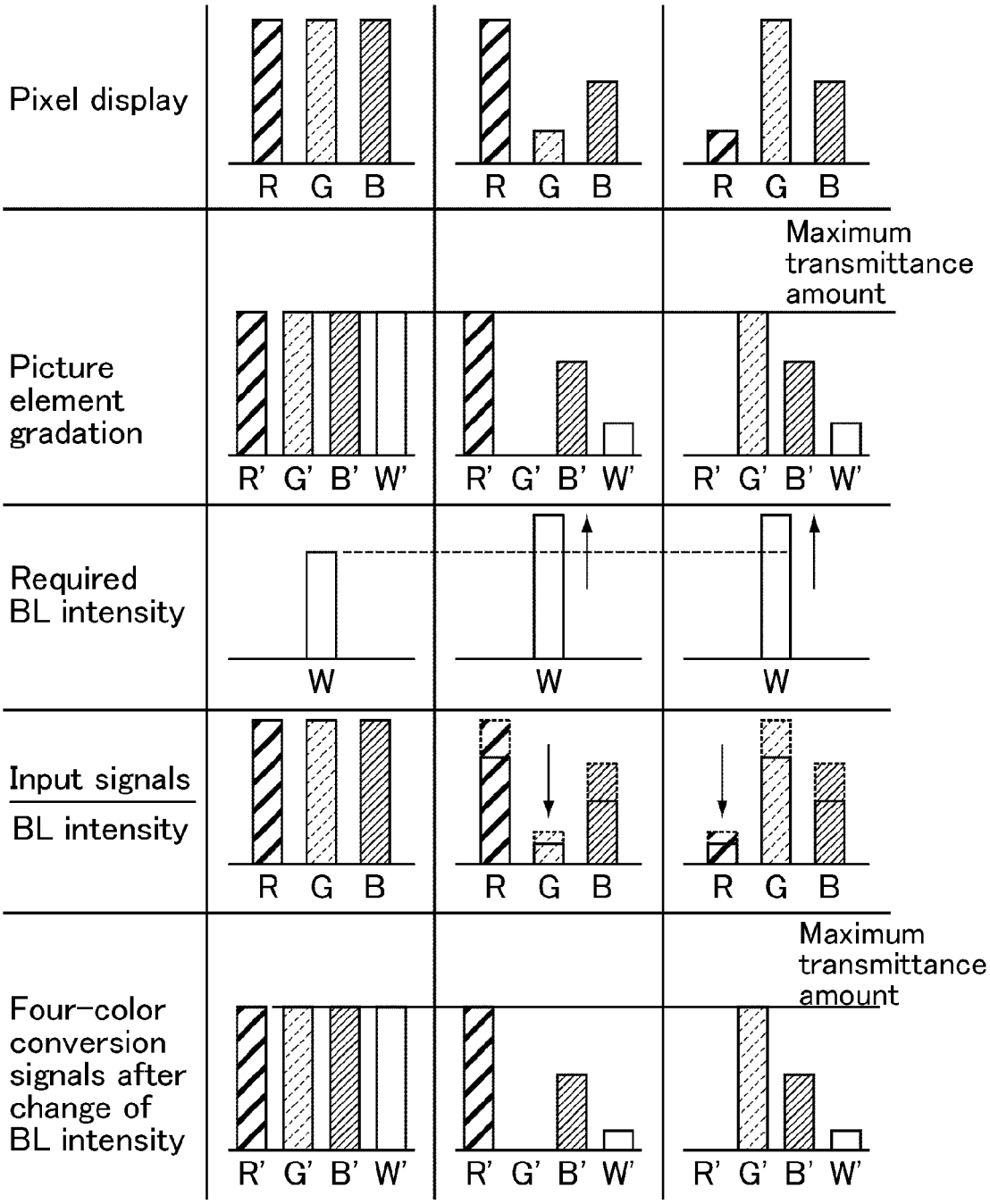
FIG. 18 is a view for explaining an algorithm for determining backlight intensities according to Embodiment 3.

FIG. 18 is a view for explaining an algorithm for determining backlight intensities according to Embodiment 3.

The procedures thereof include, first, determining a required backlight intensity for each pixel, and then setting the maximum value thereof as a backlight intensity that is required to display. A method of determining the required backlight intensity w for each pixel will now be described. The required backlight intensity w takes an intensity value of 1 when the values of input signals R, G and B are all 1 and R', G', B' and W' are converted to 1.

The required backlight intensity w can be determined in a similar manner to Embodiment 2, and as described above, among values converted to R', G', B' and W' signals, the following nine values are those with a possibility of taking the maximum value.

R, G, B $(1+\alpha)\times R-\{\alpha(1+\beta)/\beta\}\times G$ $(1+\beta)\times G-\{\beta(1+\alpha)/\alpha\}\times R$ $(1+\alpha)\times R-\{\alpha(1+\gamma)/\gamma\}\times B$ $(1+\gamma)\times B-\{\gamma(1+\alpha)/\alpha\}\times R$ $(1+\gamma)\times B-\{\gamma(1+\beta)/\beta\}\times G$ $(1+\beta)\times G-\{\beta(1+\gamma)/\gamma\}\times B$ Consequently, the required backlight intensity for a pixel with a certain combination of input signals RGB is a maximum value among the above nine values.

Even if the intensity of the backlight is greater than required, since the transmittance amount of light can be reduced by the liquid crystal, the required backlight intensity for the backlight unit as a whole is the maximum value among maximum values of the above described nine values that are determined for all combinations of the input signals RGB.

Thus, according to the present embodiment, the required minimum backlight intensity is determined for each pixel (see third row from the top in FIG. 18). Subsequently, the input signals RGB are divided by the thus determined required backlight intensity w (see fourth row from the top in FIG. 18). Next, the divided input signals RGB are converted to signals for four colors (see fifth row from the top in FIG. 18). Accordingly, even in a case where the output gradation is greater than the maximum gradation when input signals are converted as they are into signals for four colors (see second row from the top in FIG. 18), the values of R'G'B'W' all become numbers that are less than or equal to 1. Thus, the values of R', G', B', and W' become less than or equal to 1 by controlling the backlight intensity, and the values of R', G', B' and W' become equal to or greater than 0 by classifying according to different cases when converting from three colors to four colors.

The liquid crystal display device of the present embodiment has the same block configuration as that of Embodiment 2 shown in FIG. 10.

The same processing as in Embodiment 2 that is illustrated in FIG. 11 is performed by the backlight intensity determination circuit of the present embodiment.

Further, the backlight intensity determination circuit of the present embodiment has the same block configuration as that of Embodiment 2 shown in FIG. 12. However, as in the case of the above described computation, the required backlight light amount L for each pixel is one value among the nine brightnesses R, G, B, $(1+\alpha)\times R-\{\alpha(1+\beta)/\beta\}\times G$, $(1+\beta)\times G-\{\beta(1+\alpha)/\alpha\}\times R$, $(1+\alpha)\times R-\{\alpha(1+\gamma)/\gamma\}\times B$, $(1+\gamma)\times B-\{\gamma(1+\alpha)/\alpha\}\times R$, $(1+\gamma)\times B-\{\gamma(1+\beta)/\beta\}\times G$, and $(1+\beta)\times G-\{\beta(1+\gamma)/\gamma\}\times B$.

Figure 19:
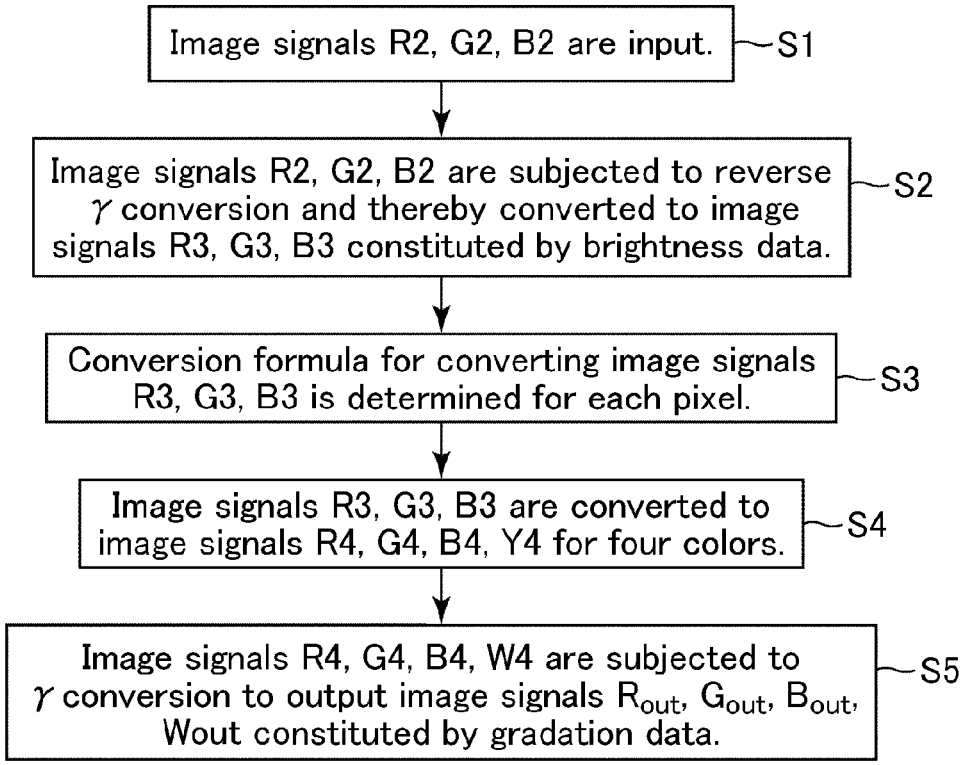
FIG. 19 is a view that illustrates a flow of processing in a color conversion circuit according to Embodiment 3.

FIG. 19 illustrates the flow of processing in the color conversion circuit of Embodiment 3. In the color conversion circuit of the present embodiment, the following processing is performed for each frame.

First, RGB image signals R2, G2, B2 constituted by gradation data are input from the backlight intensity determination circuit (S1).

Next, the image signals R2, G2, B2 are subjected to reverse gamma conversion and are converted to image signals R3, G3, B3 constituted by brightness data (S2).

Subsequently, a conversion formula for converting the image signals R3, G3, B3 for three colors to image signals for four colors is determined for each pixel (S3).

Next, for each pixel, the image signals R3, G3, B3 for three colors are converted to image signals R4, G4, B4, W4 for four colors using the determined conversion formula (S4).

Subsequently, the image signals R4, G4, B4, W4 are subjected to gamma conversion, and image signals $R_{out}$, $G_{out}$, $B_{out}$, $W_{out}$ constituted by gradation data are output (S5).

Figure 20:
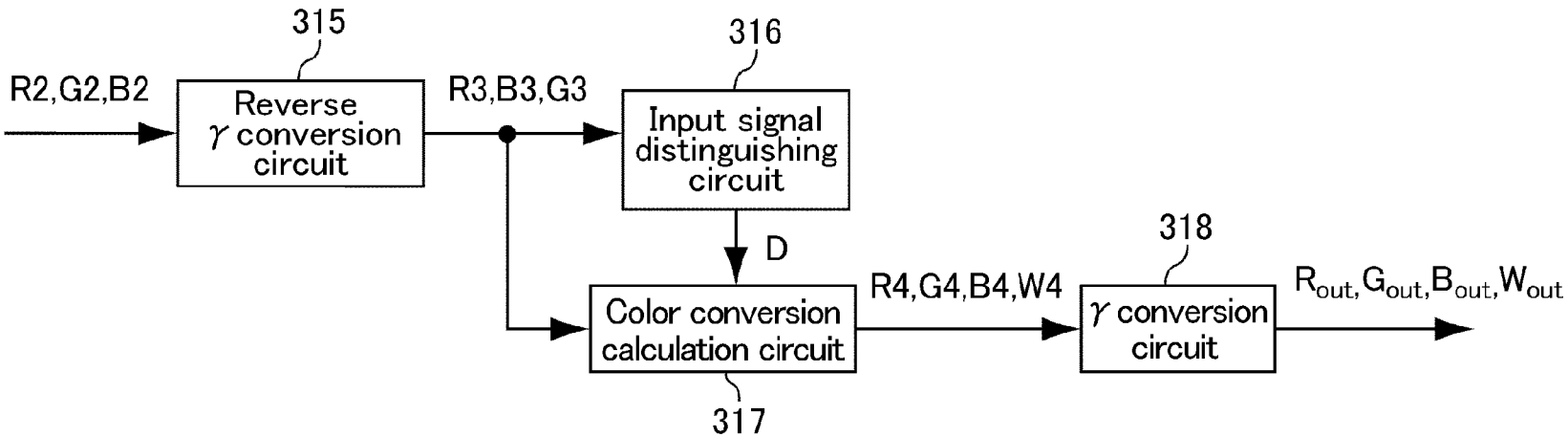
FIG. 20 shows a block diagram of a color conversion circuit according to Embodiment 3.

FIG. 20 is a block diagram of the color conversion circuit of Embodiment 3.

As shown in FIG. 20, the color conversion circuit of the present embodiment includes a reverse gamma conversion circuit 315, an input signal distinguishing circuit 316, a color conversion calculation circuit 317, and a gamma conversion circuit 318.

The reverse gamma conversion circuit 315 subjects the image signals R2, G2, B2 to reverse gamma conversion to generate image signals R3, G3, B3 constituted by brightness data.

The input signal distinguishing circuit 316 determines an algorithm for converting the image signals R3, G3, B3 for three colors that are output from the reverse gamma conversion circuit 315 to image signals R4, G4, B4, W4 for four colors by the above described calculation. More specifically, R4, G4 and B4 are calculated based on the following equations:

$$R4=(1+\alpha)\times R3-\alpha\times \mathrm{MAX}(R3,G3,B3)$$

$$G4=(1+\beta)\times G3-\beta\times \mathrm{MAX}(R3,G3,B3)$$

$$B4=(1+\gamma)\times B3-\gamma\times \mathrm{MAX}(R3,G3,B3)$$

Next, it is determined which of the following cases (1) to (4) applies to the current instance. Subsequently, a control signal D indicating which of the following conversion formulas to use is output to the color conversion calculation circuit 317.

(1) When R4>0, G4>0, B4>0

A control signal D instructing the use of the following formula for calculation is output to the color conversion calculation circuit.

$$W4=\mathrm{MAX}(R,G,B)$$

$$R4=(1+\alpha)\times R3-\alpha\times \mathrm{MAX}(R3,G3,B3)$$

$$G4=(1+\beta)\times G3-\beta\times \mathrm{MAX}(R3,G3,B3)$$

$$B4=(1+\gamma)\times B3-\gamma\times \mathrm{MAX}(R3,G3,B3)$$

(2) When R4<0, (1+β)/β×G3>(1+α)/α×R3, (1+α)/α×R3<(1+γ)/γ×B3

A control signal D instructing the use of the following formula for calculation is output to the color conversion calculation circuit.

$$W4=(1+\alpha)/\alpha\times R3$$

$$R4=0$$

$$G4=(1+\beta)\times G3-\beta\times(1+\alpha)/\alpha\times R3$$

$$B4=(1+\gamma)\times B3-\gamma\times(1+\alpha)/\alpha\times R3$$

(3) When G4<0, (1+β)/β×G4<(1+α)/α×R4, (1+γ)/γ×B4>(1+β)/β×G4

A control signal D instructing the use of the following formula for calculation is output to the color conversion calculation circuit.

$$W4=(1+\beta)/\beta\times G3$$

$$R4=(1+\alpha)\times R3-\alpha\times(1+\beta)/\beta\times G3$$

$$G4=0$$

$$B4=(1+\gamma)\times B3-\gamma\times(1+\beta)/\beta\times G3$$

(4) When B4<0, (1+α)/α×R3>(1+γ)/γ×B3, (1+γ)/γ×B3<(1+β)/β×G3

A control signal D instructing the use of the following formula for calculation is output to the color conversion calculation circuit.

$$W4=(1+\gamma)/\gamma\times B3$$

$$R4=(1+\alpha)\times R3-\alpha\times(1+\gamma)/\gamma\times B3$$

$$G4=(1+\beta)\times G3-\beta\times(1+\gamma)/\gamma\times B3$$

$$B4=0$$

The color conversion calculation circuit 317 converts the image signals R3, G3, B3 for three colors to image signals R4, G4, B4, W4 for four colors by using one of the above conversion formulas that is determined by the control signal D output from the input signal distinguishing circuit 316.

The gamma conversion circuit 318 subjects the image signals R4, G4, B4, W4 output from the color conversion calculation circuit 317 to gamma conversion to generate image signals $B_{out}$, $G_{out}$, $B_{out}$, $W_{out}$ constituted by gradation data, and outputs the image signals $R_{out}$, $G_{out}$, $B_{out}$, $W_{out}$ to the source driver.

Thus, according to the present embodiment, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

EMBODIMENT 4

A liquid crystal display device of the present embodiment has the same configuration as Embodiment 2, except that, instead of a white backlight unit, the liquid crystal display device of the present embodiment includes an RGB backlight unit in which the light emission intensities of R, G and B can be independently changed.

Although a backlight light source may be three kinds of LEDs having the colors R, G, and B, any kind of light source may be used as long as the unit enables independent adjustment of the light emission intensities of R, G, and B, respectively.

Although a case is described here in which a yellow color filter (Y picture element) is added, the description will similarly apply if R is replaced with B when a cyan color filter (C picture element) is added, and if G is replaced with B when a magenta color filter (M picture element) is added.

Hereunder, a control method for the liquid crystal display device of the present embodiment is described.

Figure 21:
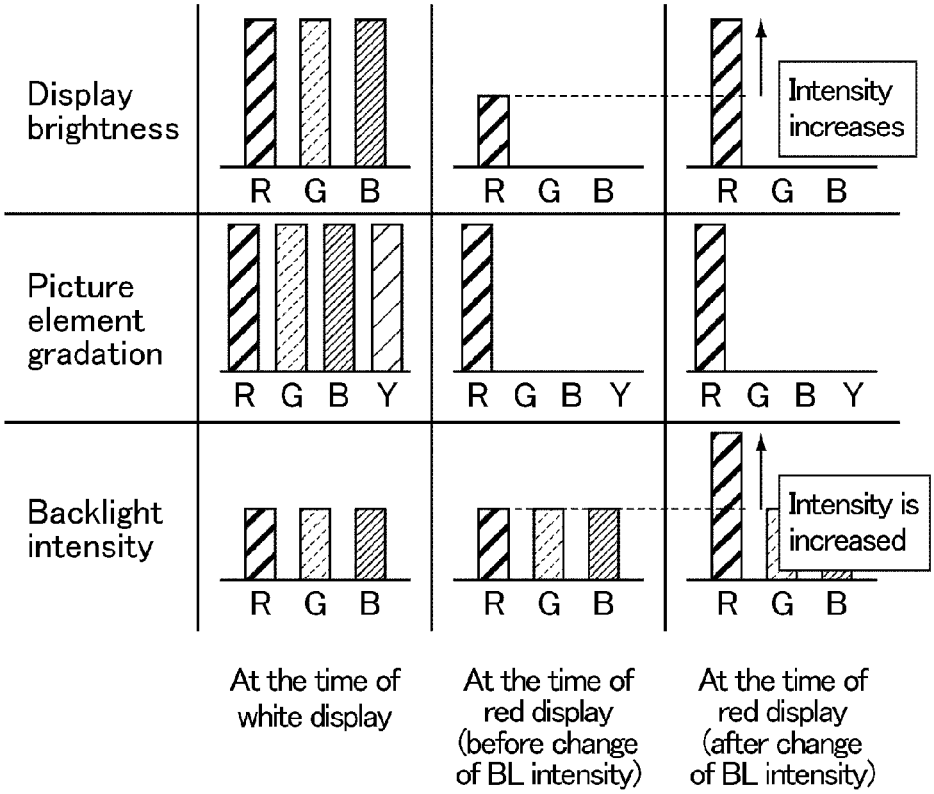
FIG. 21 is a view for explaining a method of driving a liquid crystal display device according to Embodiment 4.

FIG. 21 is a view for describing a driving method of the liquid crystal display device according to Embodiment 4.

The relationship between the backlight intensity and the gradations of picture elements when displaying white with the maximum gradation is shown in the left column in FIG. 21. The utilization efficiency of light is maximized by controlling the picture element of each color to have the maximum gradation. Next, a case is considered in which red is displayed at the maximum gradation value without altering the light emission intensity of the backlight (see the center column in FIG. 21). In this case, only the R picture element is controlled to have the maximum gradation, and the other picture elements are all controlled to have a gradation of 0. At this time, although the display is a red display, the red brightness is darker than at a time of a white display. The reason is that although the red brightness at the time of a white display is a combination of red light transmitted through the R filter and red light transmitted through the yellow filter, the red brightness at the time of a red display is only red light transmitted through the R filter. To eliminate the cause of this decrease in the red brightness, control is performed to increase the light emission intensity of only a red light source (see the right column in FIG. 21). If it is assumed that, at the time of a white display, the amount of red light transmitted from the yellow filter is a multiple of $\alpha$ relative to the amount of red light transmitted from the R filter, then the red brightness in the center column will be a multiple of $1/(1+\alpha)$ relative to the red brightness in the left column. Accordingly, it is sufficient to increase the light emission intensity of the red light source by a multiple of $(1+\alpha)$ to make the red brightness when displaying white with the maximum gradation and the red brightness when displaying red with the maximum gradation equal. Although the foregoing description refers to a case of displaying the same gradation over the entire screen, when actually performing display, the light emission intensity of the backlight will be equal for all pixels. Therefore, the control procedures are:

(1) Extracting minimum required backlight intensities for all pixels with respect to R, G, and B, respectively, and calculating the largest backlight intensity among the extracted values for each of R, G, and B; and (2) Calculating a gradation to be input to picture elements of each color with respect to the calculated backlight intensities.

A system block for implementing the above described system is the same as the system block illustrated in FIG. 8 according to Embodiment 2, and a flow of processing to generate signals of four colors from input signals is also the same as in Embodiment 2.

An algorithm for converting RGB input signals that are input to the color conversion circuit into R'G'B'Y' signals is also the same as that described in Embodiment 2.

Hereunder, an algorithm for determining backlight intensities according to the present embodiment is described.

Figure 22:
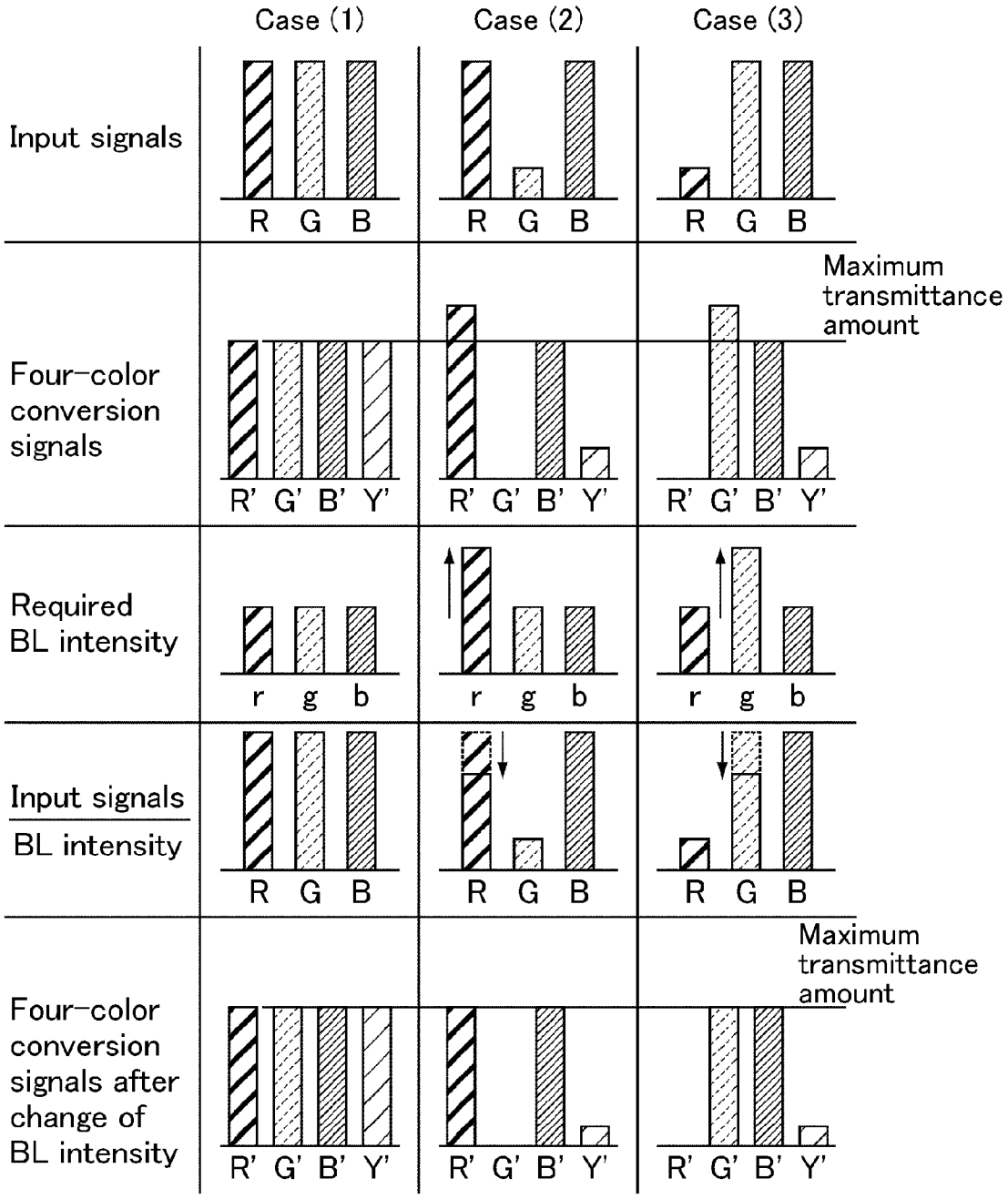
FIG. 22 is a view for explaining an algorithm for determining backlight intensities according to Embodiment 4.

FIG. 22 is a view for explaining an algorithm for determining backlight intensities according to Embodiment 4. Backlight intensities are denoted by r, g, and b.

The original input signals are converted to signals that have been divided by a backlight intensity before being input to the color conversion circuit. Therefore, the following relationships hold with respect to the original input signals RGB and signals R'G'B'Y' obtained by converting the original input signals RGB into signals for four colors.

$$\text{Always, } B'=B/b \tag{a}$$

(1) When $G/g<(1+\alpha)/\alpha\times R/r$ and $R/r<(1+\beta)/\beta\times G/g$:

$$R'=(1+\alpha)\times R/r-\alpha\times \mathrm{MAX}(R/r,G/g) \tag{b}$$

$$G'=(1+\beta)\times G/g-\beta\times \mathrm{MAX}(R/r,G/g) \tag{c}$$

$$Y'=\mathrm{MAX}(R/r,G/g) \tag{d}$$

(2) When $G/g>(1+\alpha)/\alpha\times R/r$:

$$R'=0$$

$$G'=(1+\beta)\times G/g-\{\beta\times(1+\alpha)/\alpha\}\times R/r \tag{e}$$

$$Y'=(1+\alpha)/\alpha\times R/r \tag{f}$$

(3) When $R/r>(1+\beta)/\beta\times G/g$ $$R'=(1+\alpha)\times R/r-\{\alpha\times(1+\beta)/\beta\}\times G/g \tag{g}$$

$$G'=0$$

$$Y'=(1+\beta)/\beta\times G/g \tag{h}$$

All of the values of R', G', B' and Y' must be greater than or equal to 0 and less than or equal to 1. Since a restriction is applied so that a negative number can not be taken when converting from three colors to four colors, it is sufficient to set r, g, and b so as to satisfy the condition that all of R', G', B' and Y' are less than or equal to 1.

First, based on (a) and (d), it is necessary that $r\geq R$, $g\geq G$, and $b\geq B$. If this is satisfied, (b) and (c) satisfy the condition.

Next, the required values of r and g are considered for cases (2) and (3). Based on (e), the larger that the value of r is, the more that the value of G' increases, and therefore the required value of g increases. Likewise, based on (g), the larger that the value of g is, the larger the required value of r becomes. Consequently, if the required values of r and g are considered even with respect to within only one pixel, there is a possibility that an insufficiency will arise. Therefore, a value of g that is required for the relevant pixel is determined by assuming the maximum value that can be taken for r in (e), and a value of r that is required for the relevant pixel is determined by assuming the maximum value that can be taken for g in (g). Since the maximum value that can be taken for g is:

$$G'=(1+\beta)\times G/g-\{\beta\times(1+\alpha)/\alpha\}\times R/r\leq(1+\beta)/g\leq 1,$$

when R=0 and G=1 the maximum value that can be taken for g is $1+\beta$. Similarly, using (g), the maximum value that can be taken for r is $1+\alpha$.

When $r=1+\alpha$ is substituted into (e) and the value of g required by the pixel is determined, based on $G'=(1+\beta)\times G/g-\{\beta\times(1+\alpha)/\alpha\}\times R/(1+\alpha)\leq 1$, the determined value is $g=\alpha\times(1+\beta)\times G/(\alpha+\beta\times R)$.

Similarly, when $g=1+\beta$ is substituted into (g), the determined value for r is $r=\beta\times(1+\alpha)\times R/(\beta+\alpha\times G)$.

Accordingly, when input signals of a certain pixel are R, G and B, the minimum required backlight intensities for the pixel in question are:

r: largest value among R and $\beta\times(1+\alpha)\times R/(\beta+\alpha\times G)$, g: largest value among G and $\alpha\times(1+\beta)\times G/(\alpha+\beta\times R)$, b: B.

By determining the above values for each pixel and determining maximum values for each of r, g, and b for all input signals, the required backlight intensity for the entire backlight unit can be determined.

Thus, according to the present embodiment, required minimum backlight intensities r, g and b are determined for each pixel (see the third row from the top in FIG. 22). Subsequently, the input signals RGB are divided by the determined required backlight intensities r, g and b (see the fourth row from the top in FIG. 22). Next, the divided input signals RGB are converted to signals for four colors (see the fifth row from the top in FIG. 22). Accordingly, even in a case where an output gradation is greater than the maximum gradation when input signals are converted as they are into signals for four colors (see the second row from the top in FIG. 22), the values of R'G'B'Y' all become numbers that are equal to or greater than 0 and less than or equal to 1.

In this connection, in FIG. 22, the required backlight intensities within a certain pixel are merely raised with respect to amounts that exceed a maximum transmittance amount. When this situation is described with respect to the case of (2), this is a change that assumes a case in which a required intensity of g at another pixel is 1. If the intensity of g can be lowered even when taking the affect on other pixels into account, the value of G obtained by dividing the input signal by the backlight intensity (input signal/BL intensity) will increase, while if it is necessary to further increase the intensity of g at another pixel, the value of G obtained by dividing the input signal by the backlight intensity (input signal/BL intensity) will decrease.

The liquid crystal display device of the present embodiment has the same block configuration as that of Embodiment 2 shown in FIG. 10.

Further, similar processing as that of Embodiment 2 as illustrated in FIG. 11 is performed in the backlight intensity determination circuit of the present embodiment. However, in S3, required backlight light amounts L(R), L(G), and L(B) are determined for the light sources of colors R, G, and B, respectively. Also, in S4, one maximum brightness $L_R$ of the R light sources is determined from among the backlight light amounts L(R) determined for the respective pixels, one maximum brightness $L_G$ of the G light sources is determined from among the backlight light amounts L(G) determined for the respective pixels, and one maximum brightness $L_B$ of the B light sources is determined from among the backlight light amounts L(B) determined for the respective pixels. Further, in S5, an image signal R1/$L_R$ is calculated by dividing the image signal R1 by the maximum brightness $L_R$ for each pixel, an image signal G1/$L_G$ is calculated by dividing the image signal G1 by the maximum brightness $L_G$ for each pixel, and an image signal B1/$L_B$ is calculated by dividing the image signal B1 by the maximum brightness $L_B$ for each pixel. Furthermore, in S6, the image signals R1/$L_R$, G1/$L_G$, B1/$L_B$ are subjected to gamma conversion and image signals R2, G2, B2 constituted by gradation data are output, and light amounts $L_R$, $L_G$, $L_B$ are also output as data for controlling the backlight.

Figure 23:
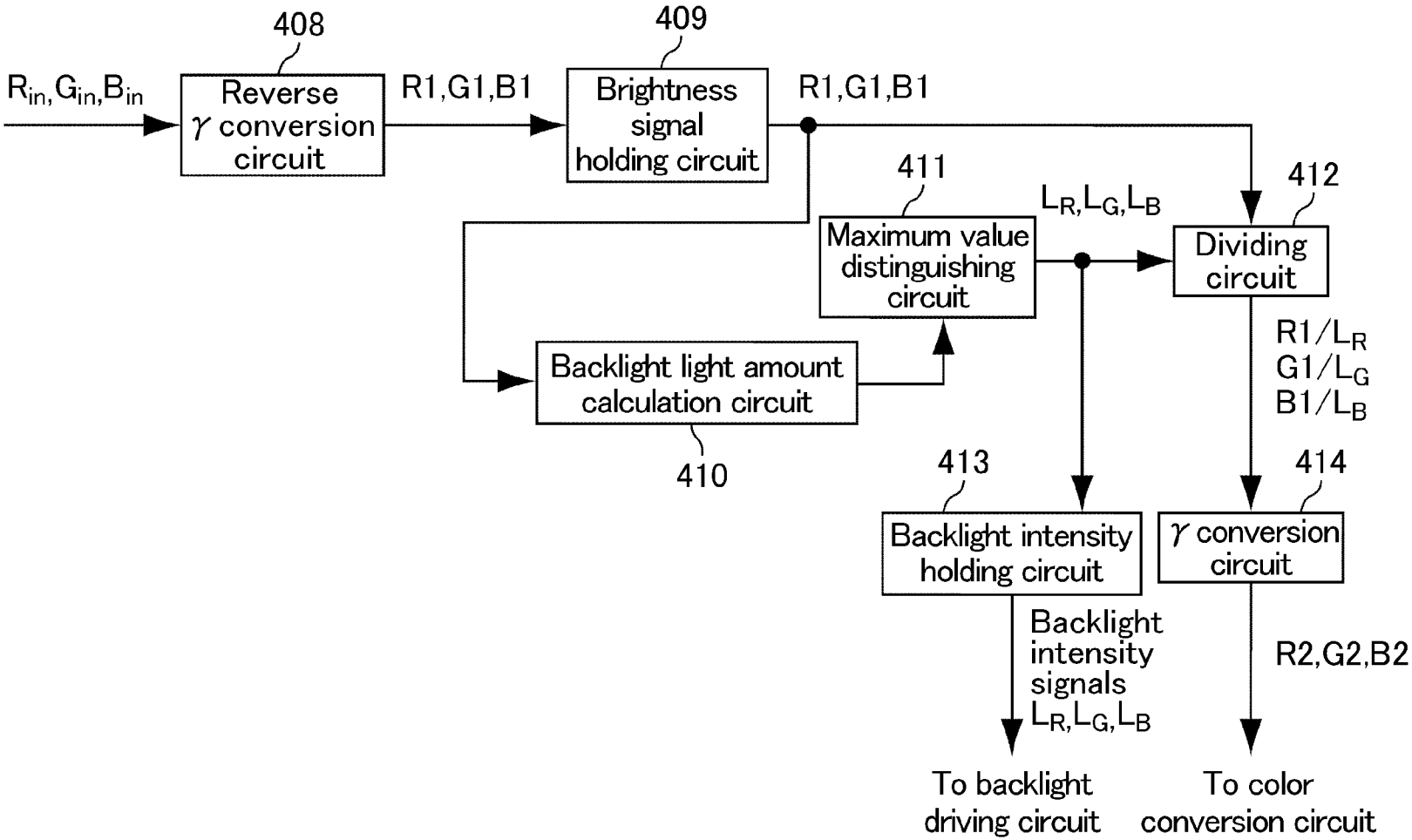
FIG. 23 shows a block diagram of a backlight intensity determination circuit according to Embodiment 4.

FIG. 23 shows a block diagram of the backlight intensity determination circuit according to Embodiment 4.

As shown in FIG. 23, the backlight intensity determination circuit according to Embodiment 4 includes a reverse gamma conversion circuit 408, a brightness signal holding circuit 409, a backlight light amount calculation circuit 410, a maximum value distinguishing circuit 411, a dividing circuit 412, a backlight intensity holding circuit 413, and a gamma conversion circuit 414.

The reverse gamma conversion circuit 408 subjects image signals $R_{in}$, $G_{in}$, $B_{in}$ to reverse gamma conversion to generate image signals R1, G1, B1 constituted by brightness data. The image signals R1, G1, B1 are output to the brightness signal holding circuit 409, and stored for a fixed period (for example, a period of one frame).

The backlight light amount calculation circuit 410 calculates required backlight light amounts L(R), L(G), L(B) for each pixel based on the image signals R1, G1, B1 output from the brightness signal holding circuit 409 as described above. As described in the above calculations, the backlight light amount L(R) is the largest value among R and $\beta\times(1+\alpha)\times R/(\beta+\alpha\times G)$, the backlight light amount L(G) is the largest value among G and $\alpha\times(1+\beta)\times G/(\alpha+\beta\times R)$, and the backlight light amount L(B) is B.

The maximum value distinguishing circuit 411 determines one maximum brightness $L_R$ among the backlight light amounts L(R) for each pixel that are output from the backlight light amount calculation circuit 410, determines one maximum brightness $L_G$ among the backlight light amounts L(G) for each pixel that are output from the backlight light amount calculation circuit 410, and determines one maximum brightness $L_B$ among the backlight light amounts L(B) for each pixel that are output from the backlight light amount calculation circuit 410.

The backlight intensity holding circuit 413 stores the maximum brightnesses $L_R$, $L_G$, $L_B$ output from the maximum value distinguishing circuit 411 for a fixed period (for example, a period of one frame), and also outputs the maximum brightnesses $L_R$, $L_G$, $L_B$ to the backlight driving circuit.

The dividing circuit 412 divides the image signals R1, G1, B1 output from the brightness signal holding circuit 409 by the maximum brightnesses $L_R$, $L_G$, $L_B$ for each pixel to calculate image signals R1/$L_R$, G1/$L_G$, B1/$L_B$.

The gamma conversion circuit 414 subjects the image signals R1/$L_R$, G1/$L_G$, B1/$L_B$ output from the dividing circuit 412 to gamma conversion to generate image signals R2, G2, B2 constituted by gradation data, and outputs the generated image signals R2, G2, B2 to the color conversion circuit.

The color conversion circuit of the present embodiment performs the same processing as in Embodiment 2 that is shown in FIG. 13.

The color conversion circuit of the present embodiment has the same block configuration as in Embodiment 2 as shown in FIG. 14. The processing performed by the color conversion circuit of the present embodiment is also the same as in Embodiment 2.

Thus, according to the present embodiment, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

EMBODIMENT 5

A liquid crystal display device of the present embodiment has the same configuration as Embodiment 3, except that, instead of a white backlight unit, the liquid crystal display device of the present embodiment includes an RGB backlight unit in which the light emission intensities of R, G and B can be changed.

Although the backlight light source may be three kinds of LEDs of the colors R, G, and B, any kind of light source may be used as long as the unit enables independent adjustment of the light emission intensities of R, G, and B, respectively.

Here, a case is described in which a white color filter is added.

Hereunder, a control method for the liquid crystal display device of the present embodiment is described.

Figure 24:
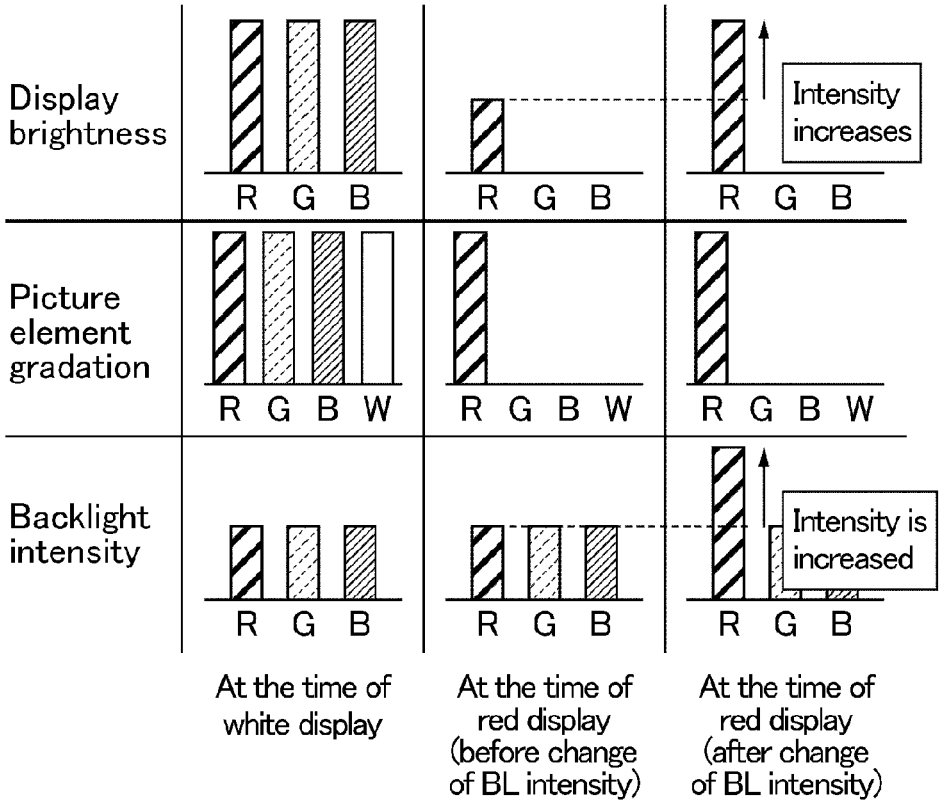
FIG. 24 is a view for explaining a method of driving a liquid crystal display device according to Embodiment 5.

FIG. 24 is a view for describing a driving method of the liquid crystal display device of Embodiment 5.

The relationship between the backlight intensity and the gradations of picture elements when displaying white with the maximum gradation is shown in the left column in FIG. 24. The utilization efficiency of light is maximized by controlling the picture element of each color to have the maximum gradation. Next, a case is considered in which red is displayed at the maximum gradation value without altering the light emission intensity of the backlight (see the center column in FIG. 24). In this case, only the R picture element is controlled to have the maximum gradation, and the other picture elements are all controlled to a gradation of 0. At this time, although the display is a red display, the red brightness is darker than at a time of a white display. The reason is that although the red brightness at the time of a white display is a combination of red light transmitted through the R filter and red light transmitted through the white filter, the red brightness at the time of a red display is only red light transmitted through the R filter. To eliminate the cause of this decrease in the red brightness, control is performed to increase the light emission intensity of only the red light source (see the right column in FIG. 24). If it is assumed that, at the time of a white display, the amount of red light transmitted from the white filter is a multiple of $\alpha$ relative to the amount of red light transmitted from the R filter, then the red brightness in the center column will be a multiple of $1/(1+\alpha)$ relative to the red brightness in the left column. Accordingly, it is sufficient to increase the intensity of the red light source by a multiple of $(1+\alpha)$ to make the red brightness when displaying white with the maximum gradation and the red brightness when displaying red with the maximum gradation equal. Although the foregoing description refers to a case of displaying the same gradation over the entire screen, when actually performing display, the illumination intensity of the backlight will be equal for all pixels. Therefore, the control procedures are:

(1) Extracting minimum required backlight intensities for all pixels with respect to R, G, and B, respectively, and calculating the largest backlight intensity among the extracted values for each of R, G, and B; and (2) Calculating a gradation to be input to picture elements of each color with respect to the calculated backlight intensities.

A system block for implementing the above described system is the same as the system block illustrated in FIG. 8 according to Embodiment 2, and a flow of processing to generate signals for four colors from input signals is also the same as in Embodiment 2.

An algorithm for converting RGB input signals that are input to the color conversion circuit into R'G'B'Y' signals is also the same as the case described in Embodiment 3.

That is, a conversion from RGB to R'G'B'W' is one of the following:

(1) When $R>\alpha/(1+\alpha)\times MAX(R, G, B)$, $$G>\beta/(1+\beta)\times MAX(R,G,B), \text{ and}$$

$$B>\gamma/(1+\gamma)\times MAX(R,G,B):$$

$$W'=MAX(R,G,B)$$

$$R'=(1+\alpha)\times R-\alpha\times MAX(R,G,B)$$

$$G'=(1+\beta)\times G-\beta\times MAX(R,G,B)$$

$$B'=(1+\gamma)\times B-\gamma\times MAX(R,G,B)$$

(2) When $R<\alpha/(1+\alpha)\times MAX(R, G, B)$, $$(1+\beta)/\beta\times G>(1+\alpha)/\alpha\times R, \text{ and}$$

$$(1+\alpha)/\alpha\times R<(1+\gamma)/\gamma\times B:$$

$$W'=(1+\alpha)/\alpha\times R$$

$$R'=0$$

$$G'=(1+\beta)\times G-\beta\times(1+\alpha)/\alpha\times R$$

$$B'=(1+\gamma)\times B-\gamma\times(1+\alpha)/\alpha\times R$$

(3) When $G<\beta/(1+\beta)\times MAX(R, G, B)$, $$(1+\beta)/\beta\times G<(1+\alpha)/\alpha\times R, \text{ and}$$

$$(1+\gamma)/\gamma\times B>(1+\beta)/\beta\times G:$$

$$W'=(1+\beta)/\beta\times G$$

$$R'=(1+\alpha)\times R-\alpha\times(1+\beta)/\beta\times G$$

$$G'=0$$

$$B'=(1+\gamma)\times B-\gamma\times(1+\beta)/\beta\times G$$

(4) When $B<\gamma/(1+\gamma)\times MAX(R, G, B)$, $$(1+\alpha)/\alpha\times R>(1+\gamma)/\gamma\times B, \text{ and}$$

$$(1+\gamma)/\gamma\times B<(1+\beta)/\beta\times G:$$

$$B'=0$$

$$W'=(1+\gamma)/\gamma\times B$$

$$R'=(1+\alpha)\times R-\alpha\times(1+\gamma)/\gamma\times B$$

$$G'=(1+\beta)\times G-\beta\times(1+\gamma)/\gamma\times B.$$

Hereunder, an algorithm for determining backlight intensities according to the present embodiment is described.

Figure 25:
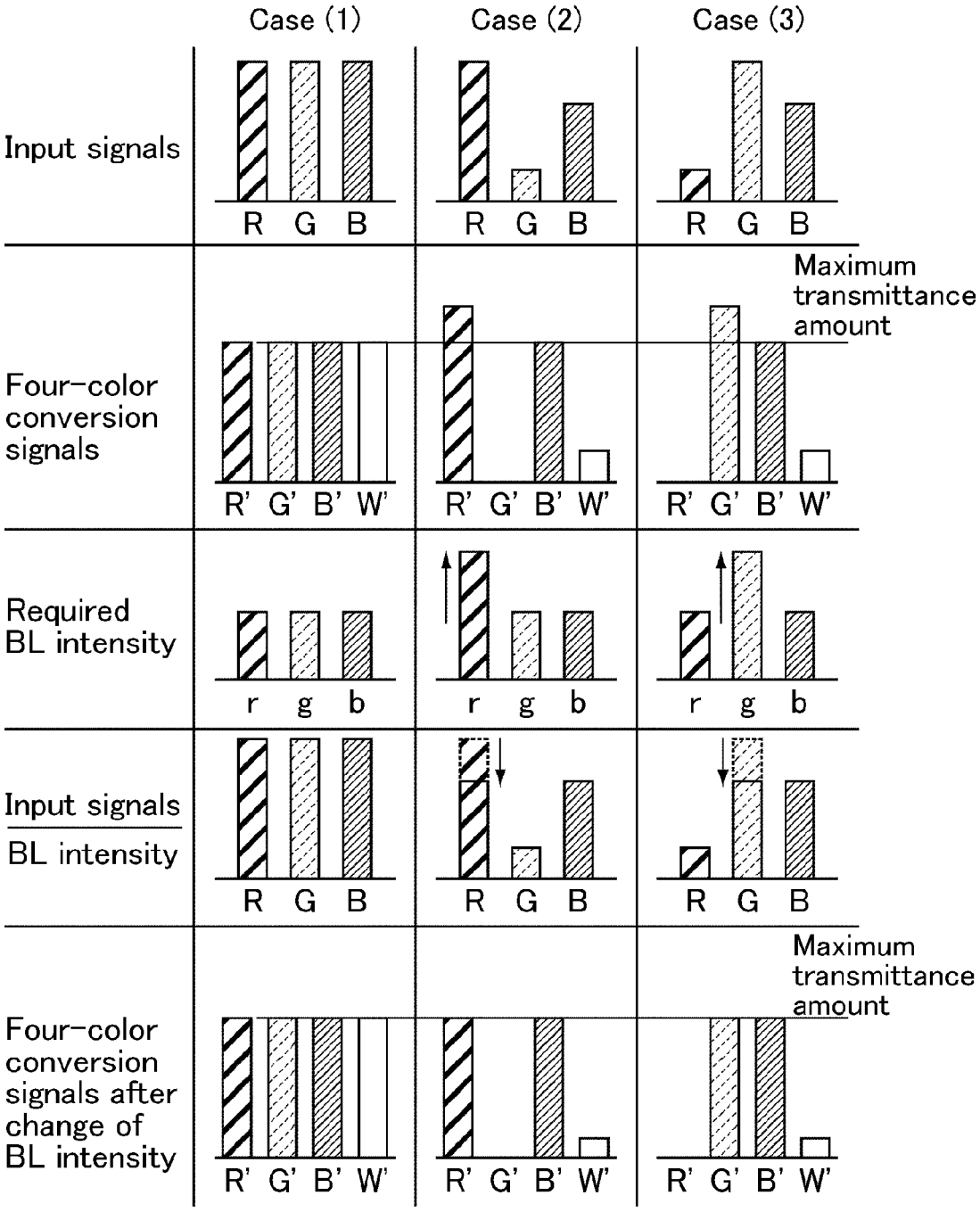
FIG. 25 is a view for explaining an algorithm for determining backlight intensities according to Embodiment 5.

FIG. 25 is a view for explaining an algorithm for determining backlight intensities according to Embodiment 5. The backlight intensities are denoted by reference characters r, g, and b.

The original input signals are converted to signals that have been divided by the backlight intensities before being input to the color conversion circuit. Therefore, the following relationships hold between the original input signals RGB and the signals R'G'B'W' obtained by converting the original input signals RGB into signals for four colors.

(1)

$$W'=MAX(R/r,G/g,B/b) \quad \text{(a)}$$

$$R'=(1+\alpha)\times R/r-\alpha MAX(R/r,G/g,B/b) \quad \text{(b)}$$

$$G'=(1+\beta)\times G/g-\beta\times MAX(R/r,G/g,B/b) \quad \text{(c)}$$

$$B'=(1+\gamma)\times B/b-\gamma\times MAX(R/r,G/g,B/b) \quad \text{(d)}$$

(2) When $R'<0$ in (1), and $G'\geq 0$ and $B'\geq 0$ can be realized by making $R'=0$:

$$W'=(1+\alpha)/\alpha\times R/r \quad \text{(e)}$$

$$R'=0$$

$$G'=(1+\beta)\times G/g-\beta\times(1+\alpha)/\alpha\times R/r \quad \text{(f)}$$

$$B'=(1+\gamma)\times B/b-\gamma\times(1+\alpha)/\alpha\times R/r \quad \text{(g)}$$

(3) When $G'<0$ in (1), and $R'\geq 0$ and $B'\geq 0$ can be realized by making $G'=0$:

$$W'=(1+\beta)/\beta\times G/g \quad \text{(h)}$$

$$R'=(1+\alpha)\times R/r-\alpha\times(1+\beta)/\beta\times G/g \quad \text{(i)}$$

$$G'=0$$

$$B'=(1+\gamma)\times B/b-\gamma\times(1+\beta)/\beta\times G/g \quad \text{(j)}$$

(4) When $B'<0$ in (1), and $G'\geq 0$ and $R'\geq 0$ can be realized by making $B'=0$:

$$W'=(1+\gamma)/\gamma\times B/b \quad \text{(k)}$$

$$R'=(1+\alpha)\times R/r-\alpha\times(1+\gamma)/\gamma\times B/b \quad \text{(l)}$$

$$G'=(1+\beta)\times G/g-\beta\times(1+\gamma)/\gamma\times B/b \quad \text{(m)}$$

$$B'=0$$

All of the values of R', G', B' and W' must be greater than or equal to 0 and less than or equal to 1. Since a restriction is applied so that a negative number can not be taken when converting from three colors to four colors, it is sufficient to set r, g, and b so as to satisfy the condition that all of R', G', B' and W' are less than or equal to 1.

First, based on (a), it is necessary that r≥R, g≥G, and b≥B. If this is satisfied, (b), (c) and (d) satisfy the condition.

Next, these relationships are considered in the same way as in Embodiment 4. In (2), regardless of what the values of the other input signals are, in order to determine a value of g so that the expression G'≤1 holds, it is sufficient to suppose a case where r=(1+α) that is the maximum value that can be taken by r is input, and by substituting r=(1+α) in (f) and determining that G'=1, the value of g at that time is:

$$g=\alpha\times(1+\beta)\times G/(\alpha+\beta\times R).$$

Similarly, based on (g), (i), (j), (l), and (m):

$$b=\alpha\times(1+\gamma)\times B/(\alpha+\gamma\times R)$$

$$r=\beta\times(1+\alpha)\times R/(\beta+\alpha\times G)$$

$$b=\beta\times(1+\gamma)\times B/(\beta+\gamma\times G)$$

$$r=\gamma\times(1+\alpha)\times R/(\gamma+\alpha\times B)$$

$$g=\gamma\times(1+\beta)\times G/(\gamma+\beta\times B).$$

Equation (e) is a case that satisfies R'<0 of equation (b) that is a condition used when entering a conditional branch of (2). Hence:

$$(1+\alpha)\times R/r-\alpha\times\mathrm{MAX}(R/r,G/g,B/b)<0$$

based on (a), since MAX(R/r, G/g, B/b)≤1, $$(1+\alpha)\times R/r<\alpha\times\mathrm{MAX}(R/r,G/g,B/b)\leq\alpha$$

$$(1+\alpha)/\alpha\times R/r<1.$$

Thus, a case that uses equation (e) always satisfies the condition. Likewise, (h) and (k) always satisfy the condition also.

Thus, the required backlight intensities rgb with respect to certain input signals RGB are:

r: maximum value among R, {β×(1+α)×R/(β+α×G)}, and {γ×(1+α)×R/(γ+α×B)} g: maximum value among G, {α×(1+β)×G/(α+β×R)}, and {γ×(1+β)×G/(γ+β×B)} b: maximum value among B, {α×(1+γ)×B/(α+γ×R)}, and {β×(1+γ)×B/(β+γ×G)}.

By determining the above values for each pixel and determining maximum values for each of r, g, and b with respect to all input signals, the required backlight intensities for the entire backlight unit are determined.

Thus, according to the present embodiment, required minimum backlight intensities rgb are determined for each pixel (see the third row from the top in FIG. 25). Subsequently, the input signals RGB are divided by the thus determined required backlight intensities rgb (see the fourth row from the top in FIG. 25). Next, the divided input signals RGB are converted to signals for four colors (see the fifth row from the top in FIG. 25). Accordingly, even in a case where an output gradation is greater than a maximum gradation when input signals are converted as they are into signals for four colors (see the second row from the top in FIG. 25), the values of R'G'B'W' are all numbers that are less than or equal to 1. Thus, the values of R', G', B', and W' become less than or equal to 1 by controlling the backlight intensities, and the values of R', G', B' and W' become equal to or greater than 0 by classifying according to different cases when converting from three colors to four colors.

In this connection, in FIG. 25, the required backlight intensities within a certain pixel are merely raised with respect to amounts that exceed a maximum transmittance amount. When this situation is described with respect to the case of (3), this is a change that assumes a case in which the required intensities of g and b at another pixel are 1. If the intensities of g and b can be lowered even when taking the affect on other pixels into account, the values of G and B obtained by dividing the input signal by the backlight intensity (input signal/BL intensity) will increase, while if it is necessary to further increase the intensities of g and b at another pixel, the values of G and B obtained by dividing the input signal by the backlight intensity (input signal/BL intensity) will decrease.

The liquid crystal display device of the present embodiment has the same block configuration as that of Embodiment 2 shown in FIG. 10.

Further, similar processing to that of Embodiment 2 as illustrated in FIG. 11 is performed in the backlight intensity determination circuit of the present embodiment. However, in S3, required backlight light amounts L(R), L(G), and L(B) are determined for the light sources of colors R, G, and B, respectively. Also, in S4, one maximum brightness $L_R$ of the R light sources is determined from among the backlight light amounts L(R) determined for the respective pixels, one maximum brightness $L_G$ of the G light sources is determined from among the backlight light amounts L(G) determined for the respective pixels, and one maximum brightness $L_B$ of the B light sources is determined from among the backlight light amounts L(B) determined for the respective pixels. Further, in S5, an image signal R1/$L_R$ is calculated by dividing the image signal R1 by the maximum brightness $L_R$ for each pixel, an image signal G1/$L_G$ is calculated by dividing the image signal G1 by the maximum brightness $L_G$ for each pixel, and an image signal B1/$L_B$ is calculated by dividing the image signal B1 by the maximum brightness $L_B$ for each pixel. Furthermore, in S6, the image signals R1/$L_R$, G1/$L_G$, B1/$L_B$ are subjected to gamma conversion and image signals R2, G2, B2 constituted by gradation data are output, and light amounts $L_R$, $L_G$, $L_B$ are also output as data for controlling the backlight.

The backlight intensity determination circuit of the present embodiment has a similar block configuration as that of Embodiment 4 that is illustrated in FIG. 23. However, as described in the above calculations, the required backlight light amount L(R) for each pixel is the maximum value among R, {β×(1+α)×R/(β+α×G)}, and {γ×(1+α)×R/(γ+α×B)}; the required backlight light amount L(G) for each pixel is the maximum value among G, {α×(1+β)×G/(α+β×R)}, and {γ×(1+β)×G/(γ+β×B)}; and the required backlight light amount L(B) for each pixel is the maximum value among B, {α×(1+γ)×B/(α+γ×R}, and {β×(1+γ)×B/(β+γ×G)}.

The same processing as that according to Embodiment 3 as illustrated in FIG. 19 is performed in the color conversion circuit of the present embodiment.

Further, the color conversion circuit of the present embodiment has the same block configuration as that of Embodiment 3 that is shown in FIG. 20. The processing performed by the color conversion circuit of the present embodiment is also the same as in Embodiment 3.

Thus, according to the present embodiment, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

EMBODIMENT 6

A liquid crystal display device of the present embodiment has the same configuration as Embodiment 4. More specifically, the liquid crystal display device of the present embodiment includes an RGB backlight unit that can independently change the light emission intensities of R, G and B.

Although the backlight light source may be three kinds of LEDs of the colors R, G, and B, any kind of light source may be used as long as the unit enables independent adjustment of the light emission intensities of R, G, and B, respectively.

Although a case is described here in which a yellow color filter (Y picture element) is added, the description will similarly apply if R is replaced with B when a cyan color filter (C picture element) is added, and if G is replaced with B when a magenta color filter (M picture element) is added.

Hereunder, a control method for the liquid crystal display device of the present embodiment is described.

When determining the backlight intensities according to Embodiment 4, a case in which the intensity of g is the maximum is assumed in order to determine the intensity of r, and a case in which the intensity of r is the maximum is assumed in order to determine the intensity of g. However, a case in which the intensity of r is the maximum is only a case where a pixel exists at which the R picture element has the maximum gradation and the G picture element has the minimum gradation, and this is an extremely limited condition. Similarly, a case in which the intensity of g is the maximum is only a case where a pixel exists at which the G picture element has the maximum gradation and the R picture element has the minimum gradation, and this is also an extremely limited condition. Consequently, the backlight intensities determined according to Embodiment 4 are normally higher intensities than the required minimum backlight intensities. According to the present embodiment, a method is proposed in which recalculation is performed using the value of a backlight intensity r1 determined according to Embodiment 4 to determine the backlight intensity of g, and recalculation is performed using the value of a backlight intensity g1 determined according to Embodiment 4 to determine the backlight intensity of r. As a result, the light emission intensities of the backlight can be set to smaller values than in Embodiment 4, and a further reduction in power consumption is enabled.

Figure 26:
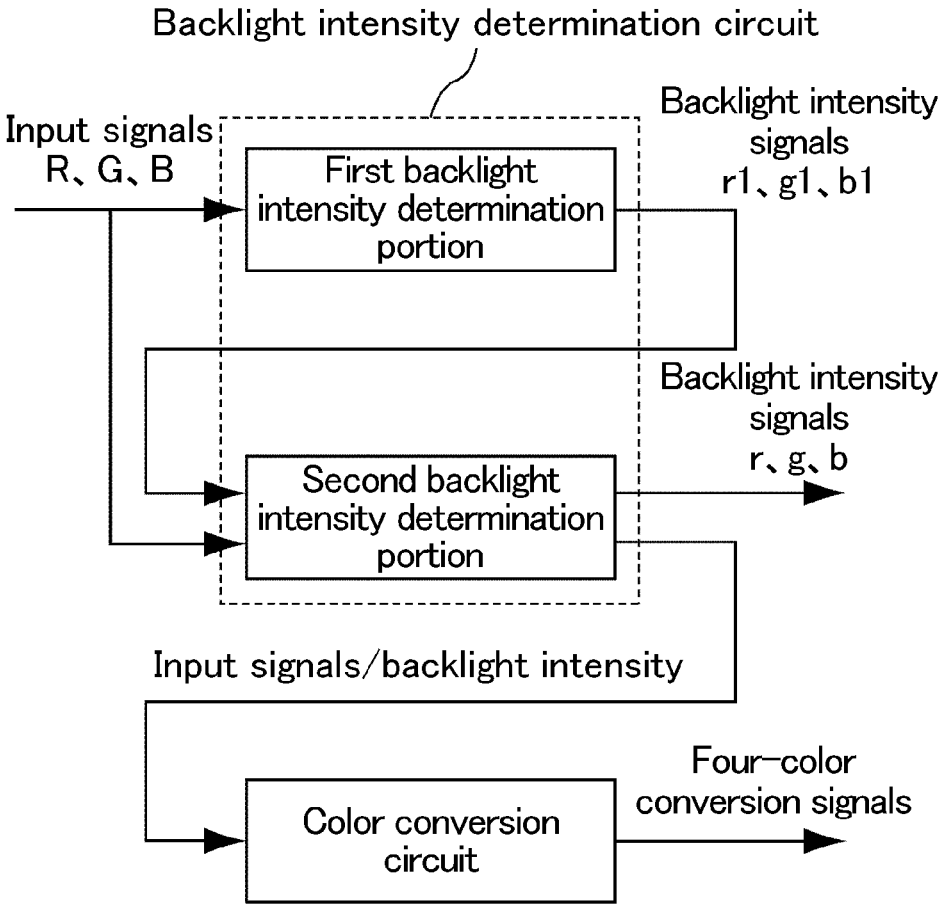
FIG. 26 is a block diagram that illustrates a circuit of a liquid crystal display device according to Embodiment 6.

A system block diagram for implementing the above described system is shown in FIG. 26.

First, in FIG. 26, input signals R, G, B are input to a first backlight intensity determination portion, and r1, g1, b1 are output. The r1, g1, b1 are the r, g, b determined in Embodiment 4, respectively. The input signals R, G, B and the r1, g1, b1 output from the first backlight intensity determination portion are input to a second backlight intensity determination portion. The second backlight intensity determination portion outputs backlight intensity signals r, g, b to a backlight driving circuit, and outputs signals obtained by dividing the input signals R, G, B by r, g, b, respectively, to a color conversion circuit. The signals input to the color conversion circuit are converted to R'G'B'Y' signals and output therefrom.

An algorithm for converting the RGB signals that are input to the color conversion circuit to R'G'B'Y' signals is the same as in Embodiments 2 and 4.

Hereunder, algorithms for determining backlight intensities according to the present embodiment are described.

First, an algorithm of the first backlight intensity determination portion is described.

Figure 27:
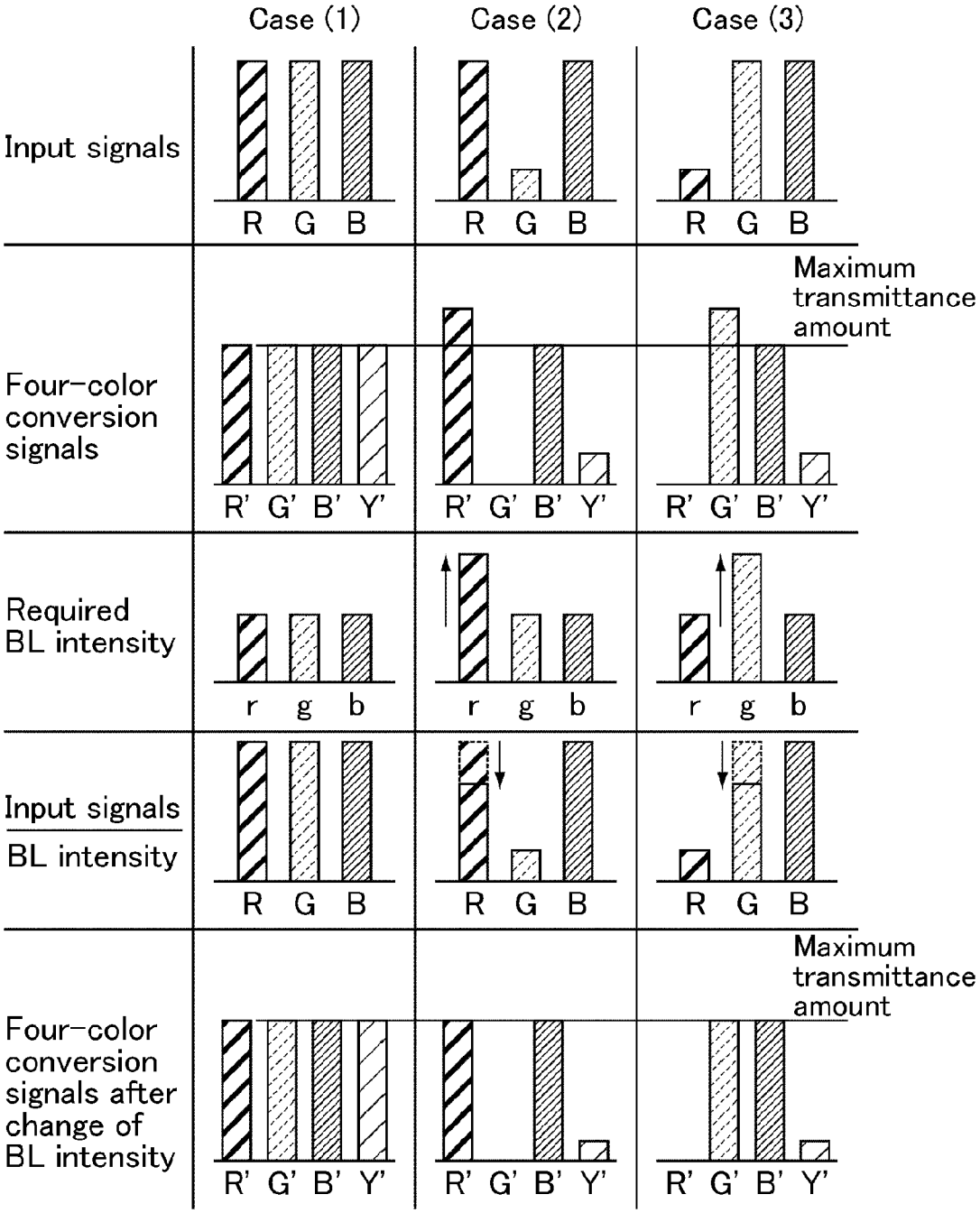
FIG. 27 is a view for explaining an algorithm for determining backlight intensities according to Embodiment 6.

FIG. 27 is a view for describing an algorithm for determining backlight intensities according to Embodiment 6. Backlight intensities are denoted by reference characters r, g, and b.

The original input signals are converted to signals that have been divided by a backlight intensity before being input to the color conversion circuit. Therefore, the following relationships hold between the original input signals RGB and the signals R'G'B'Y' obtained by converting the original input signals RGB into signals for four colors.

$$\text{Always, } B'=B/b \tag{a}$$

(1) When $G/g<(1+\alpha)/\alpha\times R/r$ and $R/r<(1+\beta)/\beta\times G/g$:

$$R'=(1+\alpha)\times R/r-\alpha\times \mathrm{MAX}(R/r,G/g) \tag{b}$$

$$G'=(1+\beta)\times G/g-\beta\times \mathrm{MAX}(R/r,G/g) \tag{c}$$

$$Y'=\mathrm{MAX}(R/r,G/g) \tag{d}$$

(2) When $G/g>(1+\alpha)/\alpha\times R/r$:

$$R'=0$$

$$G'=(1+\beta)\times G/g-\{\beta\times(1+\alpha)/\alpha\}\times R/r \tag{e}$$

$$Y'=(1+\alpha)/\alpha\times R/r \tag{f}$$

(3) When $R/r>(1+\beta)/\beta\times G/g$:

$$R'=(1+\alpha)\times R/r-\{\alpha\times(1+\beta)/\beta\}\times G/g \tag{g}$$

$$G'=0$$

$$Y'=(1+\beta)/\beta\times G/g \tag{h}$$

All of the values of R', G', B' and Y' must be greater than or equal to 0 and less than or equal to 1. Since a restriction is applied so that a negative number can not be taken when converting from three colors to four colors, it is sufficient to set r, g, and b so as to satisfy the condition that all of R', G', B' and Y' are less than or equal to 1.

First, based on (a) and (d), it is necessary that $r\geq R$, $g\geq G$, and $b\geq B$. If this is satisfied, (b) and (c) satisfy the condition.

Next, the required values of r and g are considered for cases (2) and (3). Based on (e), the larger that the value of r is, the more that the value of G' increases, and therefore the required value of g increases. Likewise, based on (g), the larger that the value of g is, the larger the required value of r becomes. Consequently, if the required values of r and g are considered even with respect to within only one pixel, there is a possibility that an insufficiency will arise. Therefore, a value of g that is required for the relevant pixel is determined by assuming the maximum value that can be taken for r in (e), and a value of r that is required for the relevant pixel is determined by assuming the maximum value that can be taken for g in (g). Since the maximum value that can be taken for g is:

$$G'=(1+\beta)\times G/g-\{\beta\times(1+\alpha)/\alpha\}\times R/r\leq(1\beta)/g\leq 1,$$

when R=0 and G=1 the maximum value that can be taken for g is $1+\beta$. Similarly, using (g), the maximum value that can be taken for r is $1+\alpha$.

When $r=1+\alpha$ is substituted into (e), and the value of g required by the relevant pixel is determined, based on $G'=(1+\beta)\times G/g-\{\beta\times(1+\alpha)/\alpha\}\times R/(1+\alpha)\leq 1$, the determined value is $$g=\alpha\times(1+\beta)\times G/(\alpha+\beta\times R) \quad \text{(i)}$$

Similarly, when $g=1+\beta$ is substituted into (g), the determined value is $$r=\beta\times(1+\alpha)\times R/(\beta+\alpha\times G) \quad \text{(j)}$$

Accordingly, when input signals of a certain pixel are R, G and B, the minimum required backlight intensities for the pixel in question are:

r: largest value among R and $\beta\times(1+\alpha)\times R/(\beta+\alpha\times G)$, g: largest value among G and $\alpha\times(1+\beta)\times G/(\alpha+\beta\times R)$, b: B.

By determining the above values for each pixel and determining maximum values for each of r, g, and b with respect to all input signals, the required backlight intensities for the entire backlight unit are determined. The backlight intensities determined here are output as r1, g1, and b1.

Next an algorithm of the second backlight intensity determination portion is described.

Although the present algorithm is almost the same as the algorithm of the first backlight determination portion, while $r=1+\alpha$ is taken as the maximum intensity of r when determining (i) at the first backlight intensity determination portion, this value is changed to the output value r1 of the first backlight intensity determination portion in the second backlight intensity determination portion. Similarly, while $g=1+\beta$ is taken as the maximum intensity of g when determining (j), this value is changed to the output value g1 of the first backlight intensity determination portion. Hence, the value g in (i) and the value r in (j) are respectively changed in the following manner:

$$g=\{\alpha\times(1+\beta)\times r1\}/\{(\alpha\times r1+\beta\times(1+\alpha)R)\}\times G$$

$$r=\{\beta\times(1+\alpha)\times g1\}/\{(\beta\times g1+\alpha\times(1+\beta)G)\}\times R.$$

Accordingly, when input signals of a certain pixel are R, G and B, the minimum required backlight intensities for the pixel in question are:

r: largest value among R and $$\{\beta\times(1+\alpha)\times g1\}/\{(\beta\times g1+\alpha\times(1+\beta)G)\}\times R$$

g: largest value among G and $$\{\alpha\times(1+\beta)\times r1\}/\{(\alpha\times r1+\beta\times(1+\alpha)R)\}\times G$$

b: B.

By determining the above values for each pixel and determining maximum values for each of r, g, and b with respect to all input signals, the required backlight intensities for the entire backlight unit are determined.

Thus, required minimum backlight intensities r, g and b are determined for each pixel (see third row from the top in FIG. 27). Subsequently, the input signals RGB are divided by the required backlight intensities r, g and b that are determined here (see fourth row from the top in FIG. 27). Next, the divided input signals RGB are converted to signals for four colors (see fifth row from the top in FIG. 27). Accordingly, even in a case where the output gradation is greater than the maximum gradation when input signals are converted as they are into signals for four colors (see second row from the top in FIG. 27), the values of R'G'B'Y' all become numbers that are equal to or greater than 0 and less than or equal to 1.

The liquid crystal display device of the present embodiment has the same block configuration as that of Embodiment 2 shown in FIG. 10.

Further, similar processing as that of Embodiment 2 that is illustrated in FIG. 11 is performed in the backlight intensity determination circuit of the present embodiment. However, in S3, required backlight light amounts L(R), L(G), and L(B) are determined for the light sources of the colors R, G, and B, respectively. Also, in S4, one maximum brightness $L_R$ of the R light sources is determined from among the backlight light amounts L(R) determined for the respective pixels, one maximum brightness $L_G$ of the G light sources is determined from among the backlight light amounts L(G) determined for the respective pixels, and one maximum brightness $L_B$ of the B light sources is determined from among the backlight light amounts L(B) determined for the respective pixels. Further, in S5, an image signal R1/$L_R$ is calculated by dividing the image signal R1 by the maximum brightness $L_R$ for each pixel, an image signal G1/$L_G$ is calculated by dividing the image signal G1 by the maximum brightness $L_G$ for each pixel, and an image signal B1/$L_B$ is calculated by dividing the image signal B1 by the maximum brightness $L_B$ for each pixel. Furthermore, in S6, the image signals R1/$L_R$, G1/$L_G$, B1/$L_B$ are subjected to gamma conversion and image signals R2, G2, B2 constituted by gradation data are output, and light amounts $L_R$, $L_G$, $L_B$ are also output as data for controlling the backlight. Further, the processing in step S3 is performed a plurality of times. More specifically, the required backlight light amounts L(R), L(G), L(B) are recalculated using the maximum brightnesses obtained in S4.

Figure 28:
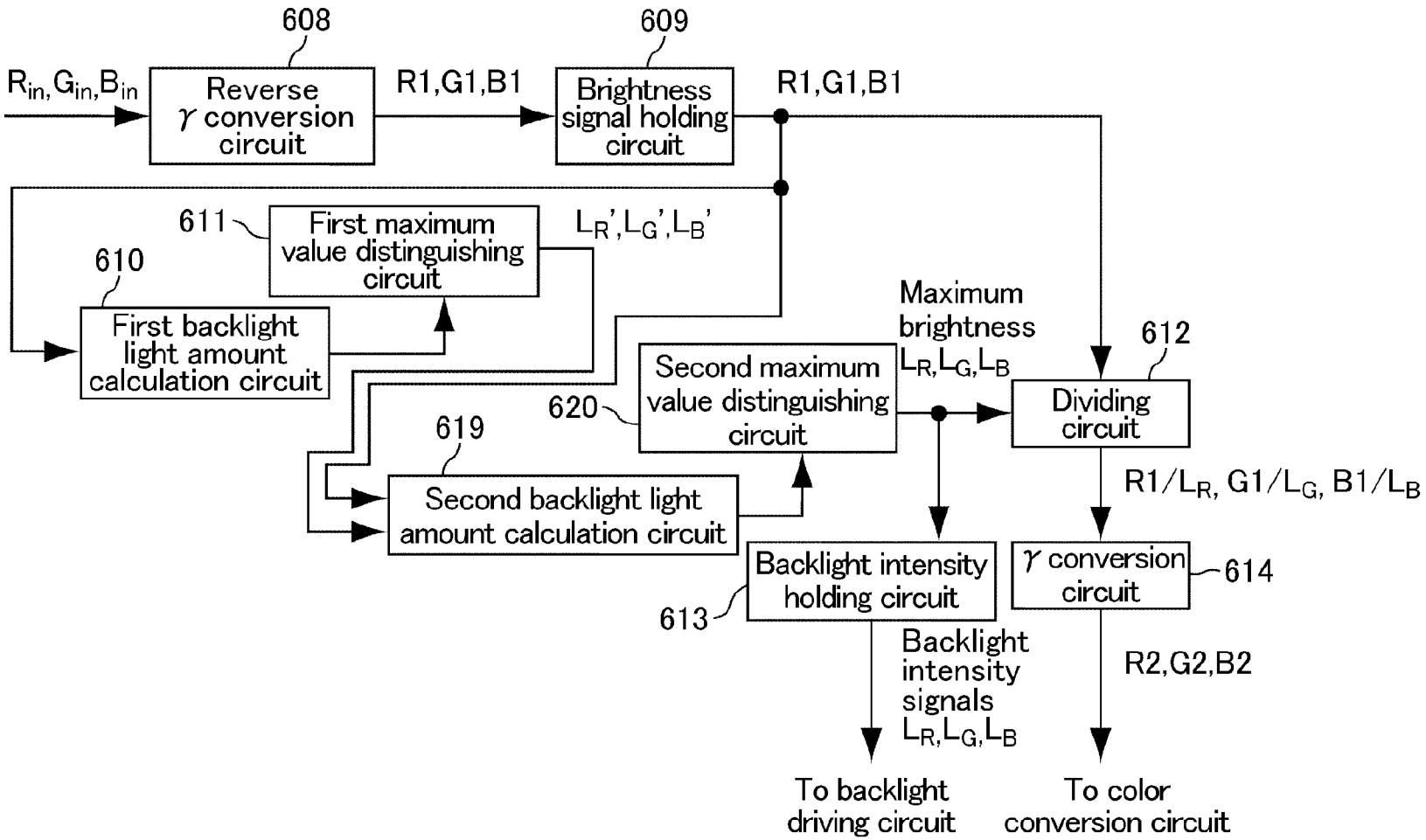
FIG. 28 shows a block diagram of a backlight intensity determination circuit according to Embodiment 6.

FIG. 28 is a view that illustrates a block diagram of the backlight intensity determination circuit according to Embodiment 6.

As shown in FIG. 28, the backlight intensity determination circuit of Embodiment 6 includes a reverse gamma conversion circuit 608, a brightness signal holding circuit 609, backlight light amount calculation circuits 610 and 619, maximum value distinguishing circuits 611 and 620, a dividing circuit 612, a backlight intensity holding circuit 613, and a gamma conversion circuit 614.

The reverse gamma conversion circuit 608 subjects image signals Rin, Gin, Bin to reverse gamma conversion to generate image signals R1, G1, B1 constituted by brightness data. The image signals R1, G1, B1 are output to the brightness signal holding circuit 609, and stored for a fixed period (for example, a period of one frame).

The backlight light amount calculation circuit 610 calculates required backlight light amounts L(R), L(G), L(B) for each pixel based on the image signals R1, G1, B1 output from the brightness signal holding circuit 609 as described above. As described in the above calculations, the backlight light amount L(R) is the largest value among R and $\beta\times(1+\alpha)\times R/(\beta+\alpha\times G)$, the backlight light amount L(G) is the largest value among G and $\alpha\times(1+\beta)\times G/(\alpha+\beta\times R)$, and the backlight light amount L(B) is B.

The maximum value distinguishing circuit 611 determines one maximum brightness $L_R'$ (assumed maximum brightness value) among the backlight light amounts L(R) for each pixel that are output from the backlight light amount calculation circuit 610, determines one maximum brightness $L_G'$ (assumed maximum brightness value) among the backlight light amounts L(G) for each pixel that are output from the backlight light amount calculation circuit 610, and determines one maximum brightness $L_B'$ (assumed maximum brightness value) among the backlight light amounts L(B) for each pixel that are output from the backlight light amount calculation circuit 610.

The backlight light amount calculation circuit 619 calculates required backlight light amounts L2(R), L2(G), L2(B) for each pixel based on the image signals R1, G1, B1 output from the brightness signal holding circuit 609 and brightnesses $L_R'$, $L_G'$, $L_B'$ output from the maximum value distinguishing circuit 611 as described above. As described in the above calculations, the backlight light amount L2(R) is the largest value among R and $\{\beta\times(1+\alpha)\times g1\}/\{(\beta\times g1+\alpha\times(1+\beta)G)\}\times R$, the backlight light amount L2(G) is the largest value among G and $\{\alpha\times(1+\beta)\times r1\}/\{(\alpha\times r1+\beta\times(1+\alpha)R)\}\times G$, and the backlight light amount L2(B) is B.

The maximum value distinguishing circuit 620 determines one maximum brightness $L_R$ among the backlight light amounts L2(R) for each pixel that are output from the backlight light amount calculation circuit 619, determines one maximum brightness $L_G$ among the backlight light amounts L2(G) for each pixel that are output from the backlight light amount calculation circuit 619, and determines one maximum brightness $L_B$ among the backlight light amounts L2(B) for each pixel that are output from the backlight light amount calculation circuit 619.

The backlight intensity holding circuit 613 stores the maximum brightnesses $L_R$, $L_G$, $L_B$ output from the maximum value distinguishing circuit 620 for a fixed period (for example, a period of one frame), and also outputs the maximum brightnesses $L_R$, $L_G$, $L_B$ to the backlight driving circuit.

The dividing circuit 612 divides the image signals R1, G1, B1 output from the brightness signal holding circuit 609 by the maximum brightnesses $L_R$, $L_G$, $L_B$ for each pixel to calculate image signals R1/$L_R$, G1/$L_G$, B1/$L_B$.

The gamma conversion circuit 614 subjects the image signals R1/$L_R$, G1/$L_G$, B1/$L_B$ output from the dividing circuit 612 to gamma conversion to generate image signals R2, G2, B2 constituted by gradation data, and outputs the generated image signals R2, G2, B2 to the color conversion circuit.

The color conversion circuit of the present embodiment performs the same processing as in Embodiment 2 that is shown in FIG. 13.

Further, the color conversion circuit of the present embodiment has the same block configuration as in Embodiment 2 that is shown in FIG. 14. The processing performed by the color conversion circuit of the present embodiment is also the same as in Embodiment 2.

Thus, according to the present embodiment, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

Moreover, since recalculation of the backlight intensities is performed based on backlight intensities that have been calculated once, a further reduction in power consumption is enabled.

Note that the number of times of calculating the backlight intensities is not particularly limited to two times, and may be three times or more.

Further, the number of maximum value distinguishing circuits need not necessarily be the same as the number of backlight light amount calculation circuits, and may be less than the number of backlight light amount calculation circuits, and for example, one maximum value distinguishing circuit may be provided. More specifically, for example, a configuration may be adopted in which the maximum value distinguishing circuit 620 is not provided, and in which the maximum brightnesses $L_R$, $L_G$, $L_B$ are determined by the maximum value distinguishing circuit 611.

EMBODIMENT 7

A liquid crystal display device of the present embodiment has the same configuration as Embodiment 5. More specifically, the present embodiment includes an RGB backlight unit that can independently change the light emission intensities of R, G and B.

According to the present embodiment, it is assumed that an added color filter is a white color filter.

Hereunder, a control method for the liquid crystal display device of the present embodiment is described.

When determining backlight intensities according to Embodiment 5, a case in which the intensity of g is the maximum intensity or a case in which the intensity of b is the maximum intensity is assumed when determining the intensity of r, a case in which the intensity of r is the maximum intensity or a case in which the intensity of b is the maximum intensity is assumed when determining the intensity of g, and a case in which the intensity of r is the maximum intensity or a case in which the intensity of g is the maximum intensity is assumed when determining the intensity of b. However, a case where the intensity of r is the maximum intensity is only a case where a pixel exists at which the R picture element has the maximum gradation and the G or B picture element has the minimum gradation, and this is an extremely limited condition. Likewise, a case where the intensity of g is the maximum intensity is only a case where a pixel exists at which the G picture element has the maximum gradation and the R or B picture element has the minimum gradation, and a case where the intensity of b is the maximum intensity is only a case where a pixel exists at which the B picture element has the maximum gradation and the R or G picture element has the minimum gradation, and these are also extremely limited conditions. Consequently, backlight intensities determined according to Embodiment 5 are normally higher intensities than the required minimum backlight intensities. According to the present embodiment, a method is proposed in which the values of backlight intensities r1, b1 determined in Embodiment 5 are used for recalculation to determine the backlight intensity of g, the values of backlight intensities g1, b1 determined in Embodiment 5 are used for recalculation to determine the backlight intensity of r, and the values of backlight intensities g1, r1 determined in Embodiment 5 are used for recalculation to determine the backlight intensity of b. As a result, the light emission intensities of the backlight can be set to lower values that in Embodiment 5, and hence a further reduction is power consumption is enabled.

Figure 29:
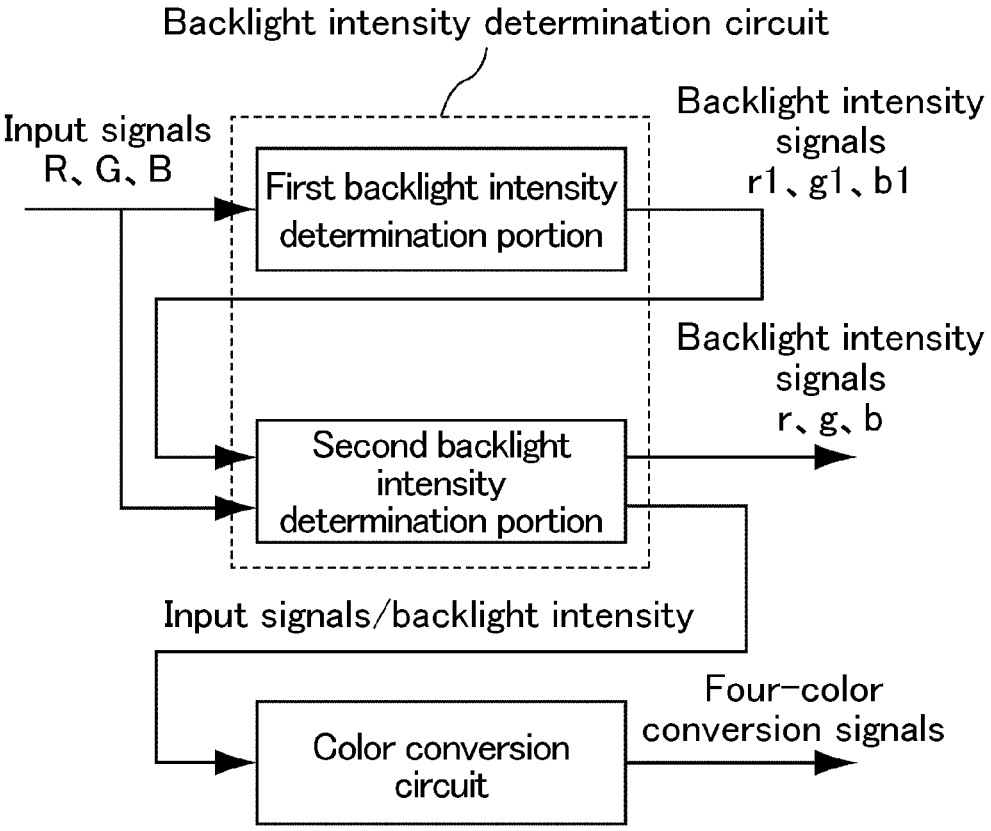
FIG. 29 is a block diagram that illustrates a circuit of a liquid crystal display device according to Embodiment 7.

A system block diagram for implementing the above described system is illustrated in FIG. 29.

First, in FIG. 29, input signals R, G, B are input to the first backlight intensity determination portion, and r1, g1, b1 are output. The r1, g1, b1 are the r, g, b determined in Embodiment 5, respectively. The input signals R, G, B and the r1, g1, b1 output from the first backlight intensity determination portion are input to the second backlight intensity determination portion. The second backlight intensity determination portion outputs backlight intensity signals r, g, b to the backlight driving circuit, and outputs signals obtained by dividing the input signals R, G, B by r, g, b, respectively, to the color conversion circuit. The signals input to the color conversion circuit are converted to R'G'B'W' signals and output therefrom.

An algorithm for converting the RGB signals that are input to the color conversion circuit to R'G'B'W' signals is shown below. This algorithm is the same as in Embodiments 3 and 5.

That is, a conversion from RGB to R'G'B'W' is one of the following:

(1) When $R>\alpha/(1+\alpha)\times MAX(R, G, B)$, $$G>\beta/(1+\beta)\times MAX(R,G,B), \text{ and}$$

$$B>\gamma/(1+\gamma)\times MAX(R,G,B):$$

$$W'=MAX(R,G,B)$$

$$R'=(1+\alpha)\times R-\alpha\times MAX(R,G,B)$$

$$G'=(1+\beta)\times G-\beta\times MAX(R,G,B)$$

$$B'=(1+\gamma)\times B-\gamma\times MAX(R,G,B)$$

(2) When $R<\alpha/(1+\alpha)\times MAX(R, G, B)$, $$(1+\beta)/\beta\times G>(1+\alpha)/\alpha\times R, \text{ and}$$

$$(1+\alpha)/\alpha\times R<(1+\gamma)/\gamma\times B:$$

$$W'=(1+\alpha)/\alpha\times R$$

$$R'=0$$

$$G'=(1+\beta)\times G-\beta\times(1+\alpha)/\alpha\times R$$

$$B'=(1+\gamma)\times B-\gamma\times(1+\alpha)/\alpha\times R$$

(3) When $G<\beta/(1+\beta)\times MAX(R, G, B)$, $$(1+\beta)/\beta\times G<(1+\alpha)/\alpha\times R, \text{ and}$$

$$(1+\gamma)/\gamma\times B>(1+\beta)/\beta\times G:$$

$$W'=(1+\beta)/\beta\times G$$

$$R'=(1+\alpha)\times R-\alpha\times(1+\beta)/\beta\times G$$

$$G'=0$$

$$B'=(1+\gamma)\times B-\gamma\times(1+\beta)/\beta\times G$$

(4) When $B<\gamma/(1+\gamma)\times MAX(R, G, B)$, $$(1+\alpha)/\alpha\times R>(1+\gamma)/\gamma\times B, \text{ and}$$

$$(1+\gamma)/\gamma\times B<(1+\beta)/\beta\times G:$$

$$B'=0$$

$$W'=(1+\gamma)/\gamma\times B$$

$$R'=(1+\alpha)\times R-\alpha\times(1+\gamma)/\gamma\times B$$

$$G'=(1+\beta)\times G-\beta\times(1+\gamma)/\gamma\times B.$$

Hereunder, an algorithm for determining backlight intensities according to the present embodiment is described.

First, a determination algorithm of the first backlight intensity determination portion is described. Backlight intensities are denoted by reference characters r, g, and b.

The original input signals are converted to signals that have been divided by a backlight intensity before being input to the color conversion circuit. Therefore, the following relationships hold between the original input signals RGB and the signals R'G'B'Y' obtained by converting the original input signals RGB into signals for four colors.

(1)

$$W'=MAX(R/r,G/g,B/b) \quad (a)$$

$$R'=(1+\alpha)\times R/r-\alpha\times MAX(R/r,G/g,B/b) \quad (b)$$

$$G'=(1+\beta)\times G/g-\beta\times MAX(R/r,G/g,B/b) \quad (c)$$

$$B'=(1+\gamma)\times B/b-\gamma\times MAX(R/r,G/g,B/b) \quad (d)$$

(2) When $R'<0$ in (1), and $G'\geq 0$ and $B'\geq 0$ can be realized by making $R'=0$:

$$W'=(1+\alpha)/\alpha\times R/r \quad (e)$$

$$R'=0$$

$$G'=(1+\beta)\times G/g-\beta\times(1+\alpha)/\alpha\times R/r \quad (f)$$

$$B'=(1+\gamma)\times B/b-\gamma\times(1+\alpha)/\alpha\times R/r \quad (g)$$

(3) When $G'<0$ in (1), and $R'\geq 0$ and $B'\geq 0$ can be realized by making $G'=0$:

$$W'=(1+\beta)/\beta\times G/g \quad (h)$$

$$R'=(1+\alpha)\times R/r-\alpha\times(1+\beta)/\beta\times G/g \quad (i)$$

$$G'=0$$

$$B'=(1+\gamma)\times B/b-\gamma\times(1+\beta)/\beta\times G/g \quad (j)$$

(4) When $B'<0$ in (1), and $G'\geq 0$ and $R'\geq 0$ can be realized by making $B'=0$:

$$W'=(1+\gamma)/\gamma\times B/b \quad (k)$$

$$R'=(1+\alpha)\times R/r-\alpha\times(1+\gamma)/\gamma\times B/b \quad (l)$$

$$G'=(1+\beta)\times G/g-\beta\times(1+\gamma)/\gamma\times B/b \quad (m)$$

$$B'=0$$

All of the values of R', G', B' and W' must be greater than or equal to 0 and less than or equal to 1. Since a restriction is applied so that a negative number can not be taken when converting from three colors to four colors, and therefore it is sufficient to set r, g, and b so as to satisfy the condition that all of R', G', B' and W' are less than or equal to 1.

First, based on (a), it is necessary that $r\geq R$, $g\geq G$, and $b\geq B$. If this is satisfied, (b), (c) and (d) satisfy the condition.

Next, these relationships are considered in the same way as in Embodiment 4. In (2), regardless of what the values of the other input signals are, in order to determine a value of g so that the expression $G'\leq 1$ holds, it is sufficient to suppose a case where $r=(1+\alpha)$ that is the maximum value that can be taken by r is input, and by substituting $r=(1+\alpha)$ in (f) and determining that $G'=1$, the value of g at that time is:

$$g=\alpha\times(1+\beta)\times G/(\alpha+\beta\times R).$$

Similarly, based on (g), (i), (j), (l), and (m):

$$b=\alpha\times(1+\gamma)\times B/(\alpha+\gamma\times R)$$

$$r=\beta\times(1+\alpha)\times R/(\beta+\alpha\times G)$$

$$b=\beta\times(1+\gamma)\times B/(\beta+\gamma\times G)$$

$$r=\gamma\times(1+\alpha)\times R/(\gamma+\alpha\times B)$$

$$g=\gamma\times(1+\beta)\times G/(\gamma+\beta\times B).$$

Equation (e) is a case that satisfies $R'<0$ of equation (b) that is a condition used when entering a conditional branch of (2). Hence:

$$(1+\alpha)\times R/r-\alpha\times MAX(R/r,G/g,B/b)<0$$

based on (a), since MAX(R/r, G/g, B/b)≤1, $$(1+\alpha)\times R/r<\alpha\times \mathrm{MAX}(R/r,G/g,B/b)\leq\alpha$$

$$(1+\alpha)/\alpha\times R/r<1$$

Thus, a case that uses equation (e) always satisfies the condition. Likewise, (h) and (k) always satisfy the condition also.

Therefore, required backlight intensities rgb with respect to certain input signals RGB are:

r: maximum value among R, {β×(1+α)×R/(β+α×G)}, and {γ×(1+α)×R/(γ+α×B)} g: maximum value among G, {γ×(1+β)×G/(γ+β×B)}, and {α×(1+β)×G/(α+β×R)} b: maximum value among B, {α×(1+γ)×B/(α+γ×R)}, and {β×(1+γ)×B/(β+γ×G)}.

By determining the above values for each pixel and determining maximum values for each of r, g, and b with respect to all input signals, the required backlight intensities for the entire backlight unit are determined. The backlight intensities determined here are output as r1, g1, b1.

Next, an algorithm of the second backlight intensity determination portion is described.

Similarly to Embodiment 6, at the second backlight intensity determination portion, the maximum values of r, g, b that are used when determining a maximum value condition are recalculated as r=r1, g=g1, b=b1. As a result, required backlight intensities rgb with respect to certain input signals RGB are:

r: maximum value among R, {β×(1+α)×g1}/{(β×g1+α×(1+β)G)}×R, and {γ×(1+α)×b1}/{(γ×b1+α×(1+γ)B)}×R g: maximum value among G, {γ×(1+β)×b1}/{(γ×b1+β×(1+γ)B)}×G, and {α×(1+β)×r1}/{(α×r1+β×(1+α)R)}×G b: maximum value among B, {α×(1+γ)×r1}/{(α×r1+γ×(1+α)R)}×B, and {β×(1+γ)×g1}/{(β×g1+γ×(1+β)G)}×B By determining the above values for each pixel and determining maximum values for each of r, g, and b with respect to all input signals, the required backlight intensities for the entire backlight unit are determined.

The required minimum backlight intensities rgb are determined for each pixel in this manner. Subsequently, the input signals RGB are divided by the required backlight intensities rgb that are determined here. Next, conversion to signals for four colors is performed with respect to the divided input signals RGB. Accordingly, even in a case where the output gradation is greater than the maximum gradation when input signals are converted as they are into signals for four colors, the values of R'G'B'W' are all numbers that are less than or equal to 1. Thus, the values of R', G', B', and W' become less than or equal to 1 by controlling the backlight intensities, and the values of R', G', B' and W' become equal to or greater than 0 by classifying according to different cases when converting from three colors to four colors.

The liquid crystal display device of the present embodiment has the same block configuration as that of Embodiment 2 shown in FIG. 10.

Further, similar processing to that of Embodiment 2 that is illustrated in FIG. 11 is performed in the backlight intensity determination circuit of the present embodiment. However, in S3, required backlight light amounts L(R), L(G), and L(B) are determined for the light sources of colors R, G, and B, respectively. Also, in S4, one maximum brightness $L_R$ of the R light sources is determined from among the backlight light amounts L(R) determined for the respective pixels, one maximum brightness $L_G$ of the G light sources is determined from among the backlight light amounts L(G) determined for the respective pixels, and one maximum brightness $L_B$ of the B light sources is determined from among the backlight light amounts L(B) determined for the respective pixels. Further, in S5, an image signal R1/$L_R$ is calculated by dividing the image signal R1 by the maximum brightness $L_R$ for each pixel, an image signal G1/$L_G$ is calculated by dividing the image signal G1 by the maximum brightness $L_G$ for each pixel, and an image signal B1/$L_B$ is calculated by dividing the image signal B1 by the maximum brightness $L_B$ for each pixel. Furthermore, in S6, the image signals R1/$L_R$, G1/$L_G$, B1/$L_B$ are subjected to gamma conversion and image signals R2, G2, B2 constituted by gradation data are output, and light amounts $L_R$, $L_G$, $L_B$ are also output as data for controlling the backlight. Further, the processing in step S3 is performed a plurality of times. More specifically, the required backlight light amounts L(R), L(G), L(B) are recalculated using the maximum brightnesses obtained in S4.

The backlight intensity determination circuit of the present embodiment has a similar block configuration as that of Embodiment 6 that is illustrated in FIG. 28. However, as described in the above calculations, the required backlight light amount L(R) for each pixel is the maximum value among R, {β×(1+α)×R/(β+α×G)}, and {γ×(1+α)×R/(γ+α×B)}; the required backlight light amount L(G) for each pixel is the maximum value among G, {γ×(1+β)×G/(γ+β×B)}, and {α×(1+β)×G/(α+β×R)}; and the required backlight light amount L(B) for each pixel is the maximum value among B, {α×(1+γ)×B/(α+γ×R)}, and {β×(1+γ)×B/(β+γ×G)}.

Further, the required backlight light amount L2(R) for each pixel is the maximum value among R, {β×(1+α)×g1}/{(β×g1+α×(1+β)G)}×R, and {γ×(1+α)×b1}/{(γ×b1+α×(1+γ)B)}×R; the required backlight light amount L2(G) for each pixel is the maximum value among G, {γ×(1+β)×b1}/{(γ×b1+β×(1+γ)B)}×G, and {α×(1+β)×r1}/{(α×r1+β×(1+α)R)}×G; and the required backlight light amount L2(B) for each pixel is the maximum value among B, {α×(1+γ)×r1}/{(α×r1+γ×(1+α)R)}×B, and {β×(1+γ)×g1}/{(β×g1+γ×(1+β)G)}×B.

The same processing as that according to Embodiment 3 that is illustrated in FIG. 19 is performed in the color conversion circuit of the present embodiment.

Further, the color conversion circuit of the present embodiment has the same block configuration as that of Embodiment 3 that is shown in FIG. 20. The processing performed by the color conversion circuit of the present embodiment is also the same as in Embodiment 3.

Thus, according to the present embodiment, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

Moreover, since recalculation of the backlight intensities is performed based on backlight intensities that have been calculated once, a further reduction in power consumption is enabled.

Note that the number of times of calculating the backlight intensities is not particularly limited to two times, and may be three times or more.

Further, the number of maximum value distinguishing circuits need not necessarily be the same as the number of backlight light amount calculation circuits, and may be less than the number of backlight light amount calculation circuits, and for example, one maximum value distinguishing circuit may be provided.

EMBODIMENT 8

Figure 30:
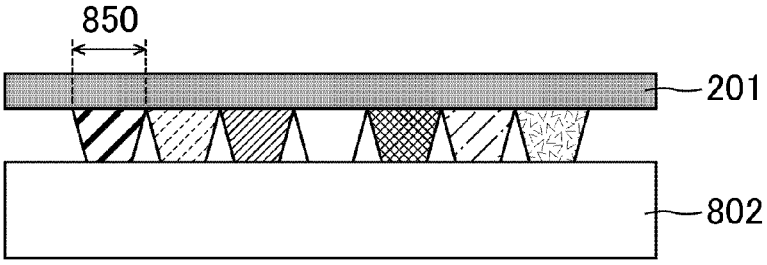
FIG. 30 is a cross-sectional schematic diagram showing a configuration of a liquid crystal display device according to Embodiment 8.

FIG. 30 is a cross-sectional schematic diagram showing a configuration of a liquid crystal display device according to Embodiment 8.

The liquid crystal display device according to the present embodiment has a similar configuration to Embodiments 2 to 7 except that, instead of a backlight unit in which light emission intensities are controlled uniformly over the entire light emitting surface, liquid crystal display device according to the present embodiment includes a backlight unit (area-active backlight unit, backlight 802) that can change a light emission intensity for each specific light emitting region.

Figure 31:
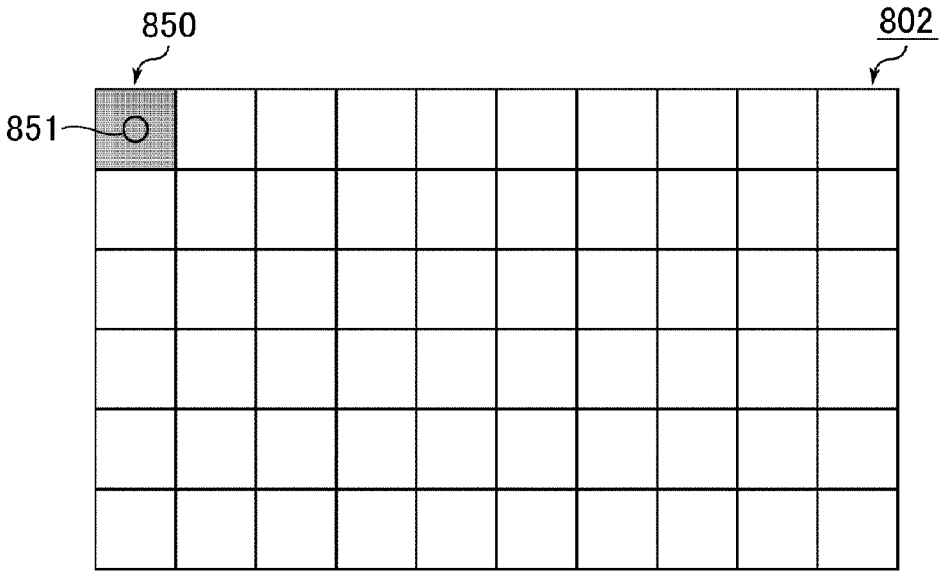
FIG. 31 is a planar schematic view that shows a configuration of a backlight according to Embodiment 8.

FIG. 31 is a planar schematic view that shows a configuration of the backlight according to Embodiment 8.

As shown in FIG. 31, the light emitting surface of the backlight 802 is split into a plurality of light emitting regions 850. In FIG. 31, a case is illustrated where, as an example, the light emitting surface is split into six areas in the vertical direction and ten areas in the lateral direction. The respective light emitting regions 850 are provided with lighting portions 851 for which light emission intensities can be controlled independently of each other. Accordingly, with respect to the light emission intensities of each lighting portion 851, it is only necessary to take into consideration image signals that are input into pixels that are within a region illuminated by the relevant lighting portion 851. More specifically, it can be considered that, in the liquid crystal display device of the present embodiment, a plurality of small displays exist within the screen.

In FIG. 31, each lighting portion 851 includes an r light source, a g light source and a b light source that can be controlled independently of each other. Thus, as shown in FIG. 30, in each light emitting region 850, not just the light emission intensity, but also the color can be changed.

In this connection, the backlight 802 may be driven with only a white monochromatic color, and in such a case, it is sufficient to replace all of the r light sources, the g light sources, and the b light sources with a w light source.

According to the present embodiment, input signals RGB are input to the backlight intensity determination circuit, and backlight intensity signals rgb for each light emitting region 850 are output. A method of determining the backlight intensities for each light emitting region 850 is almost the same as the method described in Embodiments 2 to 7. A difference between the method according to the present embodiment and the method described in Embodiments 2 to 7 is that, although according to the method described in Embodiments 2 to 7 maximum values are determined with respect to all pixels when determining the backlight intensities, according to the present embodiment the condition "all pixels" is replaced with the condition "all pixels in the light emitting region".

An algorithm corresponding to Embodiments 2 to 7, respectively, may be used as it is in the color conversion circuit of the present embodiment.

Figure 32:
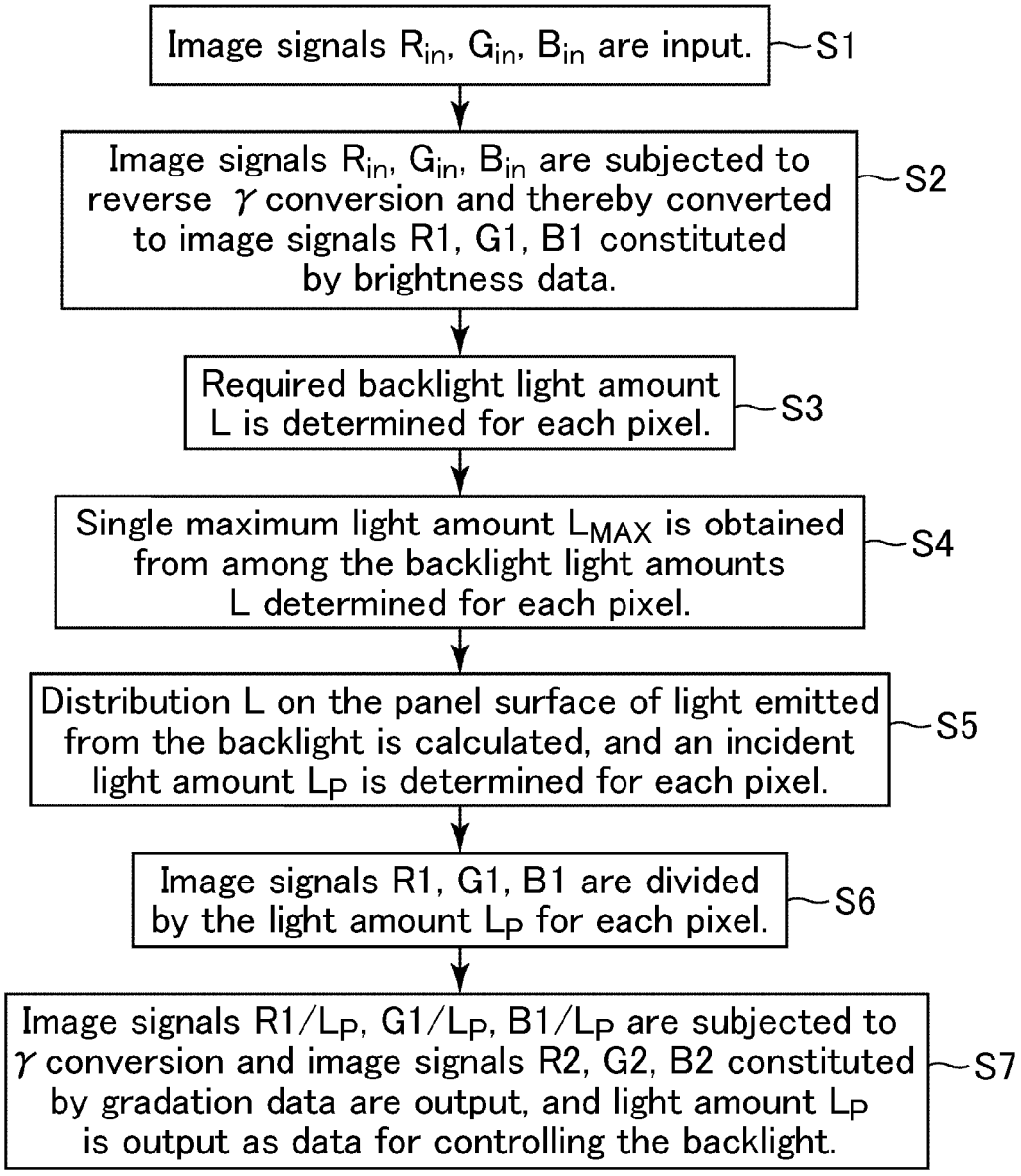
FIG. 32 is a view that illustrates a flow of processing in a backlight intensity determination circuit according to Embodiment 8.

FIG. 32 shows the flow of processing in the backlight intensity determination circuit according to Embodiment 8. In the backlight intensity determination circuit according to the present embodiment, the following processing is performed for each single frame.

First, RGB image (video) signals $R_{in}$, $G_{in}$, $B_{in}$ that are constituted by gradation data are input (S1).

Next, the image signals $R_{in}$, $G_{in}$, $B_{in}$ are subjected to reverse gamma conversion and thereby converted to image signals R1, G1, B1 constituted by brightness data (S2).

Next, a required backlight light amount L is determined for each pixel (S3).

Next, a single maximum brightness $L_{MAX}$ is determined for each light emitting region from among the backlight light amounts L determined for each pixel (S4).

Subsequently, a distribution L on the panel surface of light emitted from the backlight is calculated, and an incident light amount $L_P$ is determined for each pixel (S5).

Next, the image signals R1, G1, B1 are divided by the light amount $L_p$ for each pixel to calculate image signals $R1/L_P$, $G1/L_P$, $B1/L_P$ (S6).

Thereafter, the image signals $R1/L_P$, $G1/L_P$, $B1/L_P$ are subjected to gamma conversion and image signals R2, G2, B2 constituted by gradation data are output, and in addition, the light amount $L_{MAX}$ is output as data for controlling the backlight (S7).

In this connection, when adopting rgb light sources, it is sufficient to calculate a light amount in each step for each color.

Figure 33:
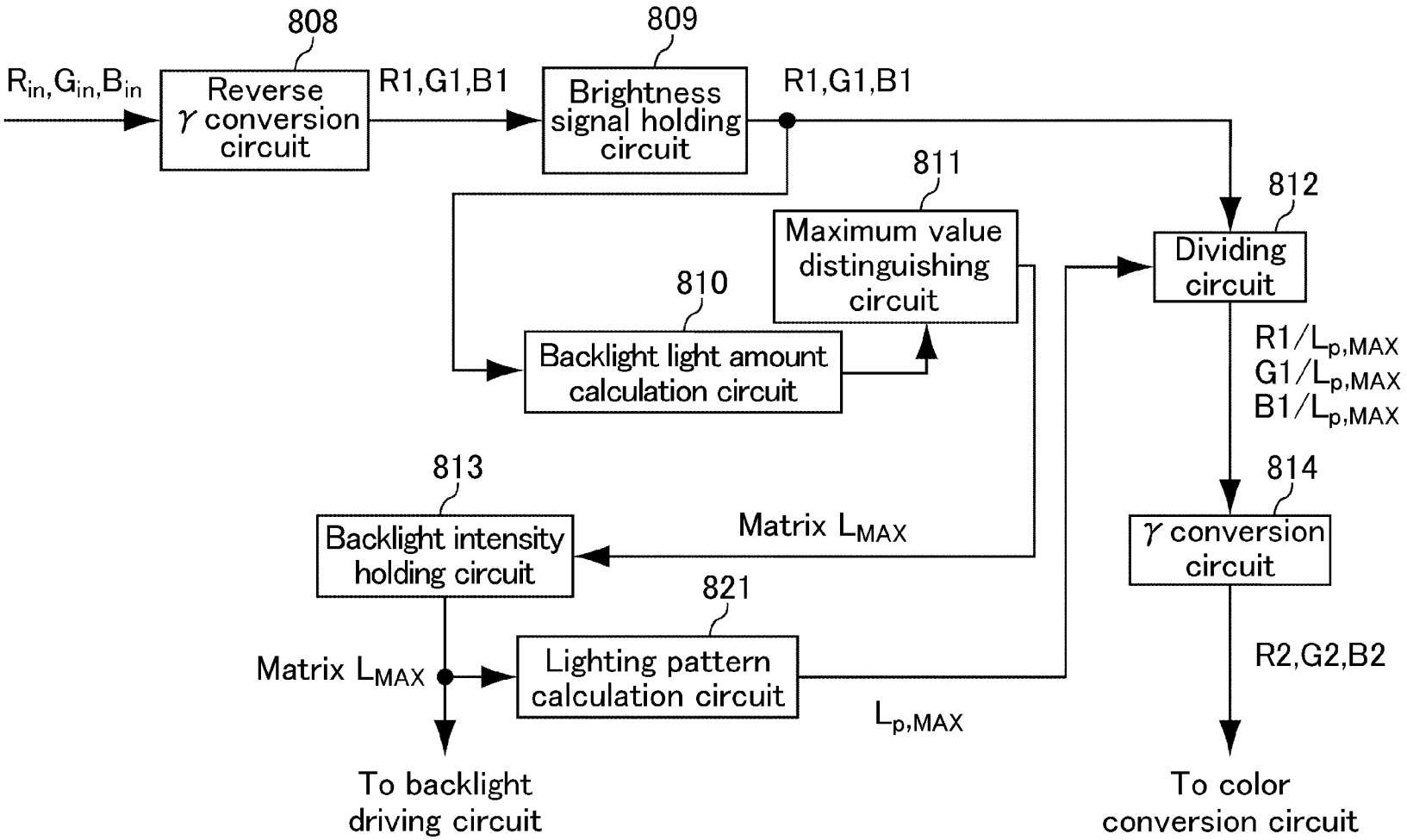
FIG. 33 shows a block diagram of a backlight intensity determination circuit according to Embodiment 8.

FIG. 33 shows a block diagram of the backlight intensity determination circuit according to Embodiment 8.

As shown in FIG. 33, the backlight intensity determination circuit according to Embodiment 8 includes a reverse gamma conversion circuit 808, a brightness signal holding circuit 809, a backlight light amount calculation circuit 810, a maximum value distinguishing circuit 811, a dividing circuit 812, a backlight intensity holding circuit 813, a gamma conversion circuit 814, and a lighting pattern calculation circuit 821.

The reverse gamma conversion circuit 808 subjects the image signals $R_{in}$, $G_{in}$, $B_{in}$ to reverse gamma conversion to generate image signals R1, G1, B1 constituted by brightness data. The image signals R1, G1, B1 are output to the brightness signal holding circuit 809, and stored for a fixed period (for example, a period of one frame).

The backlight light amount calculation circuit 810 calculates a required backlight light amount L for each pixel based on image signals R1, G1, B1 output from the brightness signal holding circuit 809 as described above.

The maximum value distinguishing circuit 811 determines one maximum brightness within each light emitting region from among the backlight light amounts L for each pixel that are output from the backlight light amount calculation circuit 810, and generates a matrix $L_{MAX}$ constituted by the brightness values.

The backlight intensity holding circuit 813 stores the matrix $L_{MAX}$ output from the maximum value distinguishing circuit 811 for a fixed period (for example, a period of one frame), and also outputs the matrix $L_{MAX}$ to the backlight driving circuit and the lighting pattern calculation circuit 821.

Figure 34:
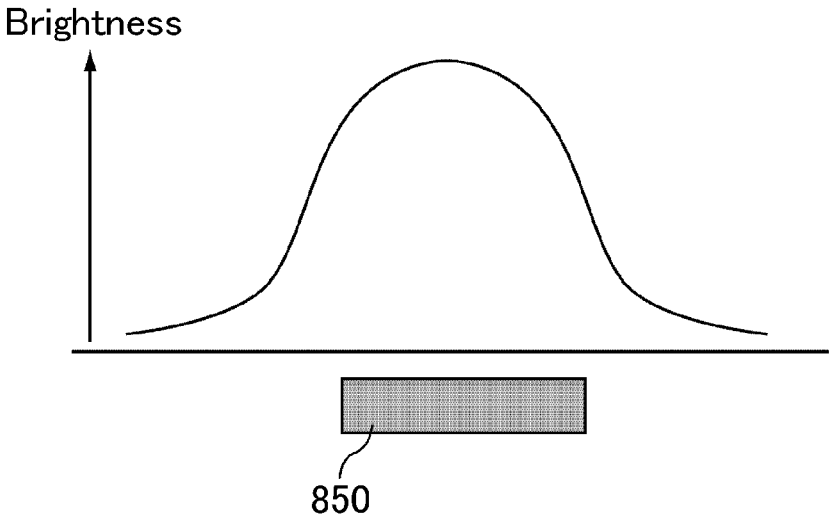
FIG. 34 is a view for describing a function of a lighting pattern calculation circuit according to Embodiment 8.
Figure 35:
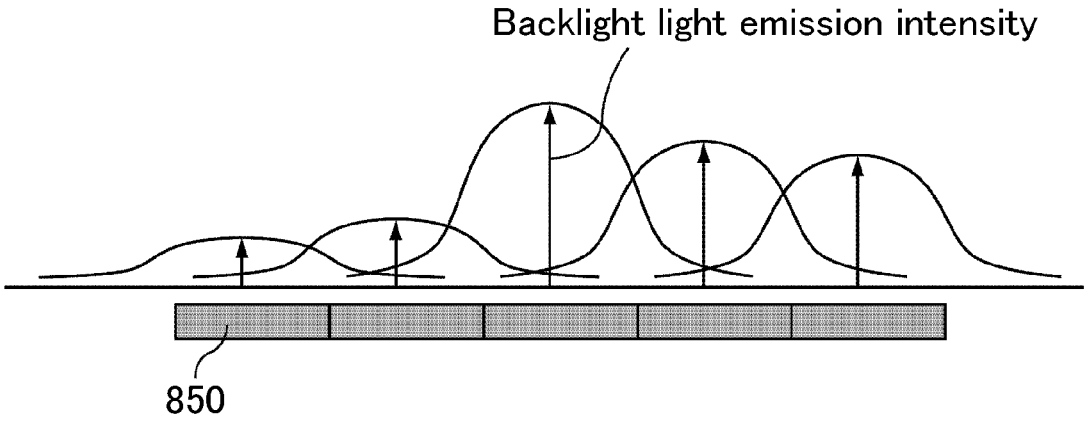
FIG. 35 is a view for describing a function of a lighting pattern calculation circuit according to Embodiment 8.

As shown in FIG. 34, the lighting pattern calculation circuit 821 holds a brightness distribution on the panel surface (irradiated surface of the panel) that arises when a certain light emitting region 850 is lit. Further, as shown in FIG. 35, the lighting pattern calculation circuit 821 calculates the manner in which the brightness distribution (lighting pattern) is manifested on the panel surface with respect to the entire display region based on the input matrix $L_{MAX}$. More specifically, the lighting pattern calculation circuit 821 adds the brightness distributions on the panel surface of all display region with respect to all brightness values included in the matrix $L_{MAX}$ and calculates a lighting pattern. Subsequently, the lighting pattern calculation circuit 821 determines a light amount that is incident on each pixel based on the lighting pattern, and generates a matrix $L_{p,MAX}$ constituted by the light amounts.

The dividing circuit 812 divides the image signals R1, G1, B1 output from the brightness signal holding circuit 809 by corresponding brightness values of the matrix $L_{p,MAX}$ for each pixel, and thereby calculates image signals R1/$L_{p,MAX}$, G1/$L_{p,MAX}$, B1/$L_{p,MAX}$.

The gamma conversion circuit 814 subjects the image signals R1/$L_{p,MAX}$, G1/$L_{p,MAX}$, B1/$L_{p,MAX}$ output from the dividing circuit 812 to gamma conversion to generate image signals R2, G2, B2 constituted by gradation data, and outputs the generated image signals R2, G2, B2 to the color conversion circuit.

Figure 36:
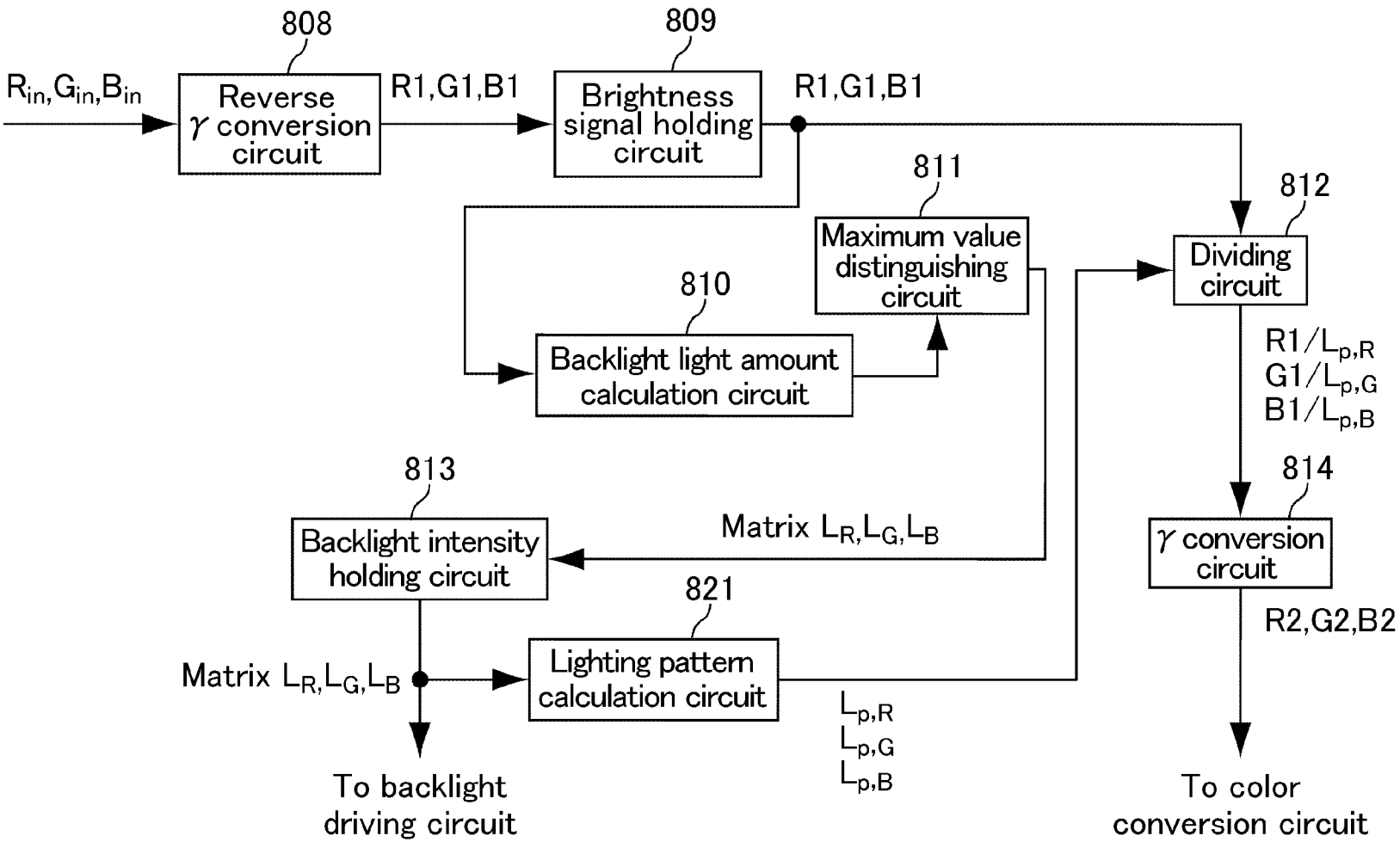
FIG. 36 shows a block diagram illustrating another configuration of the backlight intensity determination circuit according to Embodiment 8.

FIG. 36 illustrates a block diagram showing another configuration of the backlight intensity determination circuit of Embodiment 8.

In FIG. 36, the backlight light amount calculation circuit 810 calculates required backlight light amounts L(R), L(G), L(B) for each picture element with respect to the light source of each of the colors R, G and B based on the image signals R1, G1, B1 output from the brightness signal holding circuit 809.

The maximum value distinguishing circuit 811 determines one maximum brightness within each light emitting region from among the backlight light amounts L(R) of each pixel that are output from the backlight light amount calculation circuit 810, and generates a matrix $L_R$ constituted by the brightness values. Likewise, the maximum value distinguishing circuit 811 determines one maximum brightness within each light emitting region from among the backlight light amounts L(G) of each pixel that are output from the backlight light amount calculation circuit 810, and generates a matrix $L_G$ constituted by the brightness values. Further, the maximum value distinguishing circuit 811 determines one maximum brightness within each light emitting region from among the backlight light amounts L(B) of each pixel that are output from the backlight light amount calculation circuit 810, and generates a matrix $L_B$ constituted by the brightness values.

The backlight intensity holding circuit 813 stores the matrices $L_R$, $L_G$, $L_B$ that are output from the maximum value distinguishing circuit 811 for a fixed period (for example, a period of one frame), and also outputs the matrices $L_R$, $L_G$, $L_B$ to the backlight driving circuit and the lighting pattern calculation circuit 821.

The lighting pattern calculation circuit 821 adds brightness distributions on the panel of brightness values included in the matrix $L_R$, to thereby calculate a lighting pattern for R. Based on the lighting pattern for R, the lighting pattern calculation circuit 821 determines light amounts incident on each R picture element and thereby generates a matrix $L_{p,R}$ constituted by the light amounts. The lighting pattern calculation circuit 821 also adds brightness distributions on the panel of brightness values included in the matrix $L_G$, to thereby calculate a lighting pattern for G. Based on the lighting pattern for G, the lighting pattern calculation circuit 821 determines light amounts incident on each G picture element and thereby generates a matrix $L_{p,G}$ constituted by the light amounts. Furthermore, the lighting pattern calculation circuit 821 adds brightness distributions on the panel of brightness values included in the matrix $L_B$, to thereby calculate a lighting pattern for B. Based on the lighting pattern for B, the lighting pattern calculation circuit 821 determines light amounts incident on each B picture element and thereby generates a matrix $L_{p,B}$, constituted by the light amounts.

The dividing circuit 812 divides the image signals R1, G1, B1 output from the brightness signal holding circuit 809 by corresponding brightness values of the matrices $L_{p,R}$, $L_{p,G}$, $L_{p,B}$, for each pixel, and thereby calculates image signals R1/$L_{p,R}$, G1/$L_{p,G}$, B1/$L_{p,B}$.

The gamma conversion circuit 814 subjects the image signals R1/$L_{p,R}$, G1/$L_{p,G}$, B1/$L_{p,B}$ output from the dividing circuit 812 to gamma conversion to generate image signals R2, G2, B2 constituted by gradation data, and outputs the generated image signals R2, G2, B2 to the color conversion circuit.

Figure 37:
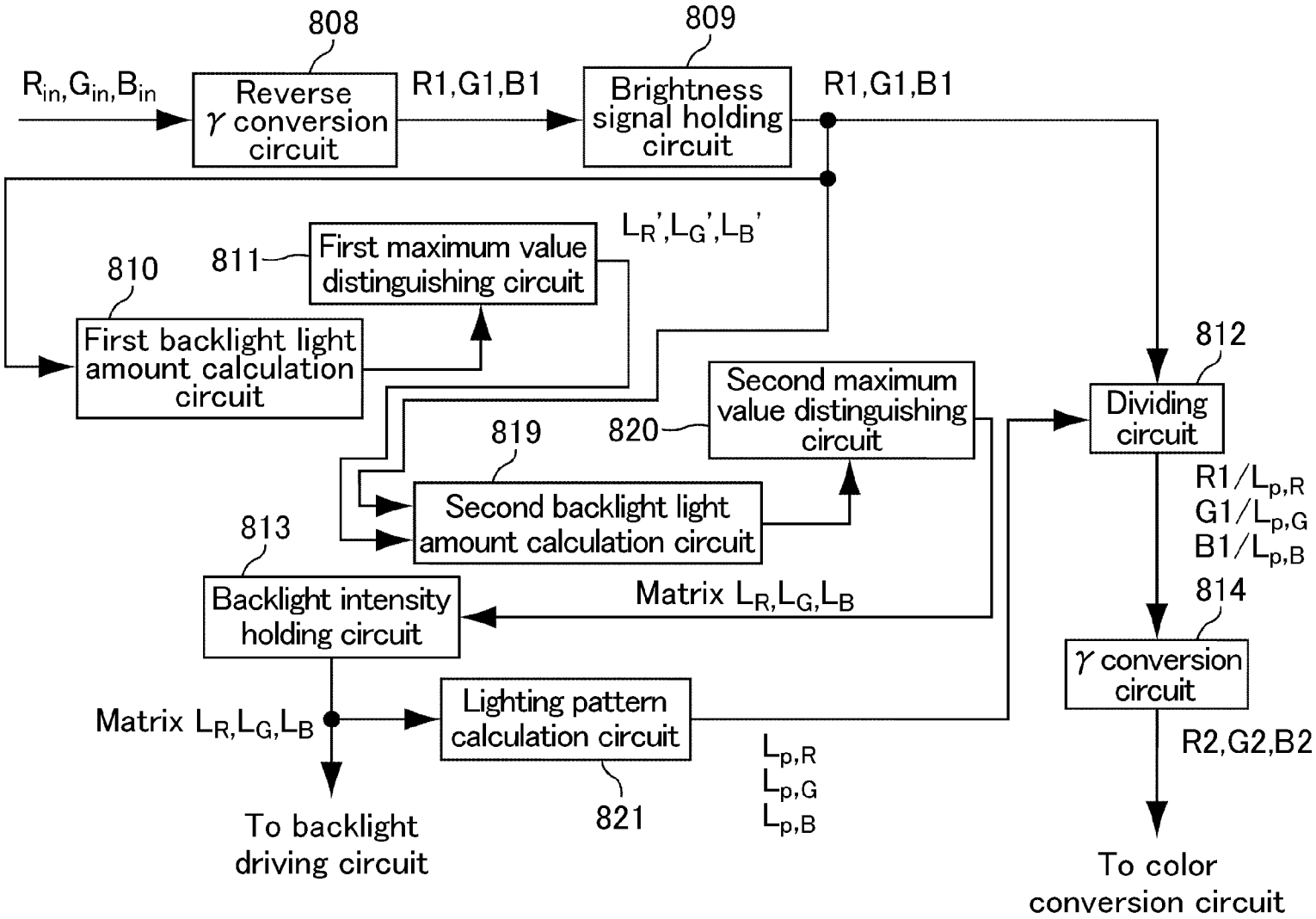
FIG. 37 shows a block diagram illustrating another configuration of the backlight intensity determination circuit according to Embodiment 8.

FIG. 37 illustrates a block diagram showing another configuration of the backlight intensity determination circuit of Embodiment 8.

In FIG. 37, the backlight light amount calculation circuit 810 calculates required backlight light amounts L(R), L(G), L(B) for each picture element with respect to the light source of each of the colors R, G and B based on the image signals R1, G1, B1 output from the brightness signal holding circuit 809.

The maximum value distinguishing circuit 811 determines one maximum brightness within each light emitting region from among the backlight light amounts L(R) of each pixel that are output from the backlight light amount calculation circuit 810, and generates a matrix $L_R'$ (assumed matrix) constituted by the brightness values. The maximum value distinguishing circuit 811 also determines one maximum brightness within each light emitting region from among the backlight light amounts L(G) of each pixel that are output from the backlight light amount calculation circuit 810, and generates a matrix $L_G'$ (assumed matrix) constituted by the brightness values. Further, the maximum value distinguishing circuit 811 also determines one maximum brightness within each light emitting region from among the backlight light amounts L(B) of each pixel that are output from the backlight light amount calculation circuit 810, and generates a matrix $L_B'$ (assumed matrix) constituted by the brightness values.

A backlight light amount calculation circuit 819 recalculates required backlight light amounts L2(R), L2(G), L2(B) for each picture element with respect to the light source of each of the colors R, G and B based on the image signals R1, G1, B1 output from the brightness signal holding circuit 809 and the matrices $L_R'$, $L_G'$, $L_B'$ output from the maximum value distinguishing circuit 811.

A maximum value distinguishing circuit 820 determines one maximum brightness within each light emitting region from among the backlight light amounts L2(R) of each pixel that are output from the backlight light amount calculation circuit 819, and generates a matrix $L_R$ constituted by the brightness values. The maximum value distinguishing circuit 820 also determines one maximum brightness within each light emitting region from among the backlight light amounts L2(G) of each pixel that are output from the backlight light amount calculation circuit 819, and generates a matrix $L_G$ constituted by the brightness values. Likewise, the maximum value distinguishing circuit 820 determines one maximum brightness within each light emitting region from among the backlight light amounts L2(B) of each pixel that are output from the backlight light amount calculation circuit 819, and generates a matrix $L_B$ constituted by the brightness values.

Note that, in the form shown in FIG. 37, the number of times of calculating the backlight intensities is not particularly limited to two times, and may be three times or more.

Further, in the form shown in FIG. 37, the number of maximum value distinguishing circuits need not necessarily be the same as the number of backlight light amount calculation circuits, and may be less than the number of backlight light amount calculation circuits, and for example, one maximum value distinguishing circuit may be provided. More specifically, for example, a configuration may be adopted in which the maximum value distinguishing circuit 820 is not provided, and in which the matrices $L_R$, $L_G$, $L_B$ are determined by the maximum value distinguishing circuit 811.

Thus, according to the present embodiment also, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

In a case where the backlight is not split into a plurality of light emitting regions, it is necessary to determine the light emission intensities of the backlight in conformity with portions that require the most light in the entire display image. In addition to widening the color reproduction range on a chromaticity diagram, another benefit that may be mentioned of a four-color panel in which a picture element other than RGB has been added is that the light utilization efficiency is enhanced by adding a picture element with a greater transmittance amount than RGB. However, in the case of uniformly controlling light emission intensities of a backlight over the entire light emitting surface (when uniformly controlling the entire surface), unless the light emission intensity of the backlight is made stronger than at the time of a white display, instances in which the required brightness can not be secured in a chromaticity range in the vicinity of a monochromatic color will increase. More specifically, there are cases in which unless the light emission intensities of the backlight are increased, the light utilization efficiency can not be effectively improved and, as a result, power consumption can not be effectively reduced. In contrast, by combining an area-active backlight system and a four-color panel, the number of cases in which the light emission intensities of the backlight must be made stronger than at the time of a white display can be reduced in comparison to when performing uniform control of the entire screen. As a result, lower power consumption can be realized.

EMBODIMENT 9

A liquid crystal display device of the present embodiment has the same configuration as in Embodiments 2 to 8, except that instead of the liquid crystal display panel that has color filters of four colors, the liquid crystal display device of the present embodiment includes a liquid crystal display panel that has color filters of five colors.

Although a case is described here in which yellow and cyan (C) color filters are added, as examples of two colors than can be applied other than R, G and B, any two colors among yellow, cyan (C), and magenta, or any one of the aforementioned three colors and white may be mentioned.

FIG. 38 is a planar schematic view that illustrates a pixel array of the liquid crystal display device according to Embodiment 9.

According to the present embodiment, as shown in FIG. 38, each of a plurality of pixels arrayed in a matrix shape includes picture elements (dots) of five colors, namely, an R picture element 13R, a G picture element 13G, a B picture element 13B, a Y picture element 13Y and a C picture element 13C.

Figure 39:
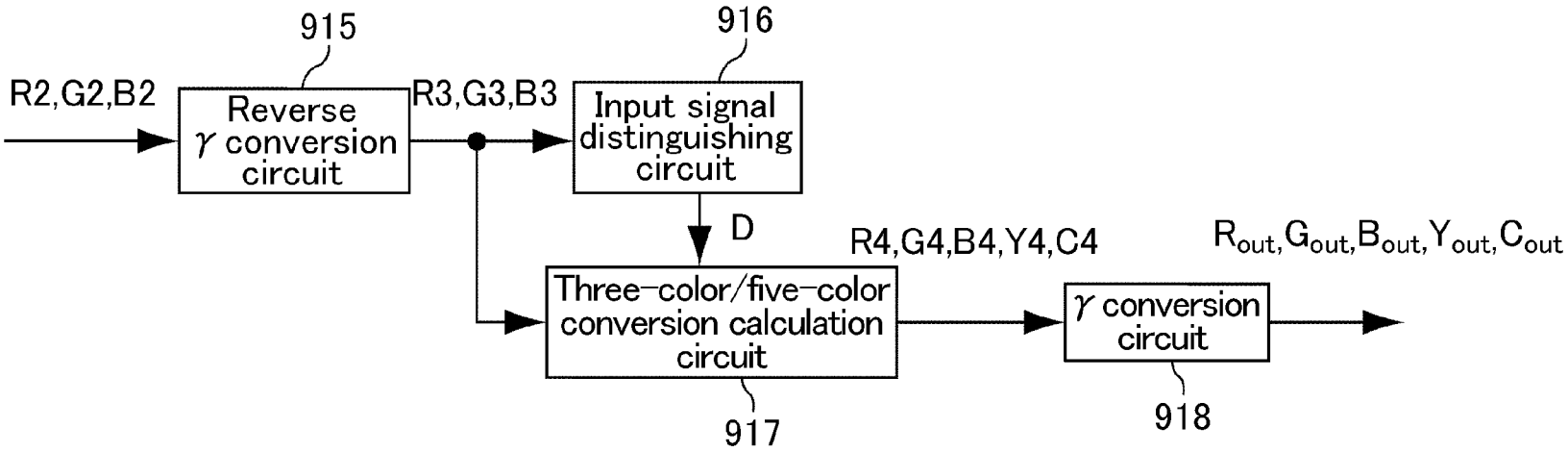
FIG. 39 shows a block diagram of a color conversion circuit according to Embodiment 9.
Figure 40:
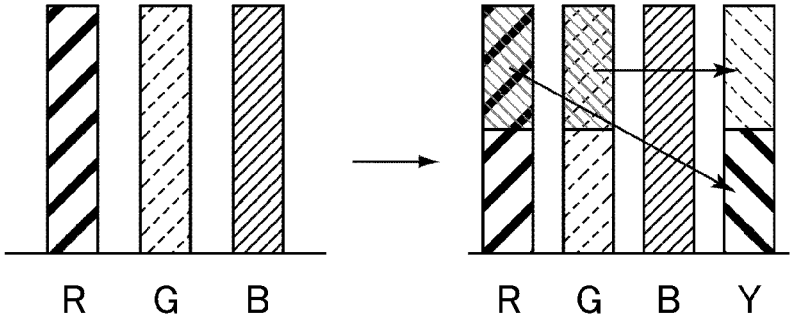
Fig. 40 PRIOR ART
FIG. 40 is a view for explaining a problem of a conventional liquid crystal display device that includes a multiple primary color panel.
Figure 41:
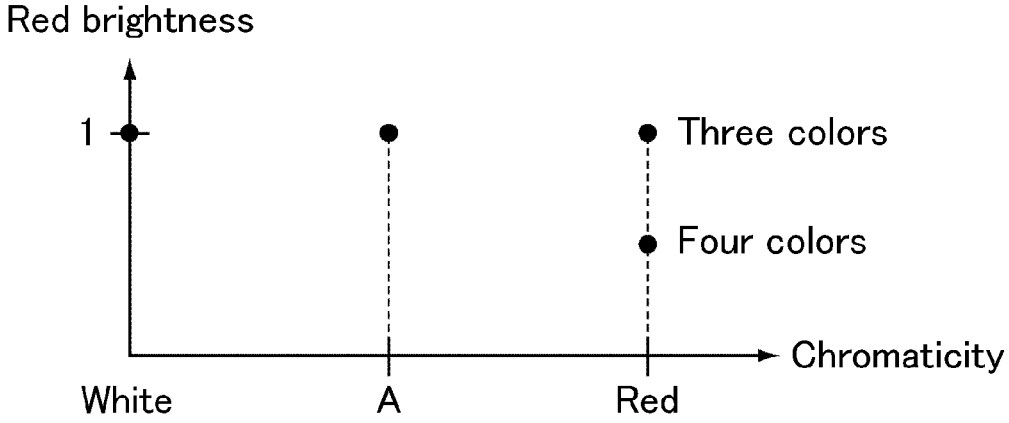
Fig. 41 PRIOR ART
FIG. 41 is a view for explaining a problem of a conventional liquid crystal display device that includes a multiple primary color panel.
Figure 42:
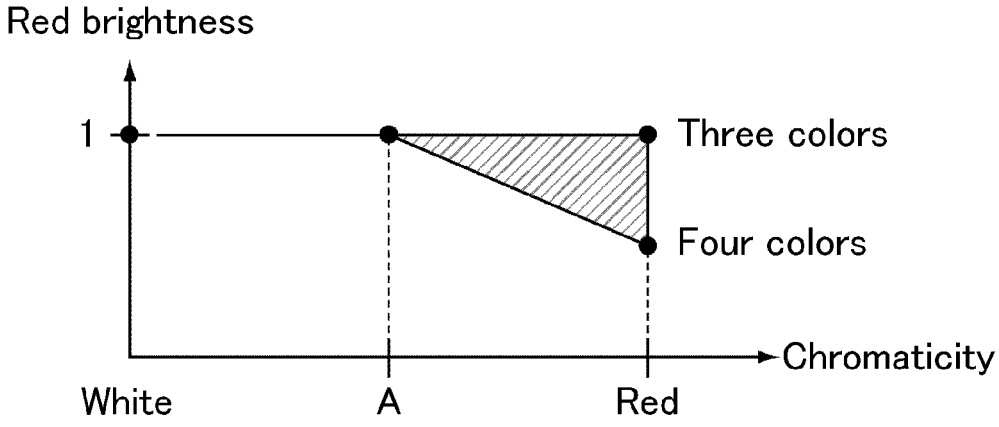
Fig. 42 PRIOR ART
FIG. 42 is a view for explaining a problem of a conventional liquid crystal display device that includes a multiple primary color panel.
Figure 43:
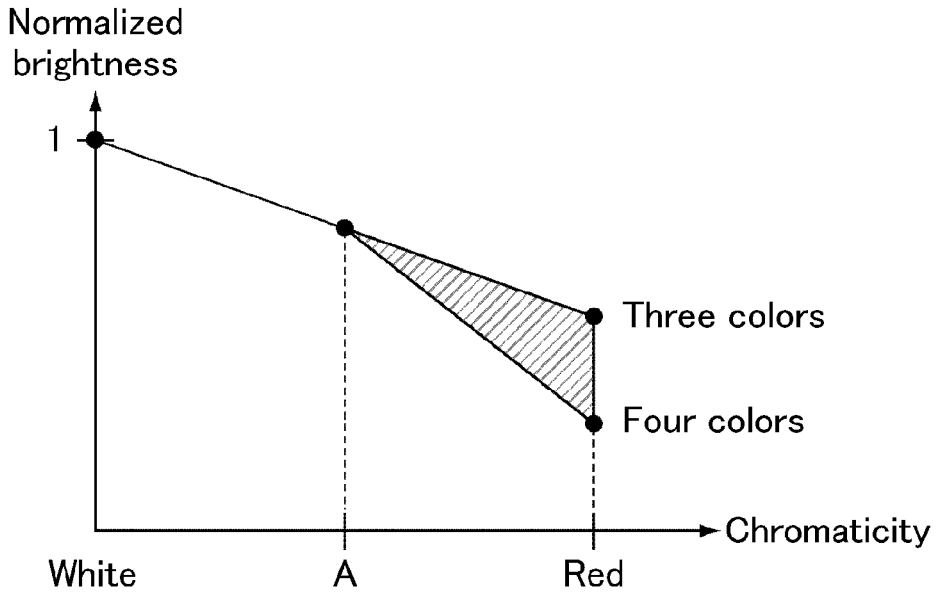
Fig. 43 PRIOR ART
FIG. 43 is a view for explaining a problem of a conventional liquid crystal display device that includes a multiple primary color panel.

FIG. 39 is a view showing a block diagram of a color conversion circuit of Embodiment 9.

As shown in FIG. 39, the color conversion circuit (three-color/five-color conversion circuit) of Embodiment 9 includes a reverse gamma conversion circuit 915, an input signal distinguishing circuit 916, a color conversion calculation circuit 917, and a gamma conversion circuit 918.

The reverse gamma conversion circuit 915 subjects image signals R2, G2, B2 to reverse gamma conversion to generate image signals R3, G3, B3 constituted by brightness data.

The input signal distinguishing circuit 916 determines an algorithm for converting the image signals R3, G3, B3 for three colors that are output from the reverse gamma conversion circuit 915 to image signals R4, G4, B4, Y4 for five colors. An algorithm for converting from three colors to five colors is the same as an algorithm for converting from three colors to four colors that is described above in Embodiments 2 to 8, except that the number of variables is different.

The color conversion calculation circuit 917 converts the image signals R3, G3, B3 for three colors to image signals R4, G4, B4, Y4, C4 for five colors by a conversion formula determined by means of a control signal D output from the input signal distinguishing circuit 916.

The gamma conversion circuit 918 subjects the image signals R4, G4, B4, Y4, C4 output from the color conversion calculation circuit 917 to gamma conversion to generate image signals $R_{out}$, $G_{out}$, $B_{out}$, $Y_{out}$, $C_{out}$ constituted by gradation data, and outputs the image signals $R_{out}$, $G_{out}$, $B_{out}$, $Y_{out}$, $C_{out}$ to the source driver.

In this connection, an algorithm for determining backlight intensities according to the present embodiment is also the same as an algorithm described above in Embodiments 2 to 8, except that the number of variables is different.

A block configuration of the liquid crystal display device of the present embodiment and a block configuration of the backlight intensity determination circuit of the present embodiment are the same as the configurations described in Embodiments 2 to 8.

Thus, according to the present embodiment also, since the light emission intensity of the backlight when displaying a monochromatic color or a color close to a monochromatic color is made greater than the light emission intensity when displaying white, it is possible to suppress a decrease in the brightness of a screen when displaying the vicinity of a monochromatic color.

Further, as described above, since the light emission intensity of the backlight is controlled in accordance with image signals input, an increase in power consumption can be suppressed.

Moreover, since the liquid crystal display panel of the present embodiment includes picture elements of five colors (five-primary-color panel), the color reproduction range can be widened more than in the above described embodiments.

The present application claims priority to Patent Application No. 2009-265386 filed in Japan on Nov. 20, 2009 under the Paris Convention and provisions of national law in a designated State, the entire contents of which are hereby incorporated by reference.

REFERENCE SIGNS LIST

2, 3: Transparent substrate
4: Liquid crystal layer
5: Pixel electrode
6: Opposed electrode
7R, 7G, 7B, 7Y: Color filter
9, 10: Alignment layer
11, 12: Polarizer
13R, 13G, 13B, 13Y, 13C: Picture element

14: Pixel
101, 201: Liquid crystal display panel
102, 202, 802: Backlight
203: Backlight intensity determination circuit
204: Color conversion circuit (three-color/four-color conversion circuit)
205: Backlight driving circuit
206: Source driver
207: Gate driver
208, 215, 315, 408, 608, 808, 915: Reverse gamma conversion circuit
209, 409, 609, 809: Brightness signal holding circuit
210, 410, 610, 619, 810, 819: Backlight light amount calculation circuit
211, 411, 611, 620, 811, 820: Maximum value distinguishing circuit
212, 412, 612, 812: Dividing circuit
213, 413, 613, 813: Backlight intensity holding circuit
214, 218, 318, 414, 614, 814, 918: Gamma conversion circuit
216, 316, 916: Input signal distinguishing circuit
217, 317, 917: Color conversion calculation circuit
821: Lighting pattern calculation circuit
850: Light emitting region
851: Lighting portion

The invention claimed is:

1. A liquid crystal display device that performs display by input thereto of image signals for three colors, red, green, and blue, from outside, the liquid crystal display device comprising:

a liquid crystal display panel and a backlight, wherein:

a plurality of pixels each including picture elements of four colors or more are arranged in a display region of the liquid crystal display panel;

each pixel includes red, green, and blue picture elements, provided with red, green, and blue color filters having colors corresponding to the respective colors of the image signals, and a picture element of another color, provided with a color filter having another color other than the colors of the image signals;

a light emission intensity of the backlight can be controlled in accordance with image signals input;

the light emission intensity of the backlight when a monochromatic color or a color close to a monochromatic color is displayed in the display region is greater than the light emission intensity when white is displayed in the display region, provided that the term "color close to a monochromatic color" refers to a color when a picture element that transmits light of which components include the monochromatic color and that is included in the picture element of the another color is set to a gradation other than a highest gradation, and a picture element that transmits the monochromatic color is set to a highest gradation;

the picture element of the another color is a yellow picture element provided with a yellow color filter;

the light emission intensity of the backlight is set to a maximum value among the following five values determined for each pixel:

$R$, $G$, $B$, $(1+\beta)\times G-\beta\times(1+\alpha)/\alpha\times R$, and $(1+\alpha)\times R-\alpha\times(1+\beta)/\beta\times G$; and wherein R, G, and B represent intensity of light radiated from the red, green, and blue picture elements, respectively, $\alpha$ represents a ratio of a transmittance amount of red light from the yellow color filter to a transmittance amount of red light from the red color filter, and $\beta$ represents a ratio of a transmittance amount of green light from the yellow color filter to a transmittance amount of green light from the green color filter.

2. The liquid crystal display device according to claim 1, wherein:

the backlight includes a plurality of lighting portions whose light emission intensities can be controlled independently of each other; and the light emission intensity of any one of the lighting portions for a certain section of the display region when the monochromatic color or the color close to the monochromatic color is displayed in the section is greater than the light emission intensity when white is displayed in the section.

3. A liquid crystal display device that performs display by input thereto of image signals for three colors from outside, the liquid crystal display device comprising a liquid crystal display panel, a backlight, and a backlight intensity determination circuit that determines a light emission intensity of the backlight for each frame, wherein:

a plurality of pixels each including picture elements of four colors or more are arranged in a display region of the liquid crystal display panel;

each pixel includes picture elements of three colors, provided with color filters having colors corresponding to the respective colors of the image signals, and at least one picture element of other color(s), provided with a color filter having a color corresponding to a color other than the colors of the image signals;

a light emission intensity of the backlight can be controlled in accordance with image signals input;

the backlight intensity determination circuit includes:

a first backlight light amount calculation circuit that converts image signals for three colors that are input from outside into first signals for four colors or more that correspond to the colors of the picture elements and determines required minimum light emission intensities of the backlight for the respective pixels based on the first signals for four colors or more, a first maximum value distinguishing circuit that determines a largest light emission intensity among the required minimum light emission intensities;

a second backlight light amount calculation circuit that converts the image signals for three colors into second signals for four colors or more corresponding to the colors of the picture elements using the light emission intensity determined by the first maximum value distinguishing circuit, and determines required minimum light emission intensities of the backlight for the respective pixels based on the second signals for four colors or more, and a second maximum value distinguishing circuit that determines a largest light emission intensity among the required minimum light emission intensities calculated by the second backlight light amount calculation circuit; and the backlight emits light with the light emission intensity determined by the second maximum value distinguishing circuit.

4. The liquid crystal display device according to claim 3, wherein:

each of the image signals for three colors comprises gradation data; and the backlight intensity determination circuit further includes:

a reverse gamma conversion circuit that subjects the image signals that comprise gradation data to reverse gamma conversion to generate image signals for three colors that comprise brightness data; and a dividing circuit that divides the image signals for three colors that comprise brightness data by the largest light emission intensity.

5. The liquid crystal display device according to claim 3, wherein:

the backlight includes a plurality of lighting portions whose light emission intensities can be controlled independently of each other;

the first and second maximum value distinguishing circuits determine a largest light emission intensity among the required minimum light emission intensities for the respective sections of the display region that correspond to the respective lighting portions; and the backlight intensity determination circuit further includes a lighting pattern calculation circuit that adds brightness distributions on an irradiated surface of the panel when the lighting portions emit light with the light emission intensities determined by the second maximum value distinguishing circuit.

6. A control method for a liquid crystal display device that performs display by input thereto of image signals for three colors from outside, the liquid crystal display device comprising a liquid crystal display panel and a backlight, wherein:

a plurality of pixels each including picture elements of four colors or more are formed in a display region of the liquid crystal display panel;

each pixel includes picture elements of three colors, provided with color filters having colors corresponding to the respective colors of the image signals, and at least one picture element of other color(s), provided with a color filter having a color corresponding to a color other than the colors of the image signals; and a light emission intensity of the backlight can be controlled in accordance with image signals input;

the control method including a backlight intensity determination step of determining a light emission intensity of the backlight for each frame, wherein:

the backlight intensity determination step includes:

(1) a step of converting image signals for three colors that are input from outside into first signals for four colors or more that correspond to the colors of the picture elements, and determining required minimum light emission intensities of the backlight for the respective pixels based on the first signals for four colors or more, (2) a step of determining a largest light emission intensity among the required minimum light emission intensities;

(3) a step of converting the image signals for three colors into second signals for four colors or more corresponding to the colors of the picture elements using the light emission intensity determined in the step (2), and determining required minimum light emission intensities of the backlight for the respective pixels based on the second signals for four colors or more, and (4) a step of determining a largest light emission intensity among the required minimum light emission intensities calculated in the step (3); and the backlight emits light with the light emission intensity determined in the step (4).

7. The control method for a liquid crystal display device according to claim 6, wherein:

each of the image signals for three colors comprises gradation data; and the backlight intensity determination step further includes:

(5) a step of subjecting the image signals that comprise gradation data to reverse gamma conversion to generate image signals for three colors that comprise brightness data, and (6) a step of dividing the image signals for three colors that comprise brightness data by the largest light emission intensity.

8. The control method for a liquid crystal display device according to claim 6, wherein:

the backlight includes a plurality of lighting portions whose light emission intensities can be controlled independently of each other;

in the steps (2) and (4), a largest light emission intensity among the required minimum light emission intensities is determined for the respective sections of the display region that correspond to the respective lighting portions; and the backlight intensity determination step further includes (5) a step of adding brightness distributions on an irradiated surface of the panel when the lighting portions emit light with the light emission intensities determined in the step (4).

* * * * *